US007438375B2

(12) United States Patent
Arazaki

(10) Patent No.: US 7,438,375 B2
(45) Date of Patent: Oct. 21, 2008

(54) PRINTING DEVICE, PRINTING DEVICE CONTROL PROGRAM AND METHOD, AND PRINTING DATA GENERATION DEVICE, PROGRAM, AND METHOD

(75) Inventor: Shinichi Arazaki, Shimosuwa (JP)

(73) Assignee: Seiko Epson Corporation (JP)

( * ) Notice: Subject to any disclaimer, the term of this patent is extended or adjusted under 35 U.S.C. 154(b) by 336 days.

(21) Appl. No.: 11/321,299

(22) Filed: Dec. 27, 2005

(65) Prior Publication Data

US 2006/0146083 A1 Jul. 6, 2006

(30) Foreign Application Priority Data

Dec. 28, 2004 (JP) ..... 2004-379210
Sep. 13, 2005 (JP) ..... 2005-265356

(51) Int. Cl.
*B41J 2/206* (2006.01)

(52) U.S. Cl. ..... 347/15; 347/41

(58) Field of Classification Search ..... 347/14–16, 347/19, 41

See application file for complete search history.

(56) References Cited

U.S. PATENT DOCUMENTS 6,283,571 B1 9/2001 Zhou et al.
6,293,643 B1 9/2001 Shimada et al.
6,328,404 B1 12/2001 Fujimori
6,554,387 B1 * 4/2003 Otsuki ..... 347/19

FOREIGN PATENT DOCUMENTS

JP 01-235655 9/1989
JP 05-030361 2/1993
JP 05-092559 4/1993
JP 05-269990 10/1993
JP 11-151821 8/1999
JP 11-254662 9/1999
JP 2000-79710 3/2000
JP 2000-190470 7/2000
JP 2000-225716 8/2000
JP 2002-019101 1/2002
JP 2003-063043 3/2003
JP 2003-136702 5/2003

* cited by examiner

*Primary Examiner*—Thinh H Nguyen
(74) *Attorney, Agent, or Firm*—Harness, Dickey & Pierce, P.L.C.

(57) ABSTRACT

A printing device that prints an image onto a printing medium using a printing head that includes a plurality of nozzles each being capable of dot formation to the printing medium. The printing device includes: an image data acquisition unit that acquires image data showing pixel values of M (M≧2) for the image; a displacement amount information storage unit that stores information about an amount of a displacement observed to the printing medium by each of the nozzles between an actual dot formation position and an ideal dot formation position; a printing data generation unit that generates printing data including information about dot formation details based on the acquired image data and the displacement amount information for each of the pixel values, and for use as the information about the dot formation details, generates information about reducing degradation of printing image quality due to a banding problem caused by the displacement between the actual dot formation position and the ideal dot formation position, and exercises control over generating the degradation-reducing information based on the displacement amount information; and a printing unit that prints, based on the printing data, the image onto the printing medium using the printing head.

13 Claims, 27 Drawing Sheets

| | | |
|---|---|---|
| | TAR-GET PIXEL | 7/16 |
| 3/16 | 5/16 | 1/16 |

EXTRACTION OF TARGET DOT

AVOID BANDING
(PIXEL SIZE CHANGE BASED ON DISPLACEMENT DATA)

CHANGE OF TARGET PIXEL DOT

CHANGE OF BINARIZED DATA

DOT PATTERN OF SOLID-FILLED PATTERN

DOT PATTERN WITH INK DEFLECTION

DOT PATTERN OF INVENTION WITH MEASURE TAKEN AGAINST INK DEFLECTION

UNIT AREA :P × P(DotPich=P)

DENSITY OF X%:$P \times P \times X/100 = \pi \times R$ $\Rightarrow R = P \times \sqrt{\times 100/\pi}$ DENSITY OF 100%:$R10 = P/2 \times \sqrt{2} = P \times 0.707$ DENSITY OF 80%:$R8 = P \times \sqrt{0.8\pi} = P \times 0.505$ DENSITY OF 60%:$R6 = P \times \sqrt{0.6\pi} = P \times 0.437$ DENSITY OF 40%:$R4 = P \times \sqrt{0.4\pi} = P \times 0.357$ DENSITY OF 20%:$R2 = P \times \sqrt{0.2\pi} = P \times 0.252$ → x ↓ y

| | 0 | 1 | 2 | 3 | 4 | 5 |
|---|---|---|---|---|---|---|
| 0 | 100 | | 80 | | 20 | |
| 1 | | 0 | | 0 | | 0 |
| 2 | 60 | | 40 | | 0 | |
| 3 | | 0 | | 0 | | 0 |

→ x

↓ y

| | 0 | 1 | 2 | 3 | 4 | 5 |
|---|---|---|---|---|---|---|
| 0 | 80 | | 60 | | 20 | |
| 1 | | 80 | | 20 | | 0 |
| 2 | 40 | | 20 | | 0 | |
| 3 | | 20 | | 20 | | 0 |

→ x

↓ y

| | 0 | 1 | 2 | 3 | 4 | 5 |
|---|---|---|---|---|---|---|
| 0 | 100 | | 60 | | 60 | |
| 1 | | 0 | | 20 | | 20 |
| 2 | 60 | | 20 | | 60 | |
| 3 | | 0 | | 20 | | 20 |

→ x

↓ y

| | 0 | 1 | 2 | 3 | 4 | 5 |
|---|---|---|---|---|---|---|
| 0 | 80 | | 60 | | 60 | |
| 1 | | 80 | | 40 | | 0 |
| 2 | 40 | | 20 | | 60 | |
| 3 | | 20 | | 40 | | 0 |

→ x

↓ y

| | 0 | 1 | 2 | 3 | 4 | 5 |
|---|---|---|---|---|---|---|
| 0 | 80 | | 40 | | 80 | |
| 1 | | 80 | | 40 | | 0 |
| 2 | 40 | | 0 | | 80 | |
| 3 | | 20 | | 40 | | 0 |

PRINTING DEVICE, PRINTING DEVICE CONTROL PROGRAM AND METHOD, AND PRINTING DATA GENERATION DEVICE, PROGRAM, AND METHOD

RELATED APPLICATIONS

This application claims priority to Japanese Patent Application Nos. 2004-379210 filed Dec. 28, 2004 and 2005-265356 filed Sep. 13, 2005 which are hereby expressly incorporated by reference herein their entirety.

BACKGROUND

1. Technical Field

The present invention relates to a printing device for use with printers of facsimile machines, copying machines, OA equipment, and others, a printing device control program and method, and a printing data generation device, program, and method. More specifically, the present invention relates to a printing device of an ink jet type that is capable of text and image rendering onto a printing paper (printing medium) through discharge of liquid ink particles of various colors, a control program and method for such a printing device, and a printing data generation device, program, and method.

2. Related Art

Described below is a printing device, specifically a printer of an ink jet type (hereinafter, referred to as ink jet printer").

With the reason of relatively inexpensive price and the ease of achieving high-quality color printing, an ink jet printer has become widely popular not only for office use but also for personal use with the spread of personal computers, digital cameras, and others.

Such an ink jet printer generally performs text and image rendering on a printing medium (paper) using a moving element in a predetermined manner so that any desired printing is achieved. More in detail, the moving element referred to as carriage includes an ink cartridge and a printing head as a piece, reciprocating on the printing medium in the direction perpendicular to the paper feeding direction, and discharging (ejecting) liquid ink droplets in dots from the nozzles provided to the printing head. If the carriage is provided with ink cartridges of four colors, i.e., black, yellow, magenta, and cyan, and their each corresponding printing head, full-color printing becomes possible in addition to monochrome printing by color mixture. Better still, the ink cartridges of six, seven, or eight colors additionally with light cyan, light magenta, and others are also in practical use.

There is a problem with such an ink jet printer of a type performing printing with the printer head reciprocating on the carriage in the direction perpendicular to the printing paper. That is, to derive a clearly-printed page, the printing head is required with frequent reciprocating movements, e.g., several tens to a hundred or more. This results in a drawback of a longer printing time compared with other types of printing device such as electrophotographic laser printers or others, e.g., copying machines.

On the other hand, with an ink jet printer of a type using no carriage but a long printing head having the same width as that of the printing paper or longer, there is no need to move the printing head in the width direction of the printing paper. This accordingly allows printing with a single scan, i.e., a single path, favorably leading to high-speed printing as can be with the laser printers. What is better, this eliminates the need for a carriage with a printing head, and a drive system for moving the carriage, thereby reducing the size and weight of the cabinet of the printer, and the noise to a considerable degree.

Note here that the ink jet printer of the former type is generally referred to as "multi-path printer", and the ink jet printer of the latter type as "line-head printer" or "serial printer".

The issue with such an ink jet printer is the manufacturing deviation observed in the printing head that serves an essential role for the printer. The manufacturing deviation is resulted from the configuration of the printing head, carrying very small nozzles of about 10 to 70 μm in diameter in a line at regular intervals, or in a plurality of lines in the printing direction. In such a configuration, the nozzle may be partially misaligned so that the ink discharge direction is incorrectly angled, or the nozzles may not be correctly disposed as they are expected to be so that the nozzles resultantly fail in forming dots at their ideal positions, i.e., causes ink deflection. Because the nozzles often show a wide range of variation in the ink amount, if the variation is too much, the ink amount to be discharged from the nozzle is considerably large or small compared with the ideal amount of ink.

As a result, an image part printed by such a faulty nozzle suffers a printing failure, i.e., so-called banding (streaking) problem, resultantly reducing the printing quality considerably. More in detail, with ink deflection occurred, the dot-to-dot distance between dots formed by any adjacent nozzles becomes not uniform. When such a dot-to-dot distance is longer than usual, the corresponding part suffers from white streaks when the printing paper is white in color. When the dot-to-dot distance is shorter than usual, the corresponding part suffers from dark streaks. When the amount of ink coming from any of the nozzles is not ideal and is a lot, the part for the nozzle suffers from dark streaks, and when the amount of ink is little, the part suffers from white streaks.

Such a banding problem is often observed in "line head printers" in which a printing head or a printing medium is fixed, i.e., printing with a single scan, compared with the above-described "multi-path printers" (serial printers). This is because the multi-path printers are adopting the technology of making white streaks less noticeable utilizing the frequent reciprocating movements of the printing head.

For the purpose of preventing printing failures caused by the banding problem, research and development has been actively conducted from the hardware perspective, e.g., improving the manufacturing technology of the printing head, or improving the design thereof. However, from the perspective of manufacturing cost, the printing quality, the technology, or others, it is found difficult to provide a printing head perfectly free from the banding problem.

In consideration of the above, the currently-available technology for correcting the banding problem is adopting a so-called software technique such as printing control as below in addition to such improvements from the hardware perspective as described above.

As an example for such a technology, Patent Document 1 (JP-A-2002-19101) and Patent Document 2 (JP-A-2003-136702) describe the technology as a measure against the ink amount variation of the nozzles, and ink discharge failures. More in detail, parts of lower density are applied with shading correction so that any head variation is handled, and parts of higher density are provided with any substitution color, e.g., cyan or magenta for printing in black, so that the banding problem is corrected or any ink amount variation is made less noticeable.

Patent Document 3 (JP-A-2003-63043) describes the technology of generating filled-in images, i.e., images being solidly and completely filled, using all of provided nozzles. That is, for filled-in images, any nozzles in the vicinity of pixels in charge of any discharge-faulty nozzle(s) are increased in ink amount for discharge.

Patent Document 4 (JP-A-5-30361) describes the technology of preventing the banding problem with a process of feeding back any variation observed to the ink amount coming from the nozzles through error diffusion so that the variation is absorbed.

The concern here is that, with the technology of correcting the banding problem or reducing the variation of nozzles using substitution colors as related arts found in Patent Documents 1 and 2, any processed parts are changed in hue. In consideration thereof, such technologies are not suitable for printing required to be high in image quality and printing quality as color photograph printing.

Another issue is with the technology of allocating information about any discharge-faulty nozzles to right and left thereof to prevent white streaks in parts high in density. If this technology is applied to solve the above-described ink deflection problem, white streaks are actually reduced but the banding problem still remains unsolved in parts high in density.

The related art of Patent Document 3 causes no problem with printing subjects if they are filled-in images, but cannot be used if printing subjects are of halftone. The technology of using substitution colors may serve well for thin lines. However, if with an image of many colors, i.e., one color next to another, the technology also fails to solve the problem of hue change in the image.

The related art of Patent Document 4 also raises an issue of complicating the feeding-back process that is expected to be appropriately executed against the problem of not deriving ideal dot formation details, and such an issue is difficult to solve.

SUMMARY

An advantage of some aspects of the invention is to provide a printing device, a printing device control program and method, and a printing data generation device, program, and method, all of which are newly developed and capable of stopping image degradation or making image degradation less conspicuous that is caused by a banding problem resulted from ink deflection, and ink discharge failures.

First Aspect

A first aspect of the invention is directed to a printing device that prints an image onto a printing medium using a printing head that includes a plurality of nozzles each being capable of dot formation to the printing medium. The printing device includes: an image data acquisition unit that acquires image data showing pixel values of M ($M \geqq 2$) for the image; a displacement amount information storage unit that stores information about an amount of a displacement observed to the printing medium by each of the nozzles between an actual dot formation position and an ideal dot formation position; a printing data generation unit that generates printing data including information about dot formation details based on the acquired image data and the displacement amount information for each of the pixel values, and for use as the information about the dot formation details, generates information about reducing degradation of printing image quality due to a banding problem caused by the displacement between the actual dot formation position and the ideal dot formation position, and exercises control over generating the degradation-reducing information based on the displacement amount information; and a printing unit that prints, based on the printing data, the image onto the printing medium using the printing head.

With such a configuration, the image data acquisition unit can acquire image data showing pixel values of M ($M \geqq 2$) for the image, and the displacement amount information storage unit can store information about an amount of displacement observed to the printing medium by each of the nozzles between an actual dot formation position and an ideal dot formation position. What is more, the printing data generation unit can generate printing data including information about dot formation details based on the acquired image data and the displacement amount information for each of the pixel values, and for use as such information about the dot formation details, generate information about reducing degradation of printing image quality due to a banding problem caused by the displacement between the actual dot formation position and the ideal dot formation position, and exercise control over generating the degradation-reducing information based on the displacement amount information. The printing unit can print, based on the printing data, the image onto the printing medium using the printing head.

This accordingly enables control application over whether information for reducing degradation of printing quality is to be generated with what amount based on the displacement amount, i.e., amount of ink deflection. The degradation of printing quality includes, for example, white and dark streaks caused by a banding problem, which is resulted from ink deflection due to nozzles whose dot formation positions are not ideal. Such control application can thus reduce the degradation of printing quality exemplified by white or dark streaks resulted from the banding problem, and can minimize any possible adverse effects the process of reducing the image degradation may cause to the original image.

The expression of "dot" denotes a single region of a printing medium formed by an ink droplet discharged from one or more nozzles. This "dot" is not zero in area, is of a predetermined size (area), and is of various sizes. The dot formed by ink discharge is not necessarily be a perfect circle in shape, and may take any other shape such as an ellipse. If the resulting dots are not perfect circle but ellipse, for example, their dot diameter may be their average value. Alternatively, an equivalent dot is estimated for a perfect circle having the same area as a dot formed by a certain amount of ink, and the diameter of the estimated equivalent dot is dealt as the dot diameter. To form dots varying in density, various techniques are applicable, e.g., forming dots of the same size but of different density, forming dots of the same density but of different size, forming dots of different density by changing the discharge amount and frequency of ink of the same density, or others. If an ink droplet discharged from one specific nozzle is broken up before reaching the printing medium, the resulting dots are dealt as one dot. If two or more dots are merged together after being discharged from any two nozzles or from one specific nozzle after a time lag, the resulting dots are dealt as two dots. This is applicable to aspects of "printing device control program", "printing device control method", "printing data generation device", "printing data generation program", "printing data generation method", and "program-recorded recording medium", descriptions in the "description of exemplary embodiments", and others.

The image data acquisition unit acquires image data that is provided from a unit for reading optical printing results exemplified by a scanner unit or others. Such image acquisition is made also from any external device over a network such as LAN or WAN passively or actively, or from recording media such as CD-ROMs or DVD-ROMs via drives of its own printing device, e.g., CD drives or DVD drives, or from a storage device of its own printing device, for example. That is, the image acquisition at least includes data input, acquisition, reception, and reading. This is applicable to aspects of "printing device control program", "printing device control method", "printing data generation device", "printing data generation program", "printing data generation method", and "program-recorded recording medium", descriptions in the "description of exemplary embodiments", and others.

The "displacement amount information storage unit" serves to store the displacement amount information in any form at any timing, and may carry the displacement amount information therein in advance, or may receive displacement amount information as external inputs for storage when the printing device is in operation. Such storage timing is not restrictive as long as the stored information is at hand when the printing device is used. For example, the printing result derived by the printing head is checked to see the displacement amount for the dot formation positions of the nozzles using a unit for reading optical printing results exemplified by a scanner unit before shipment of the product, i.e., the printing device, for sale, and the check result may be stored. Alternatively, at the time of using the printing device, the displacement amount may be checked for the dot formation positions of the nozzles that configure the printing head similarly to the case of product shipment. Still alternatively, to be ready for any possible characteristics change occurred to the printing head, after the use of the printing device, the printing result derived by the printing head may be checked on a regular basis or at a predetermined timing to see the displacement amount for the dot formation positions of the nozzles using a unit for reading optical printing results exemplified by a scanner unit, and the check result may be stored together with data at the time of product shipment or written over the data for updating of the displacement amount information. This is applicable to aspects of "printing device control program", "printing device control method", "printing data generation device", "printing data generation program", "printing data generation method", and "program-recorded recording medium", descriptions in the "description of exemplary embodiments", and others.

The expression of "the information about dot formation details for each of the nozzles" includes information needed for dot formation using nozzles. For example, the information is about whether or not to form dots using nozzles with respect to every pixel value of image data. If dots are to be formed, the information tells also about dot size of large, medium, or small, for example. This is not restrictive, and when there is only one dot size, the information may be only about whether or not to form dots.

The expression of "banding problem" means a printing failure of white and dark streaks observed together in the printing result. This is resulted from so-called ink deflection due to nozzles varying in dot formation positions, and being not at their ideal positions. This is applicable to aspects of "printing device control program", "printing device control method", "printing data generation device", "printing data generation program", "printing data generation method", and "program-recorded recording medium", descriptions in the "description of exemplary embodiments", and others.

The expression of "ink deflection" means a phenomenon in which, unlike the mere ink discharge failures occurred to some of the nozzles as described above, the nozzles have no problem for ink discharge but are partially misaligned so that the ink discharge direction is incorrectly angled, thereby failing in forming dots at their ideal positions. This is applicable to aspects of "printing device control program", "printing device control method", "printing data generation device", "printing data generation program", "printing data generation method", and "program-recorded recording medium", descriptions in the "description of exemplary embodiments", and others.

The expression of "white streaks" denotes the parts (regions) of a printing medium whose base appears streaky in color. This is due to the ink deflection, resultantly causing the dot-to-dot distance between any adjacent dots to be often wider than a predetermined distance. The expression of "dark streaks" denotes the parts (regions) of a printing medium whose base is not visible in color or looks relatively darker due to also the ink deflection, resultantly causing the dot-to-dot distance between any adjacent dots to be often narrower than the predetermined distance. The expression of "dark streaks" also denotes the parts (regions) of a printing medium that look streaky dark in color, caused by dots not formed at their ideal positions by being partially overlaid on dots formed at their normal positions. The white streaks may occur due to nozzles whose ink discharge amount is less than others, and the dark streaks may occur due to nozzles whose ink discharge amount is more than others. This is applicable to aspects of "printing device control program", "printing device control method", "printing data generation device", "printing data generation program", "printing data generation method", and "program-recorded recording medium", descriptions in the "description of exemplary embodiments", and others.

The expression of "information about reducing degradation of printing image quality" denotes information for reducing image quality degradation to be caused by nozzles forming dots not at their ideal positions. The information may be related to the dot formation details, e.g., at least either a nozzle relating to the banding problem or any of the neighboring nozzles may not be allowed for dot formation, or an image part corresponding to such a nozzle(s) may be formed with dots of a pattern making the banding phenomenon less noticeable. Note here that such information about dot formation details is different from information about dot formation details for the same pixel values but for correct nozzles having nothing to do with the banding problem. This is applicable to aspects of "printing device control program", "printing device control method", "printing data generation device", "printing data generation program", "printing data generation method", and "program-recorded recording medium", descriptions in the "description of exemplary embodiments", and others.

Second Aspect

According to a printing device of a second aspect, in the first aspect, the printing data generation unit generates the degradation-reducing information with respect to pixels corresponding to at least either any of the nozzles showing the displacement of a predetermined amount or more or any of the other neighboring nozzles.

Such a configuration enables to generate the above-described degradation-reducing information if there is any image part with noticeable quality degradation. With such degradation-reducing information, although the image part with noticeable quality degradation suffers more or less degradation after all compared with before information generation, the degradation incurred by the banding problem can be made less noticeable all in all.

The expression of "at least either any of the nozzles showing the displacement of a predetermined amount or more or any of the other neighboring nozzles" includes three possible cases. That is, the first is a case where the corresponding nozzle(s) are those showing the displacement of a predetermined amount or more, and the second is a case where the corresponding nozzle(s) are those in the vicinity of the nozzle (s) showing the displacement of the predetermined amount or more. The third is a case where the corresponding nozzle(s) are those showing the displacement of the predetermined amount or more, and those in the vicinity of such a nozzle(s). Exemplarily with the third case, when the white streaks occur as a result of ink deflection, the corresponding nozzle(s) are those whose dot formation positions are not ideal, and those forming normal dots at their correct positions with a dot-to-dot distance wider than usual between the dots displaced in position. When the dark streaks occur, the corresponding nozzle(s) are those whose dot formation positions are not ideal due to ink deflection, and those forming dots at their correct positions with the dot-to-dot distance narrower than usual between the dots displaced in position, or those forming normal dots being partially or entirely overlaid on one another. These are not surely restrictive, and the neighboring range may be so widened as to include three adjacent nozzles to any corresponding nozzle(s) on its (their) both sides, for example. Moreover, the process of generating the degradation-reducing information is executed to every pixel corresponding to any one nozzle selected from the above three cases. This is applicable to aspects of "printing device control program", "printing device control method", "printing data generation device", "printing data generation program", "printing data generation method", and "program-recorded recording medium", descriptions in the "description of exemplary embodiments", and others.

The expression of "pixels corresponding to at least either any of the nozzles showing the displacement of a predetermined amount or more or any of the other neighboring nozzles" includes three possible cases. That is, the first is a case where the pixels are those corresponding to dots to be formed by a nozzle(s) showing the displacement of a predetermined amount or more, and the second is a case where the pixels are those corresponding to dots to be formed by a nozzle(s) in the vicinity of a nozzle(s) showing the displacement of the predetermined amount or more. The third is a case where the pixels are those corresponding to dots to be formed by a nozzle(s) showing the displacement of the predetermined amount or more, and those in the vicinity of such a nozzle(s). This is applicable to aspects of "printing device control program", "printing device control method", "printing data generation device", "printing data generation program", "printing data generation method", and "program-recorded recording medium", descriptions in the "description of exemplary embodiments", and others.

The expression of "any of the other neighboring nozzles" denotes, although not in a strict sense, any nozzle taking charge of about 2 to 10 pixels therearound. The nozzle is the one showing a predetermined displacement amount or more, for example, and the degradation-reducing information is generated therefor. Here, the number of pixels changes depending on the image resolution. This is because the wider neighboring range resultantly increases the size of the region with image degradation, e.g., the granularity being more noticeable. With some level of image resolution, too much pinpoint precision will make the corresponding part peculiar in state.

Third Aspect

According to a printing device of a third aspect, in the second aspect, the printing data generation unit generates the degradation-reducing information with respect to pixels corresponding to at least either any of the nozzles showing the displacement of a predetermined amount or more or any of the other neighboring nozzles, but not with respect to pixels corresponding to at least any of the nozzles showing the displacement smaller than the predetermined amount or any of the other neighboring nozzles.

Such a configuration enables to generate the above-described degradation-reducing information if there is any image part with noticeable quality degradation, and not to generate the information for any image part without noticeable quality degradation but suffering from displacement. As a result, although the image part with noticeable quality degradation suffers more or less degradation after all compared with before information generation, the degradation incurred by the banding problem can be made less noticeable all in all. As to the image part without noticeable quality degradation, the image quality can be retained so that the printing image can be improved in quality in its entirety.

Fourth Aspect

According to a printing device of a fourth aspect, in any one of the first to third aspects, the printing data generation unit generates the degradation-reducing information with respect to pixels corresponding to at least either any of the nozzles relating to the banding problem or any of the other neighboring nozzles to have dots entirely or partially corresponding to the pixels changed in size to suit the displacement amount.

Such a configuration allows for any image part with quality degradation and parts therearound to be formed with dots of a size in accordance with the displacement amount, not of a size determined based on the original pixel values of the image data acquired by the image data acquisition unit. With such dot formation, any possible image degradation can be reduced in a more appropriate manner.

Herein, the expression of "size to suit the displacement amount" includes, in addition to the size based on the displacement amount, the size that can be calculated from the displacement amount, e.g., the size based on the dot-to-dot distance between any displaced dot and its neighboring normal dot. More in detail, when the dot-to-dot distance is increased due to some displacement in some direction, the larger the displacement amount, the larger the dots are to be formed. On the other hand, when the dot-to-dot distance is decreased, the larger the displacement amount, the smaller the dots are to be formed. Note here that there are upper limits both for maximum and minimum dot sizes depending on the performance capability of the printing head, and thus dots are formed to be of a size falling in the corresponding range. This is applicable to aspects of "printing device control program", "printing device control method", "printing data generation device", "printing data generation program", "printing data generation method", and "program-recorded recording medium", descriptions in the "description of exemplary embodiments", and others.

Fifth Aspect

According to a printing device of a fifth aspect, in the fourth aspect, when a dot-to-dot distance between any adjacent two of the nozzles is wider than an ideal dot-to-dot distance due to the displacement, the printing data generation unit generates, for use as the degradation-reducing information, information about forming dots larger in the neighborhood of the wider dot-to-dot distance than a pixel value size in the image data acquired by the image data acquisition unit to suit the dot-to-dot distance.

Such a configuration enables dot formation depending on the dot-to-dot distance, i.e., for any part showing the dot-to-dot distance wider than ideal, to suit the dot-to-dot distance, the neighboring dots are to be formed larger than the dot size determined based on the original pixel values of the image data acquired by the image data acquisition unit. This can effectively eliminate or make less noticeable white streaks caused by a banding problem resulted from so-called ink deflection. That is, the dot-to-dot distance being wider than ideal means that the nozzle in charge of dot formation for the area is suffering from ink deflection, and means a high risk of white streaks for the part showing the wider dot-to-dot distance. As such, compared with the dot size based on the original pixel values, by forming larger the dots for the area neighboring the area showing the possible risk of white streaks, i.e., by generating information for reducing such quality degradation, the area showing the possible risk of white streaks, i.e., blank area with no dot formed, can be reduced in size so that the white streaks can be eliminated or made less noticeable even if they occur.

The expression of "any adjacent two of the nozzles" denotes a pair of nozzles that their dots are formed side by side. This is applicable to aspects of "printing device control program", "printing device control method", "printing data generation device", "printing data generation program", "printing data generation method", and "program-recorded recording medium", descriptions in the "description of exemplary embodiments", and others.

The expression of "dot-to-dot distance" is exemplified by a center-to-center distance between any two adjacent dots, and is not restrictive as long as it can define an interval between dots. This is applicable to aspects of "printing device control program", "printing device control method", "printing data generation device", "printing data generation program", "printing data generation method", and "program-recorded recording medium", descriptions in the "description of exemplary embodiments", and others.

The expression of "ideal dot-to-dot distance" is a distance, i.e., interval, being within tolerance from an ideal dot-to-dot distance d used as the reference. Assuming that the measured dot-to-dot distance is d' and the tolerance is $\Delta d$, the ideal dot-to-dot distance falls in the range of $|d'|<|d+\Delta d|$. This is applicable to aspects of "printing device control program", "printing device control method", "printing data generation device", "printing data generation program", "printing data generation method", and "program-recorded recording medium", descriptions in the "description of exemplary embodiments", and others.

The expression of "original pixel values of the image data acquired by the image data acquisition unit" denotes pixel values of original image data (RGB to CMYK) coming from a printing command device such as personal computers, or pixel values of not-yet-processed image data before generation of the degradation-reducing information. This is applicable to aspects of "printing device control program", "printing device control method", "printing data generation device", "printing data generation program", "printing data generation method", and "program-recorded recording medium", descriptions in the "description of exemplary embodiments", and others.

The expression of "forming dots in the neighborhood" denotes, although not in a strict sense, about 2 to 10 pixels around a nozzle taking charge of the pixel area for which the degradation-reducing information is to be generated due to the dot-to-dot distance being wider than ideal. Here, the number of pixels changes depending on the image resolution. Specifically exemplified, "dots in the neighborhood" include those to be formed by any two nozzles with their dot-to-dot distance being wider than ideal, and those to be formed by a predetermined number of nozzles each adjacent to the above two nozzles. This is applicable to aspects of "printing device control program", "printing device control method", "printing data generation device", "printing data generation program", "printing data generation method", and "program-recorded recording medium", descriptions in the "description of exemplary embodiments", and others.

Herein, the expression of "size to suit the dot-to-dot distance" denotes that the dot size is increased with the wider dot-to-dot distance, and the dot size is decreased with the narrower dot-to-dot distance. This is because a monotonic increase is observed between the dot-to-dot distance and the dot size. Note here that there are upper limits both for maximum and minimum dot sizes depending on the performance capability of the printing head, and thus dots are formed to be of a size falling in the corresponding range. This is applicable to aspects of "printing device control program", "printing device control method", "printing data generation device", "printing data generation program", "printing data generation method", and "program-recorded recording medium", descriptions in the "description of exemplary embodiments", and others.

Sixth Aspect

According to a printing device of a sixth aspect, in the fourth or fifth aspect, when a dot-to-dot distance between any adjacent two of the nozzles is narrower than an ideal dot-to-dot distance due to the displacement, the printing data generation unit generates, for use as the degradation-reducing information, information about forming dots smaller in the neighborhood of the narrower dot-to-dot distance than a pixel value size in the image data acquired by the image data acquisition unit to suit the dot-to-dot distance, or information about decimating dots formed in the neighborhood of the narrower dot-to-dot distance.

Such a configuration enables dot formation depending on the dot-to-dot distance, i.e., for any part showing the dot-to-dot distance narrower than ideal, to suit the dot-to-dot distance, the neighboring dots are to be formed smaller than the dot size determined based on the original pixel values of the image data acquired by the image data acquisition unit, or enables to decimate the neighboring dots to be formed. This can effectively eliminate or make less noticeable dark streaks caused by a banding problem resulted from so-called ink deflection. That is, the dot-to-dot distance being narrower than ideal means that the nozzle in charge of dot formation for the area is suffering from ink deflection, and means a high risk of dark streaks for the part showing the narrower dot-to-dot distance. As such, compared with the dot size based on the original pixel values, by forming smaller the dots for the area neighboring the area showing the possible risk of dark streaks, or by decimating the neighboring dots, i.e., by generating information for reducing such quality degradation, the area showing the possible risk of dark streaks, e.g., the area in which dots are closely formed or overlaid one another, can be eliminated, or dots to be formed in such an area are prevented from being close to one another or being overlaid one another so that the dark streaks can be eliminated or made less noticeable even if they occur.

Seventh Aspect

According to a printing device of a seventh aspect, in any one of the first to sixth aspects, the printing data generation unit exercises control over generating the degradation-reducing information to derive a match between an amount of the degradation-reducing information and the displacement amount.

Such a configuration enables to control the generation amount of information based on the degradation level of the image quality. The information is the one for reducing the degradation of image quality, including information about forming dots of a size different from the normal dot size for any image part with image degradation, or information about decimating dots that are originally supposed to be formed, for example. Such information is generated more in amount when the displacement amount is large, and less in amount when the displacement amount is small.

Accordingly, the printing data corresponding to original pixel values for any image-degraded part is converted to information that is effective and minimum in amount required to make the image-degraded part less noticeable. Such data conversion can eliminate or make less noticeable white or dark streaks resulted from the banding problem, and can minimize any possible adverse effects the process of reducing the image quality may cause to the original image.

Eighth Aspect

According to a printing device of an eighth aspect, in any one of the first to seventh aspects, the printing data generation unit generates, for use as the degradation-reducing information, information about changing a resolution of a printing image derived by at least either any of the nozzles relating to the banding problem or any of the other neighboring nozzles to be lower than a resolution of a printing image derived based on the pixel values originally of the image data acquired by the image data acquisition unit, and to be a resolution based on the displacement amount information.

Such a configuration allows generation of information about changing the image resolution of a printing image that is formed by at least either a nozzle relating to the banding problem or any of the neighboring nozzles. Such resolution change is so made as to be lower than the image resolution of a printing image that is formed based on the original pixel values of the image data acquired by the image data acquisition unit, and to suit the displacement amount. For example, the resolution of a printing image is reduced by decimating dots to be formed by at least either a nozzle relating to the banding problem or any of the neighboring nozzles by the amount matching to the displacement amount. Such resolution reduction can accordingly make less noticeable white or dark streaks resulted from the banding problem, and can minimize any possible adverse effects the process of reducing the image degradation may cause to the original image.

The expression of "any of the nozzles relating to the banding problem" denotes a nozzle(s) that is a cause of ink deflection, and by extension, a cause of a banding problem. This is applicable to aspects of "printing device control program", "printing device control method", "printing data generation device", "printing data generation program", "printing data generation method", and "program-recorded recording medium", descriptions in the "description of exemplary embodiments", and others.

Ninth Aspect

According to a printing device of a ninth aspect, in any one of the first to seventh aspects, the printing data generation unit converts the image data to change a resolution of an image having any of the pixel values corresponding to at least either any of the nozzles relating to the banding problem or any of the other neighboring nozzles to be higher than a resolution of a printing image derived based on the pixel values originally of the image data acquired by the image data acquisition unit, and generates the information about the dot formation details based on any of the pixel values selected from those of the resolution-increased image data by reason of being closest to a dot formation position of any of the nozzles corresponding to the original pixel values, and corrected based on any of the other not-selected pixel values and the displacement amount information.

In such a configuration, for example, original image data (RGB to CMYK) coming from a printing command device such as personal computers is increased in resolution so that the resulting resolution-increased image data include the larger number of pixels. From such pixels of the image data, a selection is made of a pixel value corresponding to the actual dot formation position for any specific nozzle. Thus selected pixel value is then corrected based on the remaining not-selected pixel values and dot formation information, and information related to the dot formation details is formed for the corrected pixel value. By the printing unit performing printing based on the printing data generated as such, even if any displaced nozzle causes ink deflection, dark streaks can be effectively eliminated or made less noticeable certainly similar to white streaks resulted from the banding problem. What is more, the displacement amount can be used as a basis for exercising control over the correction details for the selected pixel value. Such pixel value correction can minimize any possible adverse effects the process of reducing the image degradation may cause to the original image quality so that the printing result can be high in quality.

The expression of "the selected pixel value is corrected based on any of the not-selected pixel values and the displacement amount information" denotes the correction based on the premise that an error diffusion is performed. For example, the pixel values of pixels not selected in the vicinity of the selected pixel are used as a basis to determine the correction amount, and using thus determined correction amount, the pixel value of the selected pixel is corrected so that image conversion is performed to the printing data. In this aspect, the determination factor for the correction amount is not only the pixel values of not-selected pixels but also the displacement amount information. This is applicable to aspects of "printing device control program", "printing device control method", "printing data generation device", "printing data generation program", "printing data generation method", and "program-recorded recording medium", descriptions in the "description of exemplary embodiments", and others.

Tenth Aspect

According to a printing device of a tenth aspect, in any one of the first to seventh aspects, the printing data generation unit generates information, for use as the information about the dot formation details, about any of the nozzles forming a reference dot at a position corresponding to a predetermined resolution that is lower than a possible maximum resolution for the printing device in a direction at least intersecting a nozzle disposition direction, and information about forming an enlarged dot at a position different from the reference dot, and exercises control over generating the information to make a formation size of the enlarged dot to suit the displacement amount.

Such a configuration can retain the image quality by making granularity less noticeable with reference dots and enlarged dots that are individually disposed, and can effectively correct the banding problem by displacing the enlarged dots from the positions of the reference dots to the direction intersecting the nozzle disposition direction.

What is more, the enlarged dot can be of a size matching to the displacement amount so that dark streaks can be effectively eliminated or made less noticeable certainly similar to white streaks resulted from the banding problem.

Eleventh Aspect

According to a printing device of an eleventh aspect, in any one of the first to tenth aspects, the printing head is configured by the nozzles successively disposed over a region wider than a region with the printing medium being attached.

Such a configuration can generate, as described above, printing data that serves effectively to eliminate white and dark streaks or make those less noticeable. These streaks are those caused by a banding problem, which is often observed in line head printing heads that complete printing with a single scan, i.e., a single path.

Herein, the expression of "printing with a single scan" denotes a printing operation in which lines are printed by each corresponding nozzle in the paper feeding direction, i.e., direction along which a printing head moves, and when the nozzles pass through their lines, the printing operation is through for the lines. This is applicable to aspects of "printing device control program", "printing device control method", "printing data generation device", "printing data generation program", "printing data generation method", and "program-recorded recording medium", descriptions in the "description of exemplary embodiments", and others.

Twelfth Aspect

According to a printing device of a twelfth aspect, in any one of the first to tenth aspects, the printing head takes charge of printing while reciprocating in a direction perpendicular to a paper feeding direction of the printing medium.

The above-described banding problem is pretty common with printing heads of line head type, but printing heads of multi-path type are not yet free from such a problem. In view thereof, such a configuration allows application of the printing device of any one of the first to tenth aspects to the printing heads of multi-path type, thereby generating printing data serving effectively to eliminate white and dark streaks or make those less noticeable. These streaks are those caused by a banding problem, which is observed in multi-head printing heads.

With the printing heads of multi-path type, the above-described banding problem can be prevented by repeated image scanning using the printing head, for example. However, using the printing device of any one of the first to tenth aspects favorably eliminates such a need to repeatedly perform image scanning using the printing head, and the higher-speed printing can be implemented.

Thirteenth Aspect

A thirteenth aspect of the invention is directed to a printing device control program for control use of a printing device that prints an image onto a printing medium using a printing head that includes a plurality of nozzles each being capable of dot formation to the printing medium. The control program includes, for process execution by a computer: acquiring image data showing pixel values of M ($M \geqq 2$) for the image; generating printing data including information about dot formation details for each of the pixel values based on the acquired image data and information about an amount of displacement observed to the printing medium by each of the nozzles between an actual dot formation position and an ideal dot formation position, and for use as the information about the dot formation details, generating information about reducing degradation of printing image quality due to a banding problem caused by the displacement between the actual dot formation position and the ideal dot formation position, and exercising control over generating the degradation-reducing information based on the displacement amount information; and printing, based on the printing data, the image onto the printing medium using the printing head.

Such a configuration leads to effects and advantages similar to the printing device of the first aspect by a computer reading a program and executing processes in accordance with the program.

Printing devices on the current market such as ink jet printers are each provided with a computer system, which is configured to include a Central Processing Unit (CPU), a storage device (Random Access Memory (RAM), Read Only Memory (ROM)), an input/output device, or others. Using such a computer system, the processes can be implemented by software. The printing device control program thus can implement the processes more economically and with more ease than a case with hardware that is specifically built for the purpose.

Moreover, through partial rewriting of the program, it leads to easy version up by function modification or improvement, for example.

Fourteenth Aspect

According to a printing device control program of a fourteenth aspect, in the thirteenth aspect, the generating generates the degradation-reducing information with respect to pixels corresponding to at least either any of the nozzles showing the displacement of a predetermined amount or more or any of the other neighboring nozzles.

Such a configuration leads to effects and advantages similar to the printing device of the second aspect by a computer reading a program and executing processes in accordance with the program.

Fifteenth Aspect

According to a printing device control program of a fifteenth aspect, in the thirteenth or fourteenth aspect, the generating generates the degradation-reducing information with respect to pixels corresponding to at least either any of the nozzles showing the displacement of a predetermined amount or more or any of the other neighboring nozzles, but not with respect to pixels corresponding to at least any of the nozzles showing the displacement smaller than the predetermined amount or any of the other neighboring nozzles.

Such a configuration leads to effects and advantages similar to the printing device of the third aspect by a computer reading a program and executing processes in accordance with the program.

Sixteenth Aspect

According to a printing device control program of a sixteenth aspect, in any one of the thirteenth to fifteenth aspects, the generating generates the degradation-reducing information with respect to pixels corresponding to at least either any of the nozzles relating to the banding problem or any of the other neighboring nozzles to have dots entirely or partially corresponding to the pixels changed in size to suit the displacement amount.

Such a configuration leads to effects and advantages similar to the printing device of the fourth aspect by a computer reading a program and executing processes in accordance with the program.

Seventeenth Aspect

According to a printing device control program of a seventeenth aspect, in the sixteenth aspect, when a dot-to-dot distance between any adjacent two of the nozzles is wider than an ideal dot-to-dot distance due to the displacement, the generating generates, for use as the degradation-reducing information, information about forming dots larger in the neighborhood of the wider dot-to-dot distance than a pixel value size in the image data acquired by the acquiring to suit the dot-to-dot distance.

Such a configuration leads to effects and advantages similar to the printing device of the fifth aspect by a computer reading a program and executing processes in accordance with the program.

Eighteenth Aspect

According to a printing device control program of an eighteenth aspect, in the sixteenth or seventeenth aspect, when a dot-to-dot distance between any adjacent two of the nozzles is narrower than an ideal dot-to-dot distance due to the displacement, the generating generates, for use as the degradation-reducing information, information about forming dots smaller in the neighborhood of the narrower dot-to-dot distance than a pixel value size in the image data acquired by the acquiring to suit the dot-to-dot distance, or information about decimating dots formed in the neighborhood of the narrower dot-to-dot distance.

Such a configuration leads to effects and advantages similar to the printing device of the sixth aspect by a computer reading a program and executing processes in accordance with the program.

Nineteenth Aspect

According to a printing device control program of a nineteenth aspect, in any one of the thirteenth to eighteenth aspects, the generating exercises control over generating the degradation-reducing information to derive a match between an amount of the degradation-reducing information and the displacement amount.

Such a configuration leads to effects and advantages similar to the printing device of the seventh aspect by a computer reading a program and executing processes in accordance with the program.

Twentieth Aspect

According to a printing device control program of a twentieth aspect, in any one of the thirteenth to nineteenth aspects, the generating generates, for use as the degradation-reducing information, information about changing a resolution of a printing image derived by at least either any of the nozzles relating to the banding problem or any of the other neighboring nozzles to be lower than a resolution of a printing image derived based on the pixel values originally of the image data acquired by the image data acquisition unit, and to be a resolution based on the displacement amount information.

Such a configuration leads to effects and advantages similar to the printing device of the eighth aspect by a computer reading a program and executing processes in accordance with the program.

Twenty-first Aspect

According to a printing device control program of a twenty-first aspect, in any one of the thirteenth to nineteenth aspects, the generating converts the image data to change a resolution of an image having any of the pixel values corresponding to at least either any of the nozzles relating to the banding problem or any of the other neighboring nozzles to be higher than a resolution of a printing image derived based on the pixel values originally of the image data acquired by the acquiring, and generates the information about the dot formation details based on any of the pixel values selected from those of the resolution-increased image data by reason of being closest to a dot formation position of any of the nozzles corresponding to the original pixel values, and corrected based on any of the other not-selected pixel values and the displacement amount information.

Such a configuration leads to effects and advantages similar to the printing device of the ninth aspect by a computer reading a program and executing processes in accordance with the program.

Twenty-second Aspect

According to a printing device control program of a twenty-second aspect, in any one of the thirteenth to nineteenth aspects, the generating generates information, for use as the information about the dot formation details, about any of the nozzles forming a reference dot at a position corresponding to a predetermined resolution that is lower than a possible maximum resolution for the printing device in a direction at least intersecting a nozzle disposition direction, and information about forming an enlarged dot at a position different from the reference dot, and exercises control over generating the information to make a formation size of the enlarged dot to suit the displacement amount.

Such a configuration leads to effects and advantages similar to the printing device of the tenth aspect by a computer reading a program and executing processes in accordance with the program.

Twenty-third Aspect

A twenty-third aspect of the invention is directed to a computer-readable printing device control-program-recorded recording medium that is recorded with the printing device control program of any one of the thirteenth to twenty-second aspects.

This leads to effects and advantages similar to the printing device control program of any one of the thirteenth to twenty-second aspects, and enables easy provision of the printing program via recording media such as CD-ROMs, DVD-ROMs, and MOs.

Twenty-fourth Aspect

A twenty-fourth aspect of the invention is directed to a printing device control method for control use of a printing device that prints an image onto a printing medium using a printing head that includes a plurality of nozzles each being capable of dot formation to the printing medium. The control method includes: acquiring image data showing pixel values of M ($M \geqq 2$) for the image; generating printing data including information about dot formation details for each of the pixel values based on the acquired image data and information about an amount of displacement observed to the printing medium by each of the nozzles between an actual dot formation position and an ideal dot formation position, and for use as the information about the dot formation details, generating information about reducing degradation of printing image quality due to a banding problem caused by the displacement between the actual dot formation position and the ideal dot formation position, and exercising control over generating the degradation-reducing information; and printing, based on the printing data, the image onto the printing medium using the printing head.

This leads to effects and advantages similar to the printing device of the first aspect.

Twenty-fifth Aspect

According to a printing device control method of a twenty-fifth aspect, in the twenty-fourth aspect, the generating generates the degradation-reducing information with respect to pixels corresponding to at least either any of the nozzles showing the displacement of a predetermined amount or more or any of the other neighboring nozzles.

This leads to effects and advantages similar to the printing device of the second aspect.

Twenty-sixth Aspect

According to a printing device control method of a twenty-sixth aspect, in the twenty-fifth aspect, the generating generates the degradation-reducing information with respect to pixels corresponding to at least either any of the nozzles showing the displacement of a predetermined amount or more or any of the other neighboring nozzles, but not with respect to pixels corresponding to at least any of the nozzles showing the displacement smaller than the predetermined amount or any of the other neighboring nozzles.

This leads to effects and advantages similar to the printing device of the third aspect.

Twenty-seventh Aspect

According to a printing device control method of a twenty-seventh aspect, in any one of the twenty-fourth to twenty-sixth aspects, the generating generates the degradation-reducing information with respect to pixels corresponding to at least either any of the nozzles relating to the banding problem or any of the other neighboring nozzles to have dots entirely or partially corresponding to the pixels changed in size to suit the displacement amount.

This leads to effects and advantages similar to the printing device of the fourth aspect.

Twenty-eighth Aspect

According to a printing device control method of a twenty-eighth aspect, in the twenty-seventh aspect, when a dot-to-dot distance between any adjacent two of the nozzles is wider than an ideal dot-to-dot distance due to the displacement, the generating generates, for use as the degradation-reducing information, information about forming dots larger in the neighborhood of the wider dot-to-dot distance than a pixel value size in the image data acquired by the acquiring to suit the dot-to-dot distance.

This leads to effects and advantages similar to the printing device of the fifth aspect.

Twenty-ninth Aspect

According to a printing device control method of a twenty-ninth aspect, in the twenty-seventh or twenty-eighth aspect, when a dot-to-dot distance between any adjacent two of the nozzles is narrower than an ideal dot-to-dot distance due to the displacement, the generating generates, for use as the degradation-reducing information, information about forming dots smaller in the neighborhood of the narrower dot-to-dot distance than a pixel value size in the image data acquired by the acquiring to suit the dot-to-dot distance, or information about decimating dots formed in the neighborhood of the narrower dot-to-dot distance.

This leads to effects and advantages similar to the printing device of the sixth aspect.

Thirtieth Aspect

According to a printing device control method of a thirtieth aspect, in any one of the twenty-fourth to twenty-ninth aspects, the generating exercises control over generating the degradation-reducing information to derive a match between an amount of the degradation-reducing information and the displacement amount.

This leads to effects and advantages similar to the printing device of the seventh aspect.

Thirty-first Aspect

According to a printing device control method of a thirty-first aspect, in any one of the twenty-fourth to thirtieth aspects, the generating generates, for use as the degradation-reducing information, information about changing a resolution of a printing image derived by at least either any of the nozzles relating to the banding problem or any of the other neighboring nozzles to be lower than a resolution of a printing image derived based on the pixel values originally of the image data acquired by the acquiring, and to be a resolution based on the displacement amount information.

This leads to effects and advantages similar to the printing device of the eighth aspect.

Thirty-second Aspect

According to a printing device control method of a thirty-second aspect, in any one of the twenty-fourth to thirtieth aspects, the generating converts the image data to change a resolution of an image having any of the pixel values corresponding to at least either any of the nozzles relating to the banding problem or any of the other neighboring nozzles to be higher than a resolution of a printing image derived based on the pixel values originally of the image data acquired by the acquiring, and generates the information about the dot formation details based on any of the pixel values selected from those of the resolution-increased image data by reason of being closest to a dot formation position of any of the nozzles corresponding to the original pixel values of the image data, and corrected based on any of the not-selected other pixel values and the displacement amount information.

This leads to effects and advantages similar to the printing device of the ninth aspect.

Thirty-third Aspect

According to a printing device control method of a thirty-third aspect, in any one of the twenty-fourth to thirtieth aspects, the generating generates information, for use as the information about the dot formation details, about any of the nozzles forming a reference dot at a position corresponding to a predetermined resolution that is lower than a possible maximum resolution for the printing device in a direction at least intersecting a nozzle disposition direction, and information about forming an enlarged dot at a position different from the reference dot, and exercises control over generating the information to make a formation size of the enlarged dot to suit the displacement amount.

This leads to effects and advantages similar to the printing device of the tenth aspect.

Thirty-fourth Aspect

A thirty-fourth aspect of the invention is directed to a printing data generation device that generates printing data for use in a printing device that prints an image onto a printing medium using a printing head that includes a plurality of nozzles each being capable of dot formation to the printing medium. The generation device includes: an image data acquisition unit that acquires image data showing pixel values of M ($M \geqq 2$) for the image; a displacement amount information storage unit that stores information about an amount of a displacement observed to the printing medium by each of the nozzles between an actual dot formation position and an ideal dot formation position; and a printing data generation unit that generates printing data including information about dot formation details based on the acquired image data and the displacement amount information for each of the pixel values, and for use as the information about the dot formation details, generates information about reducing degradation of printing image quality due to a banding problem caused by the displacement between the actual dot formation position and the ideal dot formation position, and exercises control over generating the degradation-reducing information based on the displacement amount information.

That is, the thirty-fourth aspect includes no such printing unit for actual printing as the above-described printing devices, but generates printing data corresponding to the properties of a printing head based on original M-value image data.

Accordingly, such a configuration can lead to effects and advantages similar to the printing device of the first aspect. For example, only by forwarding the generated printing data to a printing device, the printing device becomes able to execute a printing process. Accordingly, such a configuration eliminates the need to provide any specific printing device, and any existing ink jet printing device can be used as it is.

Furthermore, it allows the use of general-purpose information processors such as personal computers, and thus any existing printing system can be used as it is, being configured by a printing command device such as a personal computer, and an ink jet printer.

Thirty-fifth Aspect

According to a printing data generation device of a thirty-fifth aspect, in the thirty-fourth aspect, the generating generates the degradation-reducing information with respect to pixels corresponding to at least either any of the nozzles showing the displacement of a predetermined amount or more or any of the other neighboring nozzles.

This leads to effects and advantages similar to the printing device of the second aspect.

Thirty-sixth Aspect

According to a printing data generation device of a thirty-sixth aspect, in the thirty-fourth or thirty-fifth aspect, the printing data generation unit generates the degradation-reducing information with respect to pixels corresponding to at least either any of the nozzles showing the displacement of a predetermined amount or more or any of the other neighboring nozzles, but not with respect to pixels corresponding to at least any of the nozzles showing the displacement smaller than the predetermined amount or any of the other neighboring nozzles.

This leads to effects and advantages similar to the printing device of the third aspect.

Thirty-seventh Aspect

According to a printing data generation device of a thirty-seventh aspect, in any one of the thirty-fourth to thirty-sixth aspects, the printing data generation unit generates the degradation-reducing information with respect to pixels corresponding to at least either any of the nozzles relating to the banding problem or any of the other neighboring nozzles to have dots entirely or partially corresponding to the pixels changed in size to suit the displacement amount.

This leads to effects and advantages similar to the printing device of the fourth aspect.

Thirty-eighth Aspect

According to a printing data generation device of a thirty-eighth aspect, in the thirty-seventh aspect, when a dot-to-dot distance between any adjacent two of the nozzles is wider than an ideal dot-to-dot distance due to the displacement, the printing data generation unit generates, for use as the degradation-reducing information, information about forming dots larger in the neighborhood of the wider dot-to-dot distance than a pixel value size in the image data acquired by the image data acquisition unit to suit the dot-to-dot distance.

This leads to effects and advantages similar to the printing device of the fifth aspect.

Thirty-ninth Aspect

According to a printing data generation device of a thirty-ninth aspect, in the thirty-seventh or thirty-eighth aspect, when a dot-to-dot distance between any adjacent two of the nozzles is narrower than an ideal dot-to-dot distance due to the displacement, the printing data generation unit generates, for use as the degradation-reducing information, information about forming dots smaller in the neighborhood of the narrower dot-to-dot distance than a pixel value size in the image data acquired by the image data acquisition unit to suit the dot-to-dot distance, or information about decimating dots formed in the neighborhood of the narrower dot-to-dot distance.

This leads to effects and advantages similar to the printing device of the sixth aspect.

Fortieth Aspect

According to a printing data generation device of a fortieth aspect, in any one of the thirty-fourth to thirty-ninth aspects, the printing data generation unit exercises control over generating the degradation-reducing information to derive a match between an amount of the degradation-reducing information and the displacement amount.

This leads to effects and advantages similar to the printing device of the seventh aspect.

Forty-first Aspect

According to a printing data generation device of a forty-first aspect, in any one of the thirty-fourth to fortieth aspects, the printing data generation unit generates, for use as the degradation-reducing information, information about changing a resolution of a printing image derived by at least either any of the nozzles relating to the banding problem or any of the other neighboring nozzles to be lower than a resolution of a printing image derived based on the pixel values originally of the image data acquired by the image data acquisition unit, and to be a resolution based on the displacement amount information.

This leads to effects and advantages similar to the printing device of the eighth aspect.

Forty-second Aspect

According to a printing data generation device of a forty-second aspect, in any one of the thirty-fourth to fortieth aspects, the printing data generation unit converts the image data to change a resolution of an image having any of the pixel values corresponding to at least either any of the nozzles relating to the banding problem or any of the other neighboring nozzles to be higher than a resolution of a printing image derived based on the pixel values originally of the image data acquired by the image data acquisition unit, and generates the information about the dot formation details based on any of the pixel values selected from those of the resolution-increased image data by reason of being closest to a dot formation position of any of the nozzles corresponding to the original pixel values of the image data, and corrected based on any of the other not-selected pixel values and the displacement amount information.

This leads to effects and advantages similar to the printing device of the ninth aspect.

Forty-third Aspect

According to a printing data generation device of a forty-third aspect, in any one of the thirty-fourth to fortieth aspects, the printing data generation unit generates information, for use as the information about the dot formation details, about any of the nozzles forming a reference dot at a position corresponding to a predetermined resolution that is lower than a possible maximum resolution for the printing device in a direction at least intersecting a nozzle disposition direction, and information about forming an enlarged dot at a position different from the reference dot, and exercises control over generating the information to make a formation size of the enlarged dot to suit the displacement amount.

This leads to effects and advantages similar to the printing device of the tenth aspect.

A forty-fourth aspect of the invention is directed to a printing data generation program that generates printing data for use in a printing device that prints an image onto a printing medium using a printing head that includes a plurality of nozzles each being capable of dot formation to the printing medium. The generation program includes, for process execution by a computer: acquiring image data showing pixel values of M ($M \geqq 2$) for the image; and generating printing data including information about dot formation details for each of the pixel values based on the acquired image data and information about an amount of displacement observed to the printing medium by each of the nozzles between an actual dot formation position and an ideal dot formation position, and for use as the information about the dot formation details, generating information about reducing degradation of printing image quality due to a banding problem caused by the displacement between the actual dot formation position and the ideal dot formation position, and exercising control over generating the degradation-reducing information based on the displacement amount information.

Such a configuration leads to effects and advantages similar to the printing data generation device of the thirty-fourth aspect by a computer reading a program and executing processes in accordance with the program.

Forty-fifth Aspect

According to a printing data generation program of a forty-fifth aspect, in the forty-fourth aspect, the generating generates the degradation-reducing information with respect to pixels corresponding to at least either any of the nozzles showing the displacement of a predetermined amount or more or any of the other neighboring nozzles.

Such a configuration leads to effects and advantages similar to the printing data generation device of the thirty-fifth aspect by a computer reading a program and executing processes in accordance with the program.

Forty-sixth Aspect

According to a printing data generation program of a forty-sixth aspect, in the forty-fourth or forty-fifth aspect, the generating generates the degradation-reducing information with respect to pixels corresponding to at least either any of the nozzles showing the displacement of a predetermined amount or more or any of the other neighboring nozzles, but not with respect to pixels corresponding to at least any of the nozzles showing the displacement smaller than the predetermined amount or any of the other neighboring nozzles.

Such a configuration leads to effects and advantages similar to the printing data generation device of the thirty-sixth aspect by a computer reading a program and executing processes in accordance with the program.

Forty-seventh Aspect

According to a printing data generation program of a forty-seventh aspect, in any one of the forty-fourth to forty-sixth aspect, the generating generates the degradation-reducing information with respect to pixels corresponding to at least either any of the nozzles relating to the banding problem or any of the other neighboring nozzles to have dots entirely or partially corresponding to the pixels changed in size to suit the displacement amount.

Such a configuration leads to effects and advantages similar to the printing data generation device of the thirty-seventh aspect by a computer reading a program and executing processes in accordance with the program.

Forty-eighth Aspect

According to a printing data generation program of a forty-eighth aspect, in the forty-seventh aspect, when a dot-to-dot distance between any adjacent two of the nozzles is wider than an ideal dot-to-dot distance due to the displacement, the generating generates, for use as the degradation-reducing information, information about forming dots larger in the neighborhood of the wider dot-to-dot distance than a pixel value size in the image data acquired by the acquiring to suit the dot-to-dot distance.

Such a configuration leads to effects and advantages similar to the printing data generation device of the thirty-eighth aspect by a computer reading a program and executing processes in accordance with the program.

Forty-ninth Aspect

According to a printing data generation program of a forty-ninth aspect, in the forty-seventh or forty-eighth aspect, when a dot-to-dot distance between any adjacent two of the nozzles is narrower than an ideal dot-to-dot distance due to the displacement, the generating generates, for use as the degradation-reducing information, information about forming dots smaller in the neighborhood of the narrower dot-to-dot distance than a pixel value size in the image data acquired by the acquiring to suit the dot-to-dot distance, or information about decimating dots formed in the neighborhood of the narrower dot-to-dot distance.

Such a configuration leads to effects and advantages similar to the printing data generation device of the thirty-ninth aspect by a computer reading a program and executing processes in accordance with the program.

Fiftieth Aspect

According to a printing data generation program of a fiftieth aspect, in any one of the forty-fourth to forty-ninth aspects, the generating exercises control over generating the degradation-reducing information to derive a match between an amount of the degradation-reducing information and the displacement amount.

Such a configuration leads to effects and advantages similar to the printing data generation device of the fortieth aspect by a computer reading a program and executing processes in accordance with the program.

Fifty-first Aspect

According to a printing data generation program of a fifty-first aspect, in any one of the forty-fourth to fiftieth aspects, the generating generates, for use as the degradation-reducing information, information about changing a resolution of a printing image derived by at least either any of the nozzles relating to the banding problem or any of the other neighboring nozzles to be lower than a resolution of a printing image derived based on the pixel values originally of the image data acquired by the acquiring, and to be a resolution based on the displacement amount information.

Such a configuration leads to effects and advantages similar to the printing data generation device of the forty-first aspect by a computer reading a program and executing processes in accordance with the program.

Fifty-second Aspect

According to a printing data generation program of a fifty-second aspect, in any one of the forty-fourth to fiftieth aspects, the generating converts the image data to change a resolution of an image having any of the pixel values corresponding to at least either any of the nozzles relating to the banding problem or any of the other neighboring nozzles to be higher than a resolution of a printing image derived based on the pixel values originally of the image data acquired by the acquiring, and generates the information about the dot formation details based on any of the pixel values selected from those of the resolution-increased image data by reason of being closest to a dot formation position of any of the nozzles corresponding to the original pixel values, and corrected based on any of the other not-selected pixel values and the displacement amount information.

Such a configuration leads to effects and advantages similar to the printing data generation device of the forty-second aspect by a computer reading a program and executing processes in accordance with the program.

Fifty-third Aspect

According to a printing data generation program of a fifty-third aspect, in any one of the forty-fourth to fiftieth aspects, the generating generates information, for use as the information about the dot formation details, about any of the nozzles forming a reference dot at a position corresponding to a predetermined resolution that is lower than a possible maximum resolution for the printing device in a direction at least intersecting a nozzle disposition direction, and information about forming an enlarged dot at a position different from the reference dot, and exercises control over generating the information to make a formation size of the enlarged dot to suit the displacement amount.

Such a configuration leads to effects and advantages similar to the printing data generation device of the forty-third aspect by a computer reading a program and executing processes in accordance with the program.

Fifty-fourth Aspect

A fifty-fourth aspect of the invention is directed to a computer-readable printing-data-generation-program-recorded recording medium that is recorded with the printing data generation program of any one of the forty-fourth to fifty-third aspects.

This leads to effects and advantages similar to the printing data generation program of any one of the forty-fourth to fifty-third aspects, and enables easy provision of the printing program via recording media such as CD-ROMs, DVD-ROMs, and FDs (Flexible Disks).

Fifty-fifth Aspect

A fifty-fifth aspect of the invention is directed to a printing data generation method that generates printing data for use in a printing device that prints an image onto a printing medium using a printing head that includes a plurality of nozzles each being capable of dot formation to the printing medium. The generation method includes: acquiring image data showing pixel values of M ($M \geqq 2$) for the image; and generating printing data including information about dot formation details for each of the pixel values based on the acquired image data and information about an amount of displacement observed to the printing medium by each of the nozzles between an actual dot formation position and an ideal dot formation position, and for use as the information about the dot formation details, generating information about reducing degradation of printing image quality due to a banding problem caused by the displacement between the actual dot formation position and the ideal dot formation position, and exercising control over generating the degradation-reducing information based on the displacement amount information.

This leads to effects and advantages similar to the printing data generation device of the thirty-fourth aspect.

The image data is acquired by a CPU executing a program stored in a recording medium such as ROM of an information processor such as personal computer that generates printing data, e.g., through cooperation of an input unit such as scanner, a storage device such as HDD, an input/output interface, or others. The printing data is generated by a CPU executing a program stored in a recording medium such as ROM of an information processor such as personal computer that generates printing data.

Fifty-sixth Aspect

According to a printing data generation method of a fifty-sixth aspect, in the fifty-fifth aspect, the generating generates the degradation-reducing information with respect to pixels corresponding to at least either any of the nozzles showing the displacement of a predetermined amount or more or any of the other neighboring nozzles.

This leads to effects and advantages similar to the printing data generation device of the thirty-fifth aspect.

Fifty-seventh Aspect

According to a printing data generation method of a fifty-seventh aspect, in the fifty-fifth or fifty-sixth aspect, the generating generates the degradation-reducing information with respect to pixels corresponding to at least either any of the nozzles showing the displacement of a predetermined amount or more or any of the other neighboring nozzles, but not with respect to pixels corresponding to at least any of the nozzles showing the displacement smaller than the predetermined amount or any of the other neighboring nozzles.

This leads to effects and advantages similar to the printing data generation device of the thirty-sixth aspect.

Fifty-eighth Aspect

According to a printing data generation method of a fifty-eighth aspect, in any one of the fifty-fifth to fifty-seventh aspects, the printing data generation unit generates the degradation-reducing information with respect to pixels corresponding to at least either any of the nozzles relating to the banding problem or any of the other neighboring nozzles to have dots entirely or partially corresponding to the pixels changed in size to suit the displacement amount.

This leads to effects and advantages similar to the printing data generation device of the thirty-seventh aspect.

Fifty-ninth Aspect

According to a printing data generation method of a fifty-ninth aspect, in the fifty-eighth aspect, when a dot-to-dot distance between any adjacent two of the nozzles is wider than an ideal dot-to-dot distance due to the displacement, the generating generates, for use as the degradation-reducing information, information about forming dots larger in the neighborhood of the wider dot-to-dot distance than a pixel value size in the image data acquired by the acquiring to suit the dot-to-dot distance.

This leads to effects and advantages similar to the printing data generation device of the thirty-eighth aspect.

Sixtieth Aspect

According to a printing data generation method of a sixtieth aspect, in the fifty-eighth or fifty-ninth aspect, when a dot-to-dot distance between any adjacent two of the nozzles is narrower than an ideal dot-to-dot distance due to the displacement, the generating generates, for use as the degradation-reducing information, information about forming dots smaller in the neighborhood of the narrower dot-to-dot distance than a pixel value size in the image data acquired by the acquiring to suit the dot-to-dot distance, or information about decimating dots formed in the neighborhood of the narrower dot-to-dot distance.

This leads to effects and advantages similar to the printing data generation device of the thirty-ninth aspect.

Sixty-first Aspect

According to a printing data generation method of a sixty-first aspect, in any one of the fifty-fifth to sixtieth aspects, the generating exercises control over generating the degradation-reducing information to derive a match between an amount of the degradation-reducing information and the displacement amount.

This leads to effects and advantages similar to the printing data generation device of the fortieth aspect.

Sixty-second Aspect

According to a printing data generation method of a sixty-second aspect, in any one of the fifty-fifth to sixty-first aspects, the generating generates, for use as the degradation-reducing information, information about changing a resolution of a printing image derived by at least either any of the nozzles relating to the banding problem or any of the other neighboring nozzles to be lower than a resolution of a printing image derived based on the pixel values originally of the image data acquired by the acquiring, and to be a resolution based on the displacement amount information.

This leads to effects and advantages similar to the printing data generation device of the forty-first aspect.

Sixty-third Aspect

According to a printing data generation method of a sixty-third aspect, in any one of the fifty-fifth to sixty-first aspects, the generating converts the image data to change a resolution of an image having any of the pixel values corresponding to at least either any of the nozzles relating to the banding problem or any of the other neighboring nozzles to be higher than a resolution of a printing image derived based on the pixel values originally in the image data acquired by the acquiring, and generates the information about the dot formation details based on any of the pixel values selected from those of the resolution-increased image data by reason of being closest to a dot formation position of any of the nozzles corresponding to the original pixel values, and corrected based on any of the other not-selected pixel values and the displacement amount information.

This leads to effects and advantages similar to the printing data generation device of the forty-second aspect.

Sixty-fourth Aspect

According to a printing data generation method of a sixty-fourth aspect, in any one of the fifty-fifth to sixty-first aspects, the generating generates information, for use as the information about the dot formation details, about any of the nozzles forming a reference dot at a position corresponding to a predetermined resolution that is lower than a possible maximum resolution for the printing device in a direction at least intersecting a nozzle disposition direction, and information about forming an enlarged dot at a position different from the reference dot, and exercises control over generating the information to make a formation size of the enlarged dot to suit the displacement amount.

This leads to effects and advantages similar to the printing data generation device of the forty-third aspect.

DESCRIPTION OF EXEMPLARY EMBODIMENTS

The invention will be described with reference to the accompanying drawings, wherein like numbers reference like elements.

Figure 21:
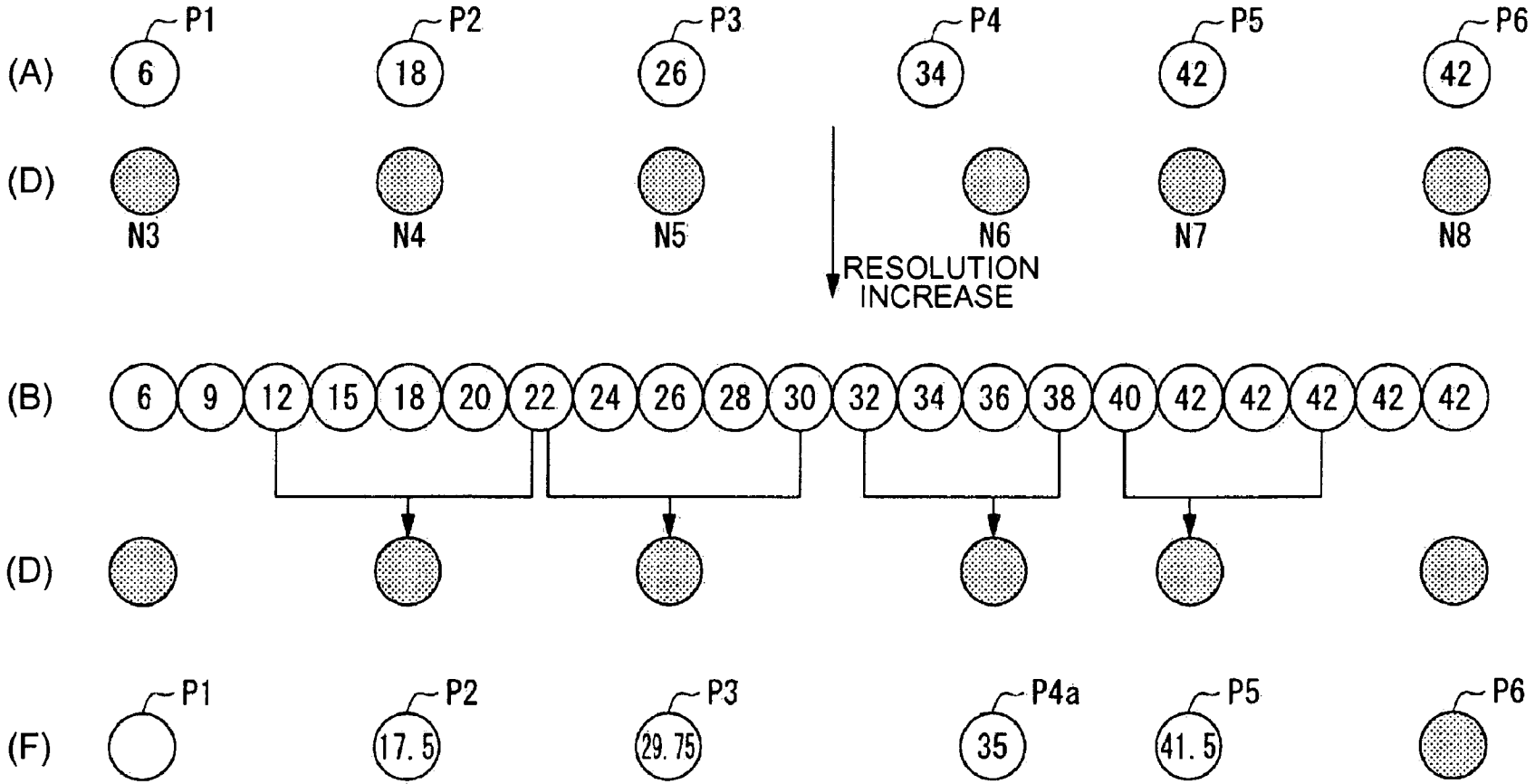

FIG. 21 includes conceptual diagrams showing the relationship among first image data, second image data, third image data, dot formation position causing ink deflection, and any selected pixel.

Figure 22:
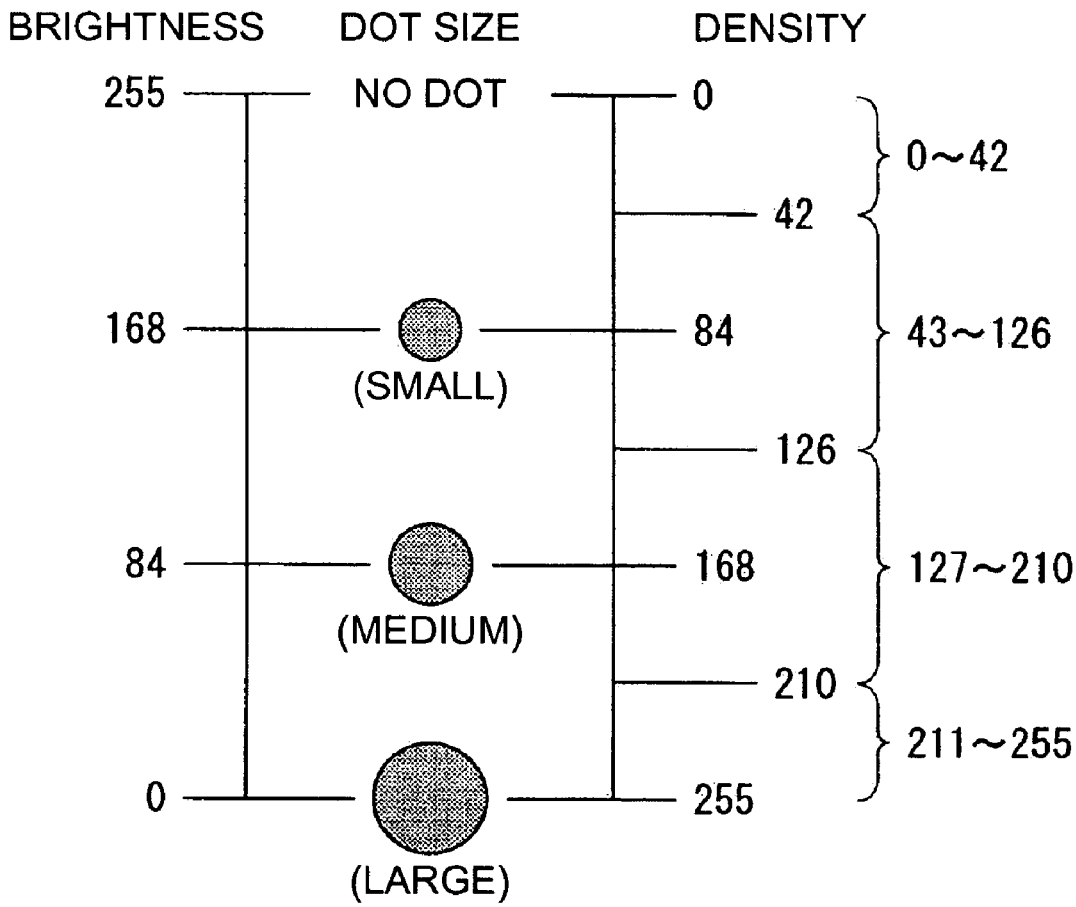

FIG. 22 is a diagram showing the relationship between a pixel value and a dot size.

Figure 23A:
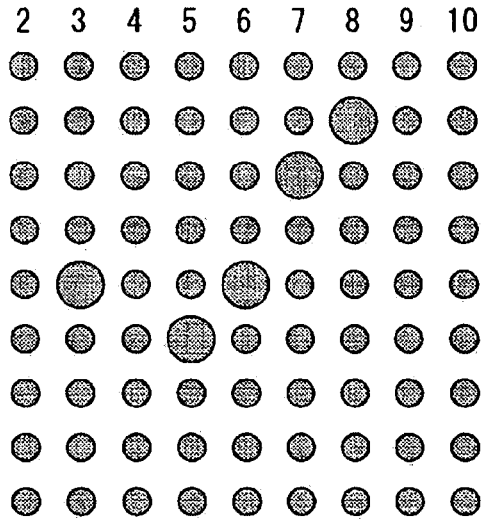
Figure 23B:
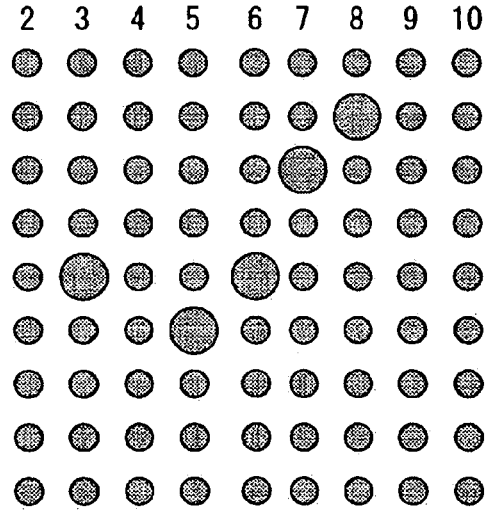
Figure 23C:
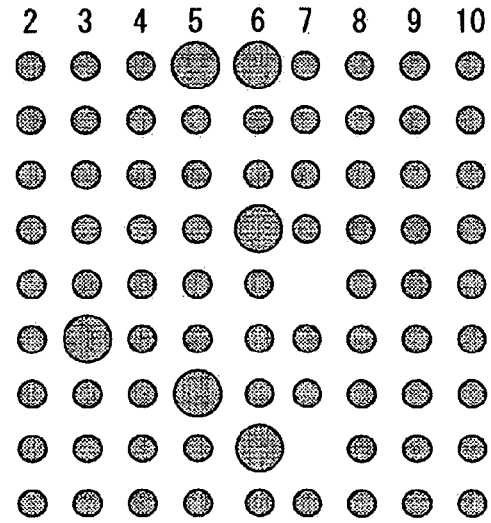

FIGS. 23A to 23C are all a diagram showing dot patterns with normal printing, with ink deflection, and with the invention applied, respectively.

Figure 24:
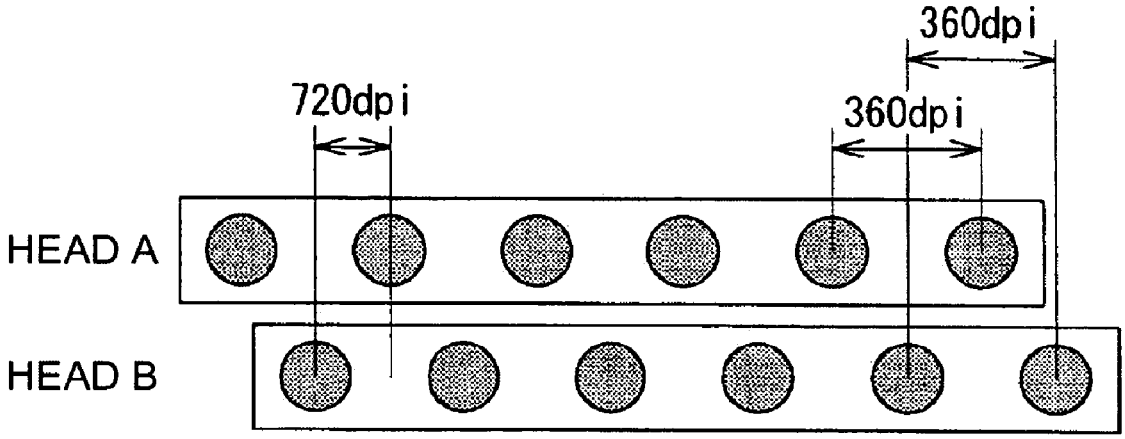

FIG. 24 is a diagram illustrating the relationship between a printing head and a dot diameter.

Figure 25:
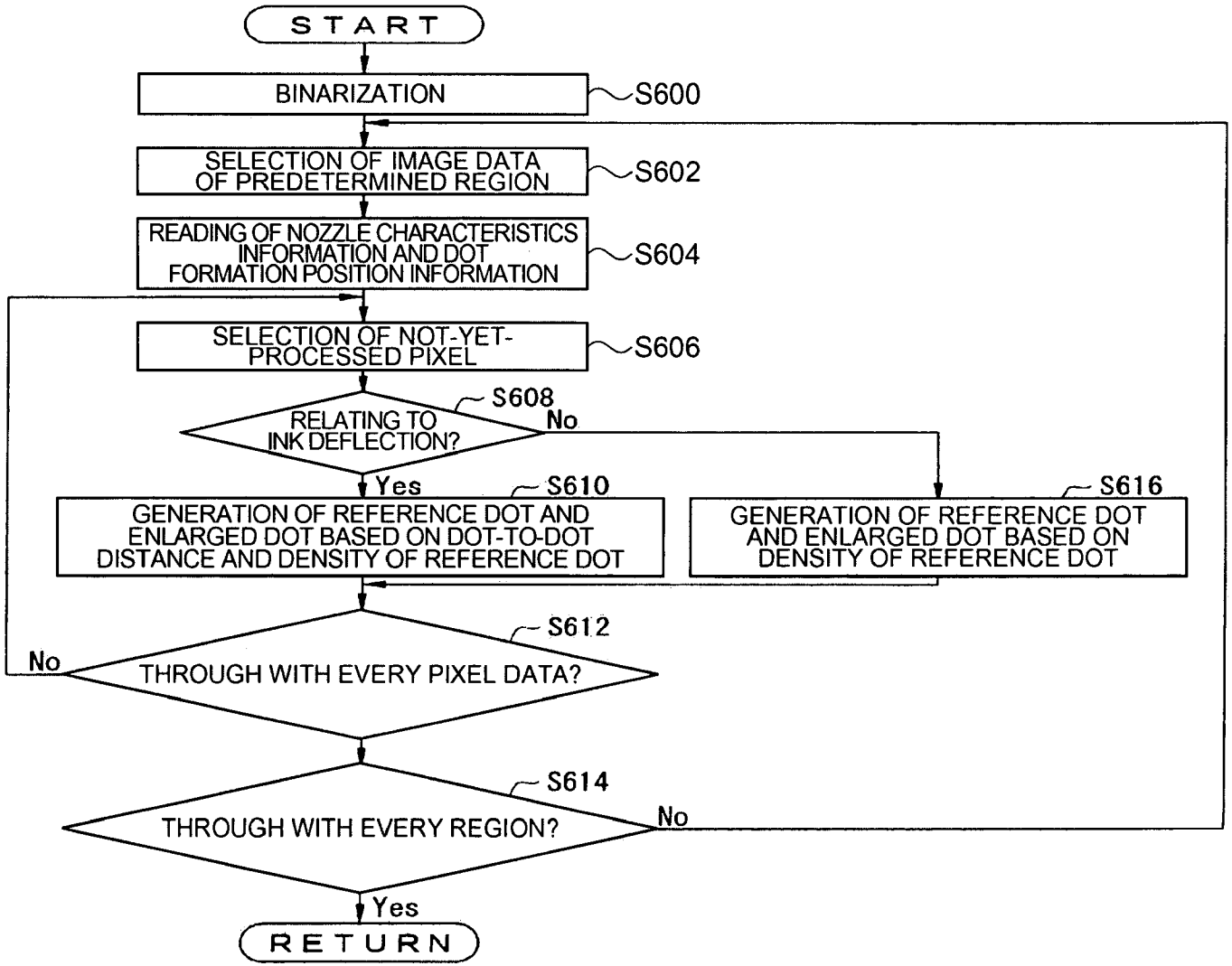

FIG. 25 is a flowchart of a printing data generation process of the printing device 300 in a fourth embodiment of the invention.

Figure 26:
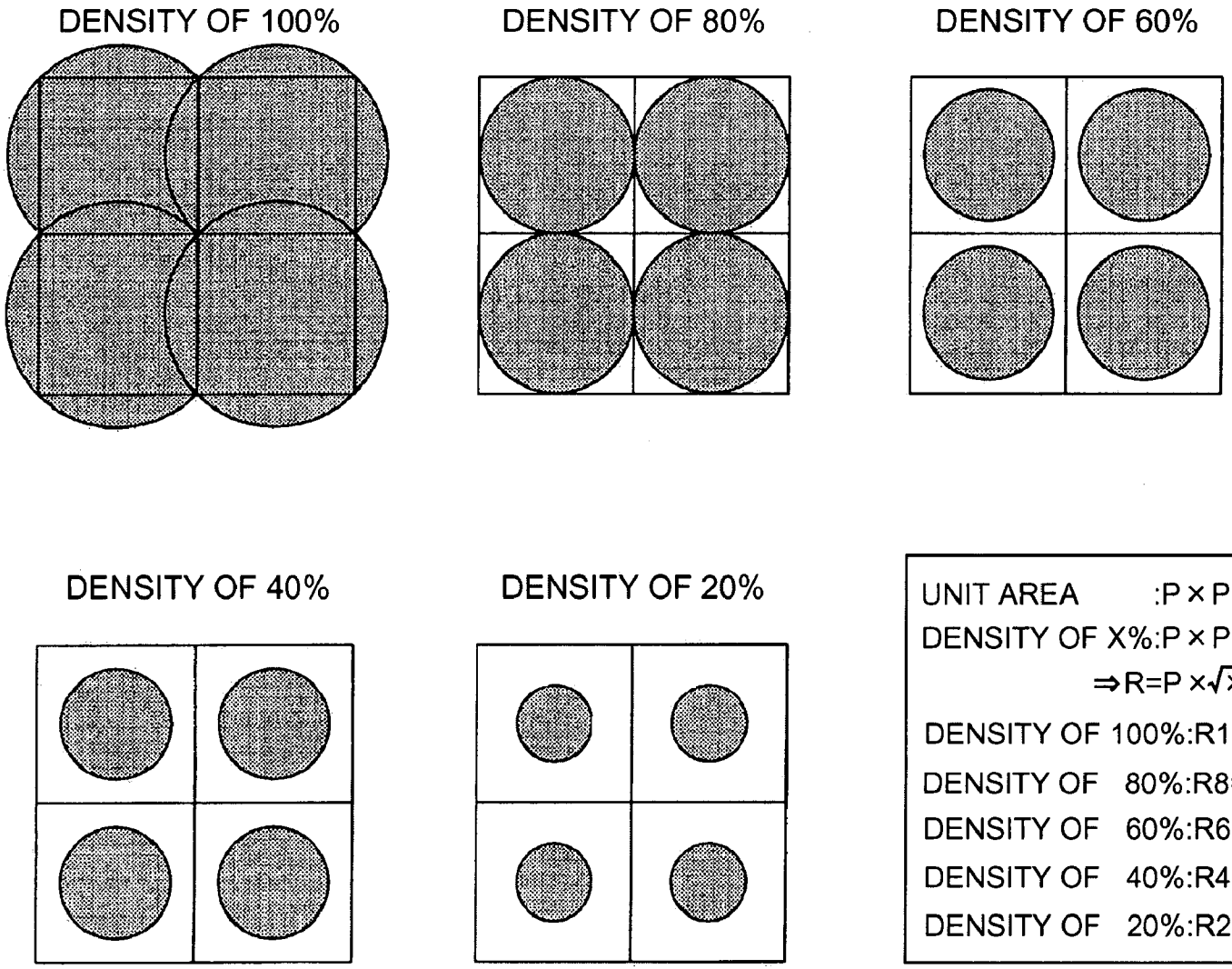

FIG. 26 is a diagram illustrating the relationship between a dot diameter and a density.

Figure 27:
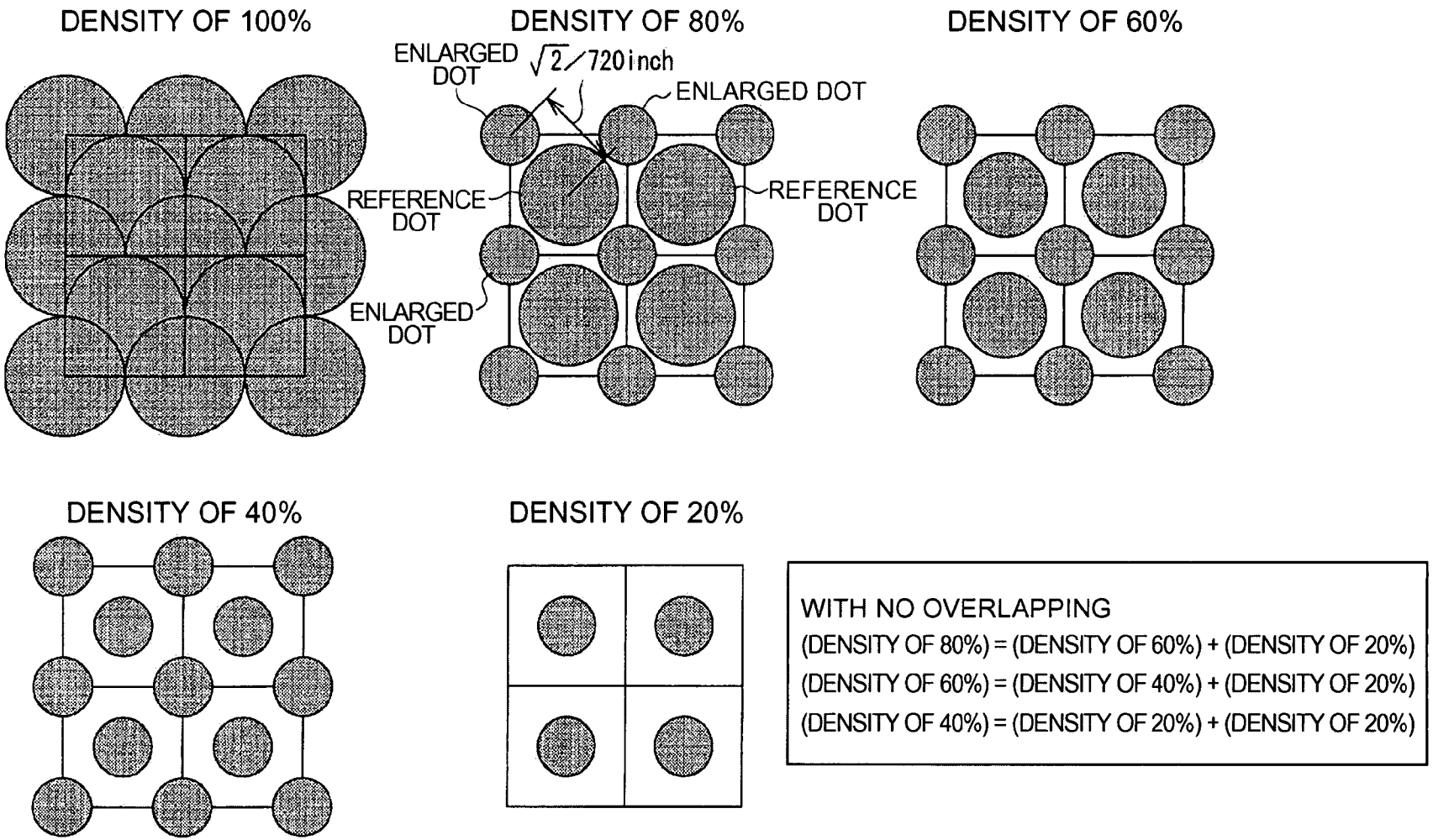

FIG. 27 is a diagram for illustrating the formation principles of reference dots and enlarged dots.

Figures 28A, 28B, 28C:
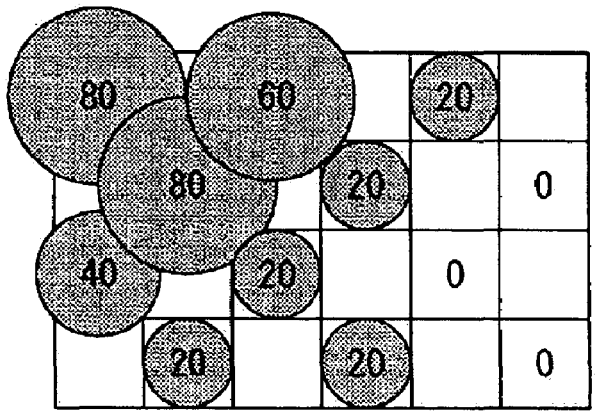

FIGS. 28A to 28C are all a diagram showing an exemplary case of generating reference dots and enlarged dots when any selected pixel data has nothing to do with ink deflection.

Figure 29:
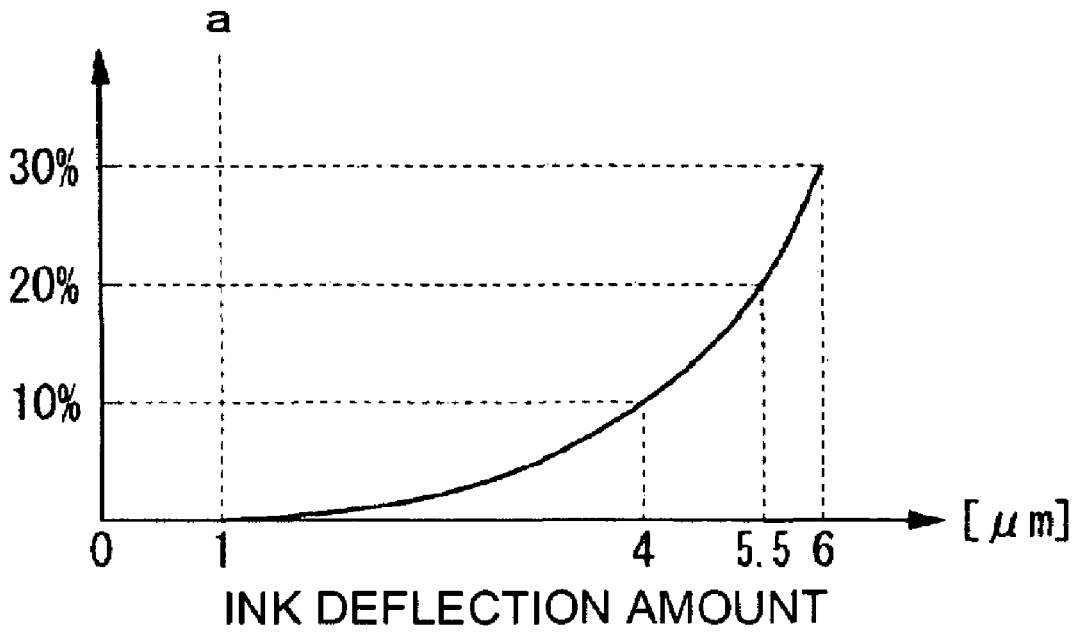

FIG. 29 is a diagram showing the relationship between the amount of ink deflection and a correction ratio of the dot diameter of an enlarged dot.

FIGS. 30A to 30D are all a diagram showing an exemplary case of generating reference dots and enlarged dots when any selected pixel data has something to do with ink deflection.

Figure 31:
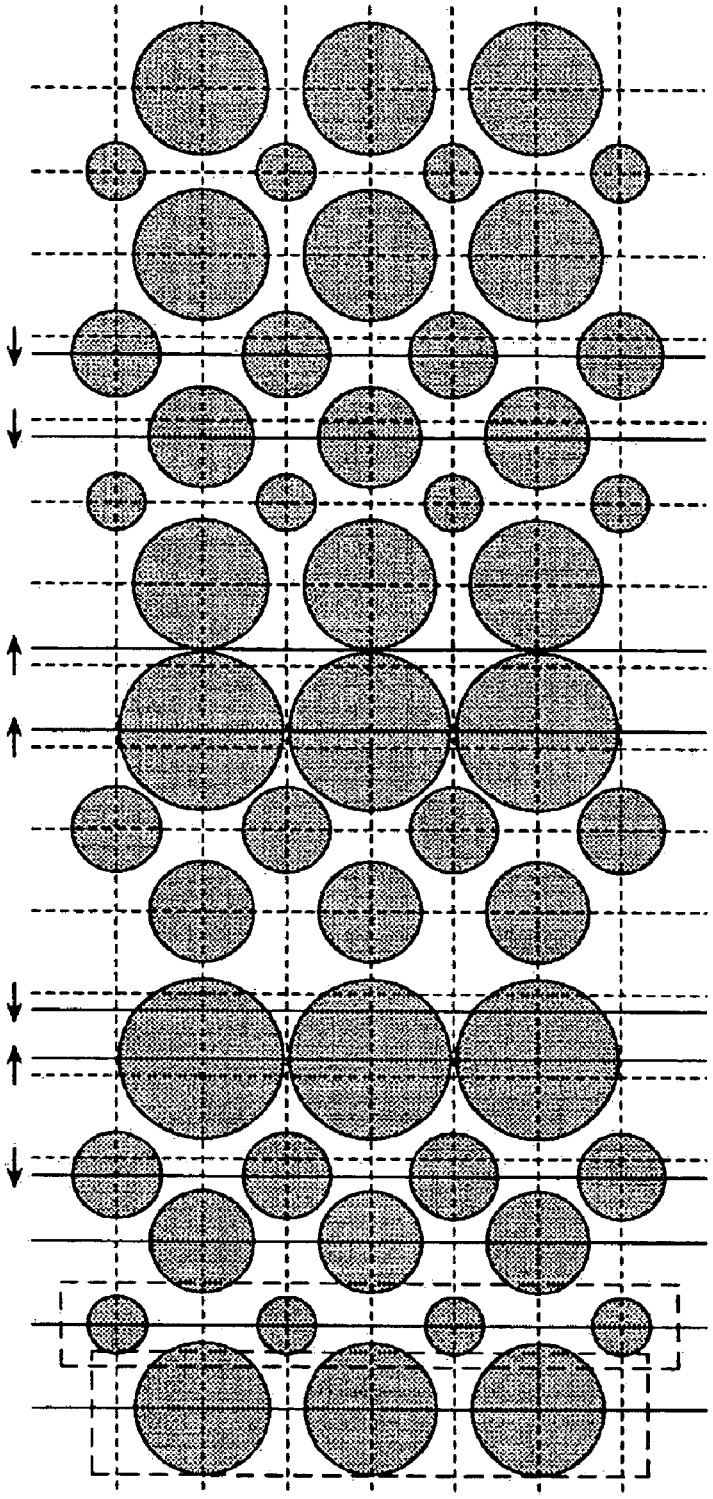

FIG. 31 is a diagram showing an exemplary printing result using printing data after a correction process.

Figure 32A:
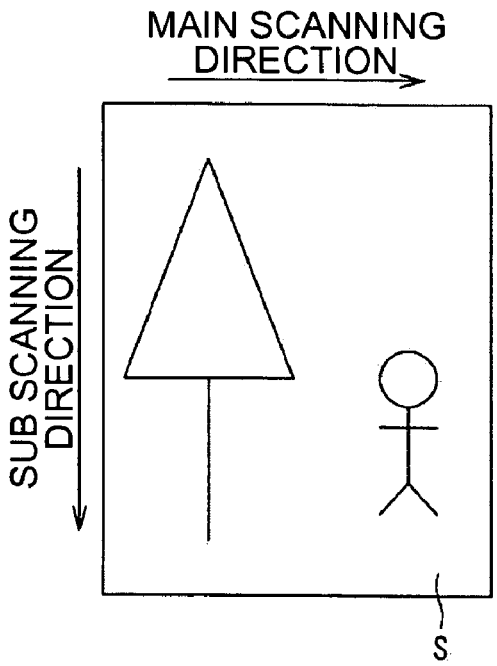
Figure 32B:
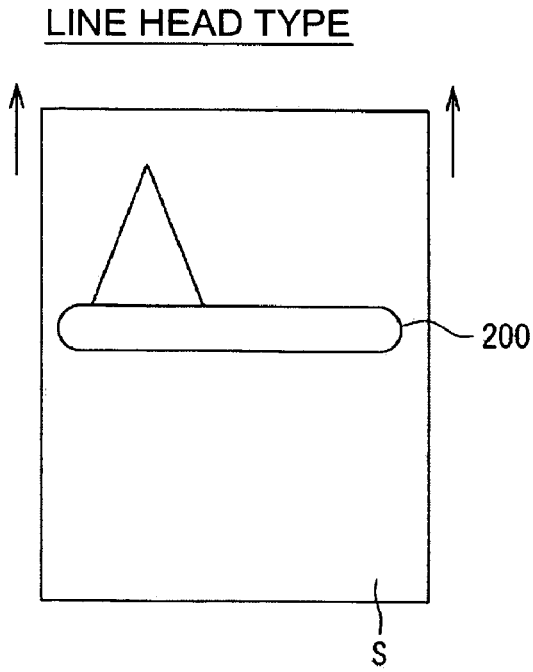
Figure 32C:
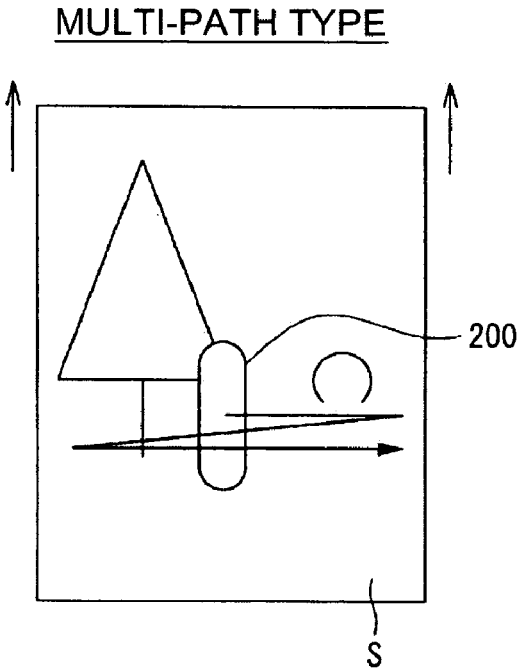

FIGS. 32A to 32C are all a diagram illustrating printing scheme differences between a multi-path ink jet printer, and a line head ink jet printer.

Figure 33:
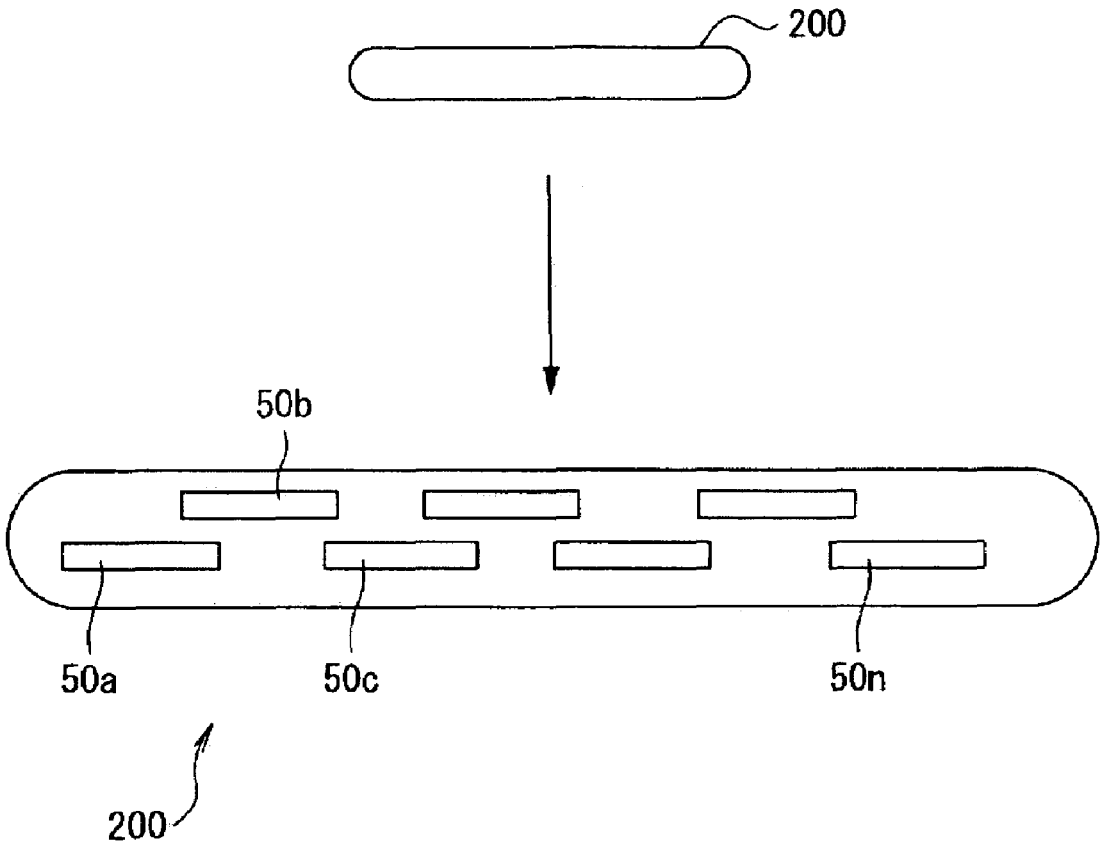

FIG. 33 is a conceptual diagram of another exemplary configuration of a printing head.

DESCRIPTION OF EXEMPLARY EMBODIMENTS

First Embodiment

Described below is a first embodiment of the invention referring to the accompanying drawings. FIGS. 1 to 13C are all a diagram showing the first embodiment of the invention, i.e., a printing device, a printing device control program and method, and a printing data generation device, program, and method.

Figure 1:
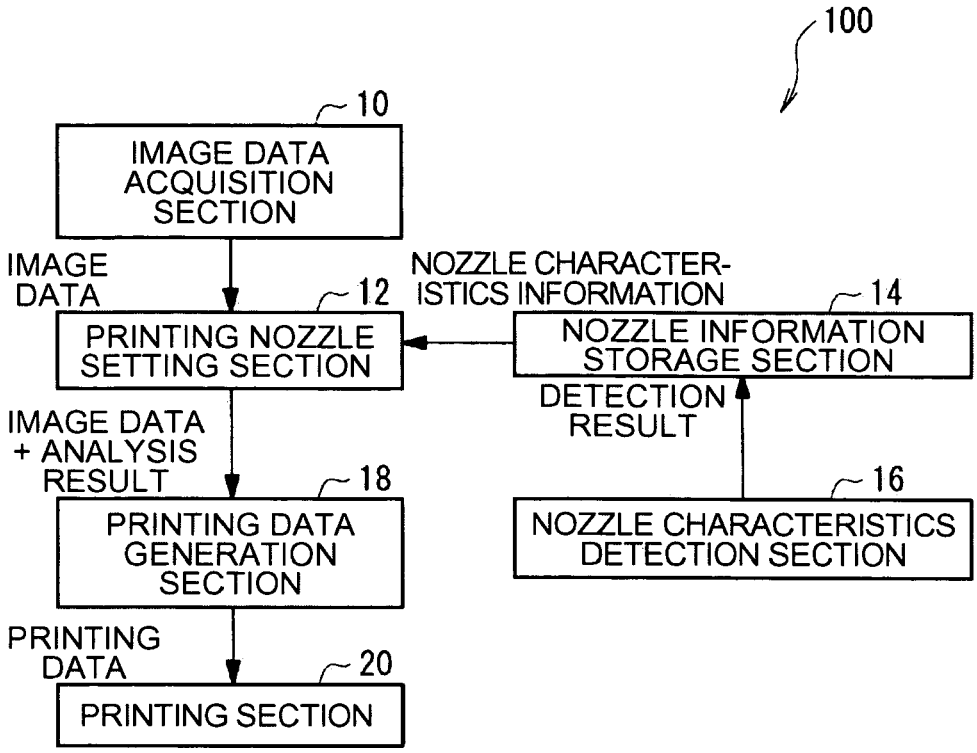
FIG. 1 is a block diagram showing the configuration of a printing device 100 of the invention.

Described first is the configuration of a printing device 100 of the invention by referring to FIG. 1. FIG. 1 is a block diagram showing the configuration of the printing device 100 of the invention.

As shown in FIG. 1, the printing device 100 is of a line-head type, configured to include: an image data acquisition section 10; a printing nozzle setting section 12; a nozzle information storage section 14; a nozzle characteristics detection section 16; a printing data generation section 18; and a printing section 20. More specifically, the image data acquisition section 10 acquires image data from any external devices, storage devices, or others. The image data is the one configuring any predetermined image. The printing nozzle setting section 12 makes a use details setting for printing nozzles with respect to pixel data of the image data. Such a setting is made based on the characteristics of any specific printing nozzles provided to an internally-provided printing head 200, which will be described later. The nozzle information storage section 14 stores information about the characteristics of the printing nozzles. Such characteristics information is detected by the nozzle characteristics detection section 16 that will be described later, or detected by a measurement text or others before shipment, for example. The nozzle characteristics detection section 16 is capable of detecting, through text printing, the characteristics of the respective printing nozzles provided to the printing head 200. Herein, the characteristics include whether or not the nozzle causes ink deflection, for example. The printing data generation section 18 generates printing data based on the image data, and the setting details made by the printing nozzle setting section 12 for the image data. The printing data is generated in the printing section 20 that will be described later, and images of the resulting image data are to be printed on a printing medium S (printing paper in this example). Based on the printing data, the printing section 20 prints the images of the image data onto the printing paper with ink jet technology.

The image data acquisition section 10 serves to acquire multi-value image data in which tone (brightness value) is represented by 8 bits (0 to 255) on a pixel basis for the respective colors of R, G, and B. The image data acquisition section 10 is capable of acquiring such image data in response to any printing command coming from external devices, input devices of its own printing device 100, or others. Such image data acquisition is made from any external devices over a network such as LAN or WAN, from recording media such as CD-ROMs or DVD-ROMs via drives of its own printing device 100, e.g., CD drives or DVD drives, that are not shown, or from a storage device 70 of its own printing device 100 that will be described later. The image data acquisition section 10 also has a function of converting multi-value RGB data into multi-value CMYK (four colors) data corresponding inks of the printing head 200 through color conversion.

The printing nozzle setting section 12 reads nozzle characteristics information about the respective nozzles N provided to the printing head 200. Such information reading is made from the nozzle information storage section 14 in response to any printing command issued against the image data acquired by the image data acquisition section 10. Based on thus read nozzle characteristics information and the image data corresponding to the printing command, the printing nozzle setting section 12 refers to the dot formation details of the nozzles to determine whether there is any nozzle not at its ideal position (specifically, any nozzle causing ink deflection) for image printing correctly on the printing paper. If such a nozzle is found, the printing nozzle setting section 12 makes a setting of whether or not to use at least either thus found nozzle or any of the neighboring nozzles for image data printing. This setting is made for every pixel data of the image data. Based on the setting details, the printing nozzle setting section 12 subjects the image data both to a pixel data decimation process corresponding to the region at which no nozzle is used, and a density value distribution process. The density value distribution process is executed to prevent the dithering level from lowering in the image part by the pixel data decimation process.

Figure 3:
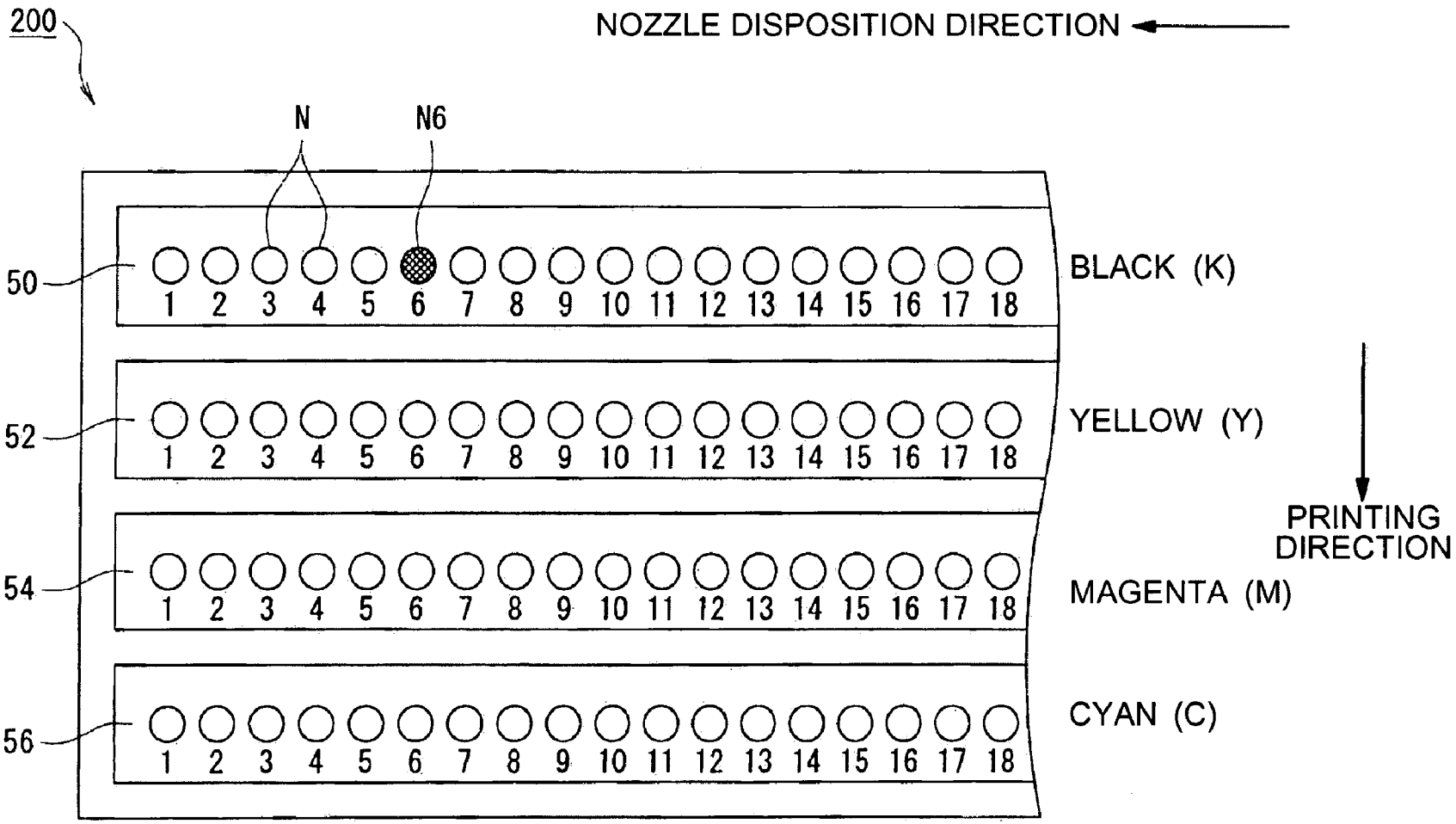
FIG. 3 is a partially-enlarged bottom view of a printing head 200 of the invention.
Figure 4:
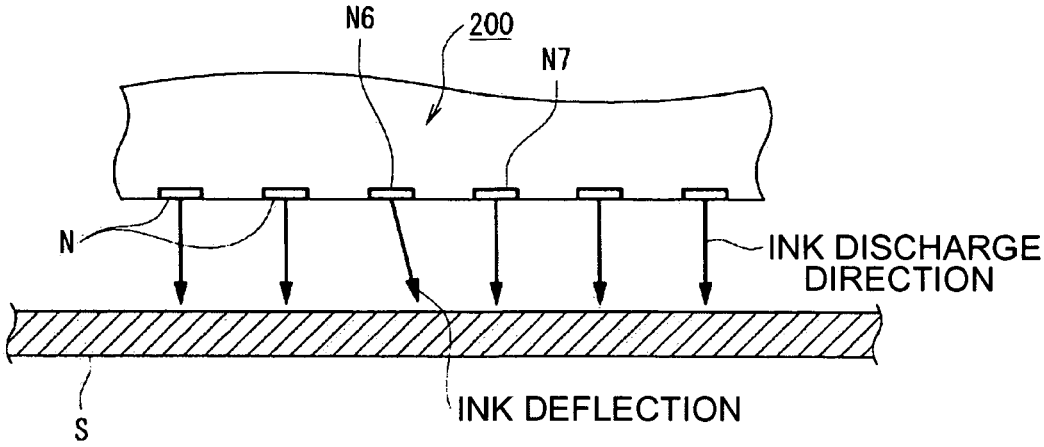
FIG. 4 is a partially-enlarged side view of the printing head 200 of FIG. 3.

The nozzle information storage section 14 serves to store the characteristics information of nozzles provided to the printing head 200, which is used in the ink-jet-type printing section 20 that will be described later, and displacement amount information for dots to be formed by the nozzles. Here, such nozzle characteristics information is used for determining whether any of the nozzles N provided to the printing head 200 used in the printing section 20 of FIGS. 3 and 4 is (are) causing ink deflection. If determined Yes, the nozzle information storage section 14 uses the information for specifically identifying which of the nozzles N is (are) faulty, i.e., causing ink deflection. In the present embodiment, when ink deflection is smaller in value than a predetermined value, it is determined that no ink deflection is occurring. The displacement amount information includes, specifically, the displacement amount for each of the nozzles N indicating how much its actual dot formation position is away from an ideal dot formation position, i.e., amount of ink deflection, and information indicating a pitch of dots to be formed by each of the nozzles N, center-to-center distance between any adjacent dots.

FIG. 3 is a partially-enlarged bottom view of the printing head 200 of the invention, and FIG. 4 is a partially-enlarged side view thereof.

As shown in FIG. 3, the printing head 200 is configured to include four nozzle modules of: a black nozzle module 50; a yellow nozzle module 52; a magenta nozzle module 54; and a cyan nozzle module 56. More specifically, the black nozzle module 50 carries a plurality of nozzles N (18 in the drawing) in a line in the direction along which the nozzles are disposed in the printing head 200, each of which discharges only black (K) ink. The yellow nozzle module 52 carries a plurality of nozzles N in a line in the nozzle disposition direction, each of which discharges only yellow (Y) ink. The magenta nozzle module 54 carries a plurality of nozzles N in a line in the nozzle disposition direction, each of which discharges only magenta (M) ink. The cyan nozzle module 56 carries a plurality of nozzles N in a line in the nozzle disposition direction, each of which discharges only cyan (C) ink. As shown in FIG. 3, the nozzle modules 50, 52, 54, and 56 are disposed as a unit in such a configuration that the nozzles N sharing the same number among these four nozzle modules come on the same line in the printing direction, i.e., direction perpendicular to the nozzle disposition direction. Accordingly, the nozzles N configuring the respective nozzle modules are disposed in a line along the nozzle disposition direction of the printing head 200. The nozzles N sharing the same number among these four nozzle modules are disposed in a line in the printing direction.

The printing head 200 configured as such prints circular dots on a white printing paper through ink discharge from nozzles N1, N2, N3, and others using piezoelectric elements exemplified by piezo actuators, which are not shown but provided to ink chambers. Here, the ink chambers, which are not shown, are respectively provided to the nozzles N1, N2, N3, and others, and carry therein ink. The printing head 200 can also print dots varying in size for each of the nozzles N1, N2, N3, and others by control exercise over the discharge amount of ink coming from the ink chambers through voltage change for application step by step to the piezo actuator. Alternatively, voltage application may be made to the nozzles in two steps in a short time in time series, and two ink droplets may be merged together on the printing paper to form a single dot. With this being the case, utilizing the fact that the ink discharge speed varies depending on the dot size, a single very-large dot can be formed by ink discharge on the printing paper at substantially the same position, i.e., a small dot first and then an enlarged dot.

As to these four nozzle modules 50, 52, 54, and 56, FIG. 4 shows an exemplary case where the nozzle N6 in the black nozzle module 50 located 6th from the left is causing ink deflection, and the nozzle N6 discharges ink onto the printing medium S in the diagonal direction. In such a case, dots formed by the faulty nozzle N6 on the printing medium S are formed in the vicinity of dots formed by a normal nozzle N7 on the printing medium S. The nozzle N7 is the one located next to the nozzle N6.

Referring back to FIG. 1, the nozzle characteristics detection section 16 checks the characteristics of the printing head 200, and stores the check result together with the data of the nozzle information storage section 14 or writes the check result over the data. Such a check operation is executed against the printing result derived by the printing head 200, utilizing a unit for reading optical printing results on a regular basis or at any predetermined time to be ready for a case if the printing head 200 is changed in characteristics after use of the printing device 100. Also measured are the amount of ink deflection observed to each of the nozzles N, and the dot-to-dot distance between dots to be formed by the nozzles N, and the measurement results are stored into the nozzle information storage section 14. Here, it is understood that the characteristics of the printing head 200 are fixed during manufacturing to some extent, and once manufactured, the characteristics hardly change except when discharge failures such as ink clogging occur, for example. Therefore, in most cases, there is no need to provide the nozzle characteristics detection section to the respective printing devices if the nozzle characteristics are checked at shipment, and stored in the nozzle information storage section 14 in advance.

Although a detailed description will be given later, the printing data generation section 18 serves to convert the image data provided by the printing nozzle setting section 12 into printing data for use in the printing section 20 of an ink jet type, which will be described later, i.e., into data about whether dots of a predetermined color and size are to be formed for every pixel data of the image data. Such data conversion is hereinafter referred to as "binarization" or "half toning" as appropriate. At the time of such data conversion, with consideration of whether the faulty nozzle and its neighboring nozzle(s) are forming dots or not for each pixel data, the printing data generation section 18 determines not to use a part of the nozzles, or exercises control over the size of dots to be formed by the other nozzles in the vicinity of the faulty nozzle. The nozzle(s) determined not to be used are those corresponding to the image part in which a banding problem is observed due to ink deflection caused by the faulty nozzle. In such a manner, the image data can be converted into printing data of a low resolution. For generating such resolution-decreased printing data, information about the dot positions including the amount of ink deflection or the dot-to-dot distance is used as a basis to exercise control over the amount of pixel data using no nozzle.

The printing section 20 is an ink jet printer with which a predetermined image is formed on the printing medium S. The image is configured by a plurality of dots of ink ejected from the nozzle modules 50, 52, 54, and 56 provided to the printing head 200. Such dots are formed while either the printing medium S or the printing head 200 or both are moved. Together with the printing head 200, the printing section 20 is configured to include: a printing head feeding mechanism (with a multi-path printer); a feeding mechanism; and a printing control mechanism, all of which are not shown. Specifically, the printing head feeding mechanism reciprocates the printing head 200 in the width direction of the printing medium (paper) S, and the feeding mechanism moves the printing medium (paper) S. The printing control mechanism exercises control over the ink discharge from the printing head 200 based on the binary data.

Figure 2:
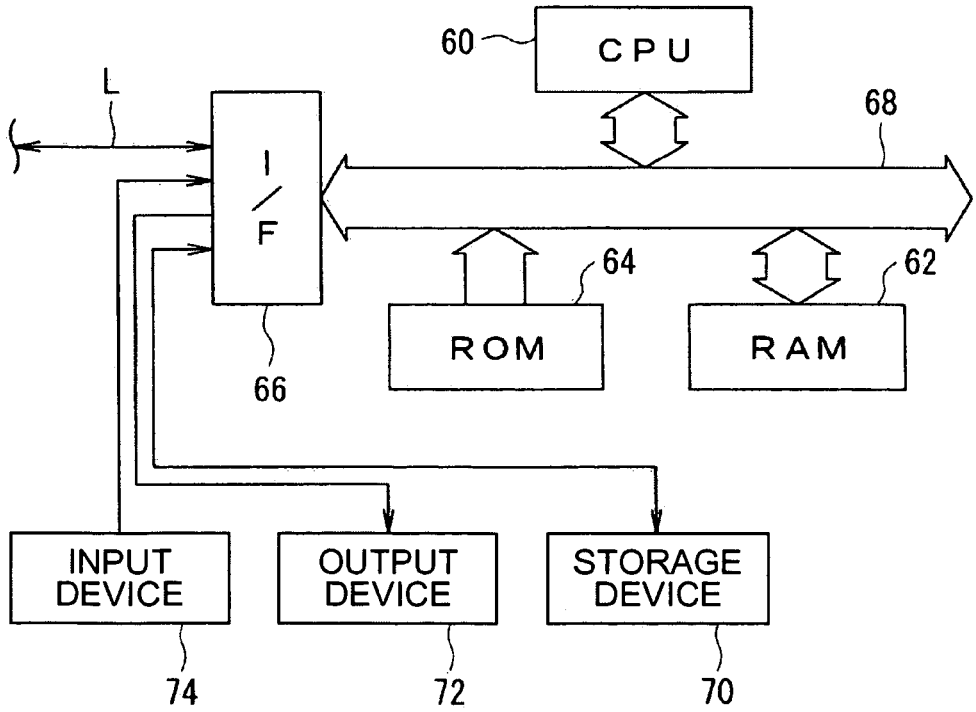
FIG. 2 is a diagram showing the hardware configuration of a computer system.

The printing device 100 is provided with a computer system for the purpose of implementing the component functions of the image data acquisition section 10, the printing nozzle setting section 12, the nozzle characteristics detection section 16, the printing data generation section 18, the printing section 20, and others, and running software of hardware control required for such component functions' implementation. As shown in FIG. 2, the computer system has such a hardware configuration that an In/Out bus 68 connects together a CPU (Central Processing Unit) 60, RAM (Random Access Memory) 62, and ROM (Read Only Memory) 64. The In/Out bus 68 varies in type, including PCI (Peripheral Component Interconnect) bus, ISA (Industrial Standard Architecture), or others. Herein, the CPU 60 takes charge of various control applications and computation. The RAM 62 serves as a main storage, and the ROM 64 is provided specifically for data reading. In the hardware configuration, the In/Out bus 68 is connected with, through an Input/Output interface (I/F) 66, the external storage device 70 (secondary storage) such as HDD, an output device 72, an input device 74, a network cable L for communications with a printing command device that is not shown, and others. Herein, the output device 72 is exemplified by the printing section 20, CRT, LCD monitor, or others, and the input device 74 by an operation panel, mouse, keyboard, scanner, or others.

When the printing device 100 is turned ON, the component functions as described above are implemented on the software by the CPU 60 applying predetermined control and performing computation by putting various resources to full use. For such control application and computation, the CPU 60 follows commands written in programs loaded to the RAM 62. The programs are those loaded by a system program such as BIOS stored in the ROM 64 or others, including various specific computer programs previously stored in the ROM 64 or installed in the storage device 70 via recording media including CD-ROMs, DVD-ROM. flexible disks (FDs), or others, or via a communications network such as the Internet.

Figure 5:
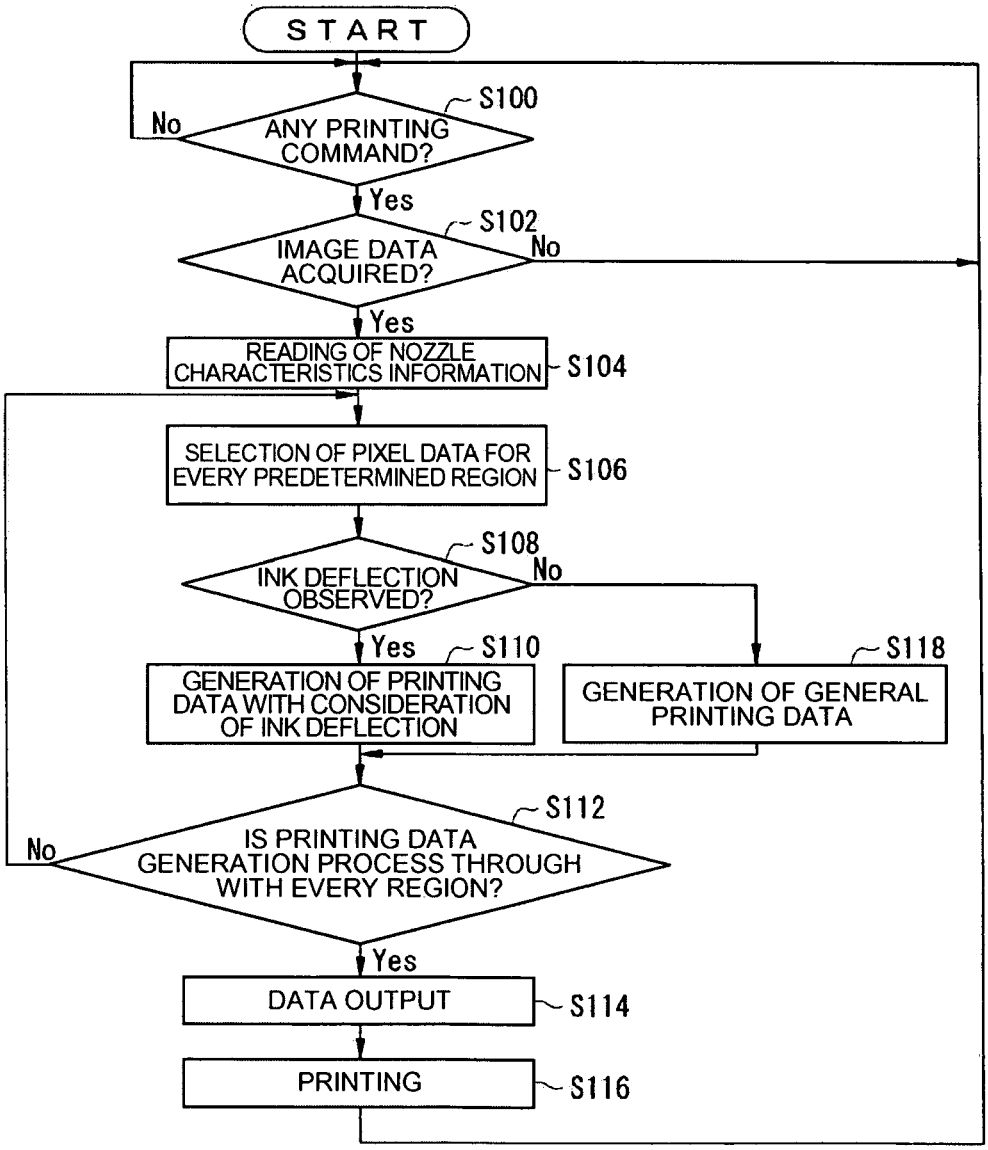
FIG. 5 is a flowchart of a printing process in the printing device 100.

The printing device 100 has the CPU 60 activated a predetermined program stored in any given region of the ROM 64, and in accordance with the program, executes the printing process in the flowchart of FIG. 5. As described above, the printing head 200 for dot formation is generally so configured as to form dots of various colors, e.g., four or six, substantially at the same time. For the sake of simplification, described below is an exemplary case in which every dot is presumably formed by the printing head 200 using a single color (monochrome color), and the resulting image is a monochrome image.

FIG. 5 is a flowchart of the printing process in the printing device 100.

As shown in FIG. 5, when executed by the CPU 60, the printing process is started from step S100.

In step S100, the image data acquisition section 10 determines whether a printing command is provided. Such a determination is made in response to printing command information coming from any external device connected through the network cable L, or printing command information coming via the input device 74. When the determination is made as Yes, the procedure goes to step S102, and when not (No), the determination process is repeated until a printing command comes.

In step S102, the image data acquisition section 10 goes through a process of acquiring image data corresponding to the printing command from recording media, the storage device 70, or others. The recording media include, as described above, external devices, CD-ROMs, DVD-ROMs, or others, and the storage device 70 includes HDDs or others. When the image data is determined as being acquired (Yes), the acquired image data is forwarded to the printing nozzle setting section 12, and the procedure goes to step S104. When the determination is No, the image data acquisition section 10 makes a notification to tell the source of printing command that the printing cannot be performed, for example, and terminates the printing process for the printing command. The procedure then returns to step S100. The image data here is the one configured by a plurality of multi-value pixel data disposed in matrix. The line direction of the image data is the same as the nozzle disposition direction in the printing head 200, and the column direction thereof is the same as the printing direction of the printing head 200.

In step S104, the printing nozzle setting section 12 reads nozzle characteristics information from the nozzle information storage section 14. The procedure then goes to step S106.

In step S106, the printing nozzle setting section 12 makes a selection of pixel data of a predetermined region from the image data acquired in step S102. The procedure then goes to step S108. The predetermined region here is a data region including a pixel data column in the image data corresponding to a faulty nozzle, and a predetermined number of neighboring pixel data columns, e.g., pixels of eight columns in the vicinity of the column corresponding to the faulty nozzle (four columns on the right and 4 columns on the left).

In step S108, the printing nozzle setting section 12 determines whether the pixel data of the predetermined region is taken charge by the faulty nozzle of the printing head 200 causing ink deflection. Such a determination is made based on the nozzle characteristics information read in step S104, and the pixel data of the predetermined region selected in step S106. When the determination is made as Yes, the procedure goes to step S110, and when No, the procedure goes to step S118.

When the procedure goes to step S110, it means that there is the pixel data corresponding to the faulty nozzle causing ink deflection. Accordingly, in the printing nozzle setting section 12 and the printing data generation section 18, printing data is generated with consideration given to ink deflection for the pixel data of the predetermined region. The procedure then goes to step S112.

In step S112, the printing data generation section 18 determines whether the printing data is generated for the entire pixel data of the image data. When the determination is made as Yes, the procedure goes to step S114, and when No, the procedure goes to step S106.

In step S114, the printing data generation section 18 forwards the printing data generated in step S108 toward the printing section 20. The procedure then goes to step S116.

In step S116, the printing section 20 goes through the printing process based on the printing data provided by the printing data generation section 18. The procedure then returns to step S100.

In step S108, when the procedure goes to step S118 with no faulty nozzle in the printing head 200 causing ink deflection, the printing data is generated by subjecting the predetermined region of the image data to normal data conversion (binarization) together with an error diffusion process that will be described later, for example. The procedure then goes to step S112.

By referring to FIG. 6, described next in detail is a printing data generation process with consideration given to ink deflection in step S110.

Figure 6:
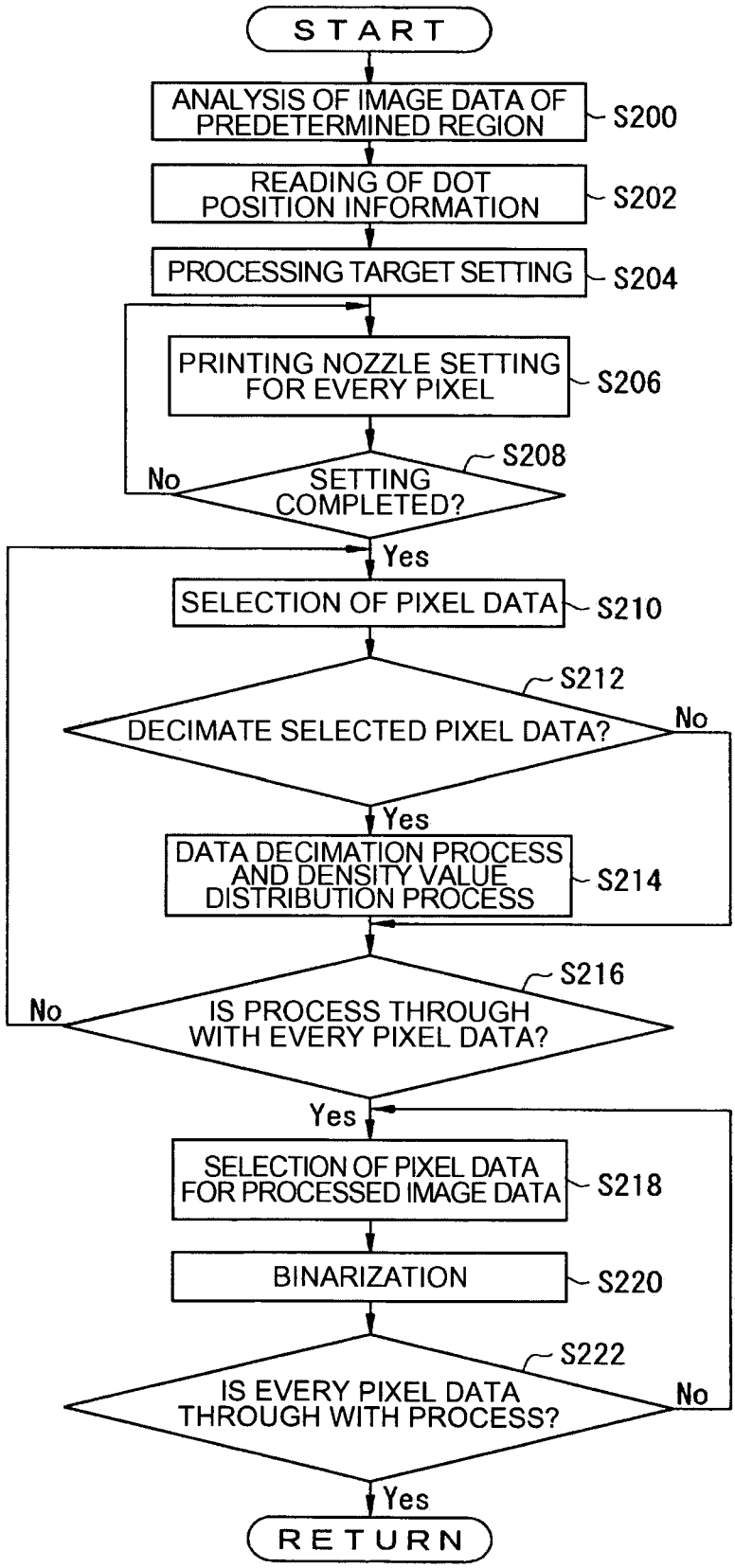
FIG. 6 is a flowchart of a printing data generation process in the printing device 100 in a first embodiment of the invention.

FIG. 6 is a flowchart of the printing data generation process with consideration given to ink deflection in the printing device 100.

In the printing data generation process, by referring to any faulty nozzle causing ink deflection and its neighboring nozzles, a nozzle use setting is made whether a nozzle is used for the pixel data corresponding to the predetermined region of the image data with consideration given to the amount of ink deflection. The setting result is then used as a basis to subject the pixel data of the predetermined region to a data decimation process and a density value distribution process. The printing data is then generated based on the image data having been subjected to such processes. After such a printing data generation process is started in step S110, as shown in FIG. 6, the procedure first goes to step S200.

In step S200, the printing nozzle setting section 12 analyzes the pixel data of the predetermined region to see the correspondence between the pixel data of the predetermined region and the respective nozzles N provided to the printing head 200. The procedure then goes to step S202. In this analysis process, analysis subjects are the image size, printing command information about specified paper size, printing mode, or others, and the correspondence between the pixel data and the respective nozzles N is thus derived. This is surely not restrictive, and the analysis process may be skipped if the ROM 64 previously stores information about the correspondence of image data size or the printing mode, for example.

In step S202, the nozzle information storage section 14 is subjected to reading of displacement amount information corresponding to at least either the faulty nozzle causing ink deflection or any of its neighboring nozzles. The procedure then goes to step S204.

In step S204, based on the analysis result of step S200, and the displacement amount size found in the displacement amount information read in step S202, i.e., difference from ideal dot formation positions for each of the nozzles N, a column setting is made to pixel columns corresponding to the faulty nozzle causing ink deflection and any of its neighboring nozzles, i.e., which column is to be processed and which column is not. The procedure then goes to step S206.

The printing nozzle setting section 12 in this embodiment exercises control over the nozzle causing ink deflection. More in detail, the larger the ink deflection, i.e., the larger the displacement amount from the ideal position, the more pixel data is to be processed, i.e., the more number of columns are to be processed, for the pixel columns corresponding to the faulty nozzle and any of its neighboring nozzles. On the other hand, the smaller the ink deflection, the less pixel data is to be processed, i.e., the less number of columns are to be processed, for the pixel columns corresponding to the faulty nozzle and any of its neighboring nozzles.

In step S206, the printing nozzle setting section 12 makes a setting of which of the nozzles N is not to be used for the line(s) to be processed, and a setting of any corresponding nozzle N is to be used for the line(s) not to be processed. Such a setting is made based on the analysis result of step S200, the setting result of step S204, and the nozzle characteristics information read from the nozzle information storage section 14. The procedure then goes to step S208.

In the present embodiment, for the line(s) to be processed, a setting is so made as not to use the faulty nozzle for every pixel data corresponding to the faulty nozzle causing ink deflection. Another setting is also made that a nozzle not on the immediate right of the faulty nozzle but with a nozzle disposed therebetween, and a nozzle not on the immediate left of the faulty nozzle with a nozzle disposed therebetween are not to be used for the corresponding pixel data. To be more specific, by referring to FIG. 3, assuming that the nozzle N6 is faulty causing ink deflection, a setting is made that the nozzle N4 with the nozzle N5 disposed therebetween, and the nozzle N8 with the nozzle N7 disposed therebetween are not to be used for the corresponding pixel data.

In step S208, the printing nozzle setting section 12 determines whether a nozzle use setting is completely made. When the determination is made as Yes, the procedure goes to step S210, and when No, the procedure returns to step S206 to continue the setting process.

In step S210, from the predetermined region for the image data, the printing nozzle setting section 12 selects any pixel data that has not yet been subjected to data decimation process nor density value distribution process. The procedure then goes to step S212.

In step S212, the printing nozzle setting section 12 determines whether the selected pixel data is corresponding to the not-to-be-used nozzle, i.e., whether the selected pixel data is to be decimated. Such a determination is made based on the pixel data selected in step S210, and the setting information in step S204. When the determination is made as Yes, the procedure goes to step S214, and when No, the procedure goes to step S216.

In step S214, the printing nozzle setting section 12 goes through a process of decimating the pixel data selected in step S210, i.e., a process of forming no dot. The printing nozzle setting section 12 also goes through a process of distributing the density value of the to-be-decimated pixel data to the pixel data on both sides thereof. The procedure then goes to step S216. In the present embodiment, for example, the density value of the to-be-decimated pixel data is divided into two, and the resulting values are each added to the density value of the pixel data on both sides. In such a manner, the density of the decimated pixel can be compensated by its adjacent pixels so that the dithering level is prevented from lowering as a result of such data decimation.

In step S216, the printing nozzle setting section 12 determines whether every pixel data is selected, and whether the process is completed. When the determination is made as Yes, the image data through with data decimation and density value distribution is forwarded to the printing data generation section 18, and then the procedure goes to step S218. When the determination is made as No, the procedure returns to step S206.

In step S218, the printing data generation section 18 selects the pixel data that has not yet been subjected to binarization from the image data through with data decimation and density value distribution. The procedure then goes to step S220.

In step S220, the printing data generation section 18 applies binarization to the pixel data selected in step S218, and the procedure goes to step S222. Here, binarization is a process of converting multi-value data into either of two values based on a threshold value. Such data conversion is generally made through comparison between multi-value data found in a specific value range, and a predetermined threshold value, e.g., median value in a specific value range. Assuming that there is multi-value data in a value range of 0 to 255, a threshold value is set to "127" being a median value. With being the case, the multi-value data is converted into either of two values, e.g., when the value of the multi-value data is larger than "127", the multi-value data is converted to "255", and when the value is equal to or smaller than the threshold value, the multi-value data is converted to "0". Because the present embodiment generates printing data, the determination factor will be whether a printing medium is formed with dots or not. For example, from two values, the value of "1" is assigned for dot formation, and the value of "0" is assigned for no dot formation. In the present embodiment, in addition to such two values of dot formation or no dot formation, a plurality of sizes are set for dots to be formed by the nozzles depending on the density value of the pixel data. A threshold value is set from the value range of the density values for each of the dot sizes, and the threshold value is compared with the pixel data (multi-value data). Based on the comparison result, the pixel data is converted into the value for dot formation or that for no dot formation. In an exemplary case with N dot sizes ($N \geqq 2$), the dot sizes are assigned with each different value representing "dot formation" so that the pixel data takes N values. In such a case, a value representing "no dot formation" is always "0".

In the present embodiment, binarization is performed for every dot size with a value of "1" for dot formation, and a value of "0" for no dot formation. Among the dot sizes determined as "formed", the largest size is selected, and information about the largest size is added to the value of "1".

The present embodiment is adopting the technique of error diffusion for such binarization, thereby enabling tone representation by dithering.

The error diffusion is a well-known technique, and when multi-value data is subjected to binarization with a specific threshold value, any difference from the threshold value is not neglected but diffused as an error for pixels to be processed. Assuming that a processing-target pixel is of 8 bits (256 tones) with a tone of "101", the tone is smaller than "127" being the threshold value (median value). In the normal binarization, the pixel is thus processed as a pixel of "0" formed with no dot, and the tone "101" is neglected. On the other hand, in the error diffusion, the tone "101" is diffused among its around not-yet-processed pixels in accordance with any predetermined error diffusion matrix. By taking a pixel right of the target pixel as an example, in the normal binarization, it is to be processed as "no dot formation" as is not satisfying the threshold value similarly to the target pixel. With the error diffusion from the target pixel, however, the density value of the pixel exceeds the threshold value, and thus can be processed as "dot formation". As such, the resulting binary data can be much closer to the original image data.

In step S222, the printing data generation section 18 determines whether every pixel data of the predetermined region is through with binarization with error diffusion. When the determination is made as Yes, this is the end of the processes, and the procedure returns.

Herein, the printing data in the present embodiment is about whether the pixels are each formed with a dot of a predetermined color and size. As such, not every pixel is formed with a dot. In the present embodiment, data decimation is performed with respect to the pixel data corresponding to any faulty nozzle causing ink deflection, and the pixel data corresponding to any of the neighboring nozzles, e.g., two nozzles on both sides of the faulty nozzle, not immediately but with a nozzle each disposed therebetween. The density value of the decimated pixel data is distributed to the pixel data on both sides so that the image part composed of ink-deflected column pixels and any neighboring pixels is reduced in resolution, and the dithering level is prevented from lowering as a result of such resolution reduction.

Through such control exercise over the ratio of pixel data lines for processing depending on the amount of ink deflection, in any part with relatively-conspicuous ink deflection, the more number of lines are to be processed so that the process of correcting the banding problem is to be executed more frequently, and in any part with not-so-much-conspicuous ink deflection, the less number of lines are to be processed so that the process of correcting the banding problem is to be executed less frequently.

Described next is the operation of the present embodiment by referring to FIGS. 7 to 13C.

Figure 7:
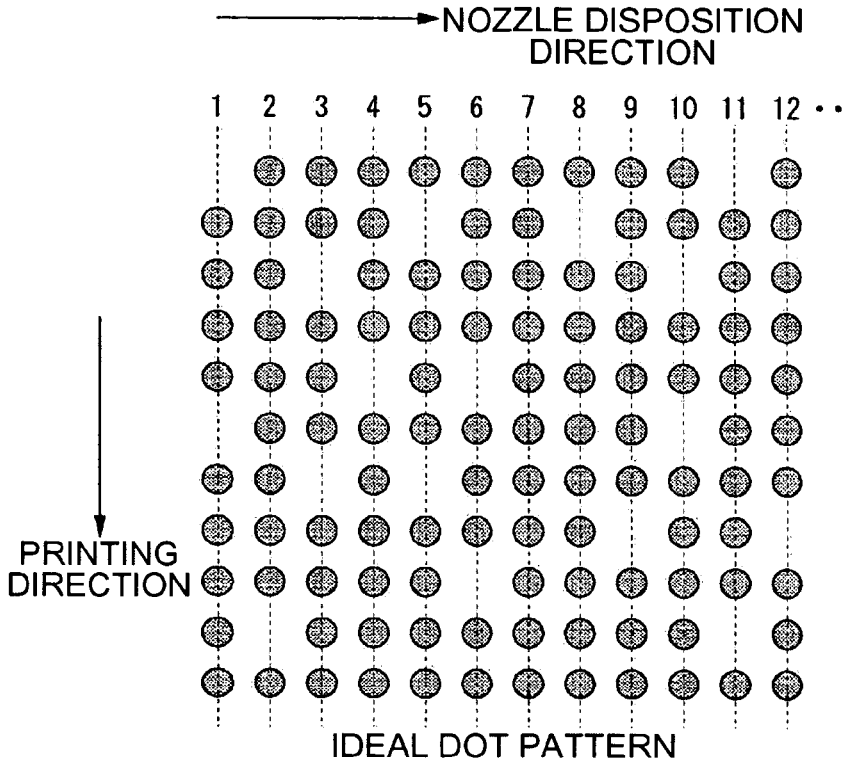
FIG. 7 is a diagram showing an exemplary dot pattern to be formed only by a black nozzle module 50, which includes no faulty nozzle as a cause of ink deflection.
Figure 8:
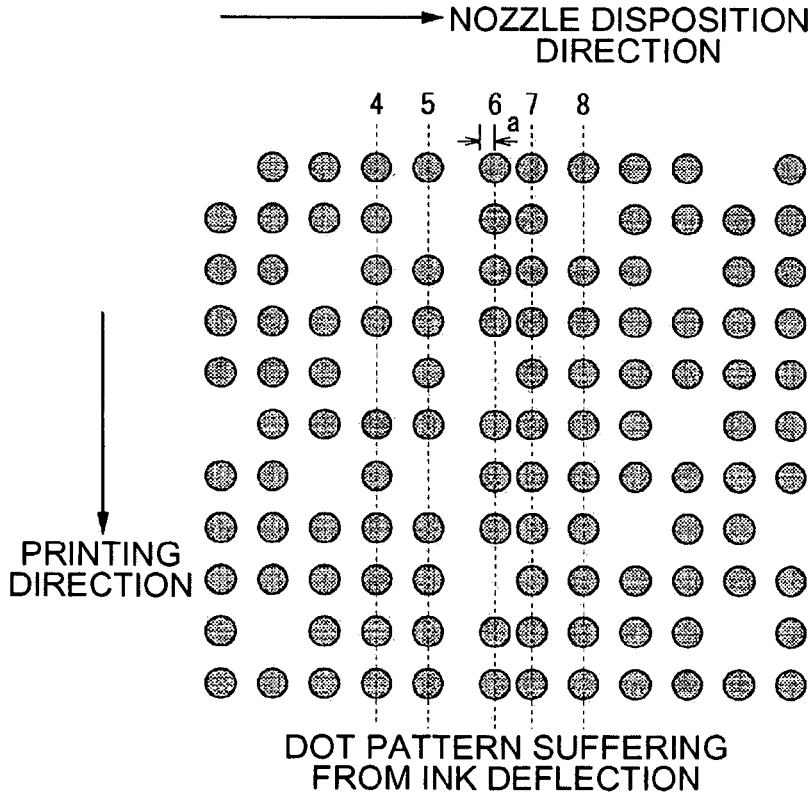
FIG. 8 is a diagram showing an exemplary dot pattern to be formed by the black nozzle module 50 in which a nozzle N6 is assumed as being a cause of ink deflection.
Figure 9A:
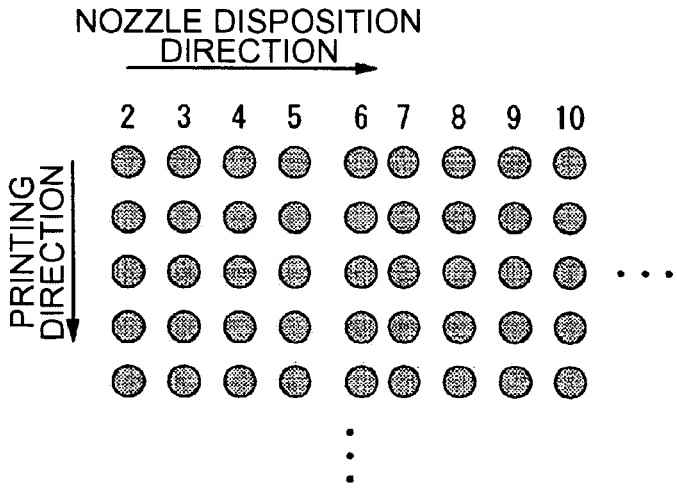
FIG. 9A is a diagram partially showing the dot pattern to be formed in the case of FIG. 8.
Figure 9B:
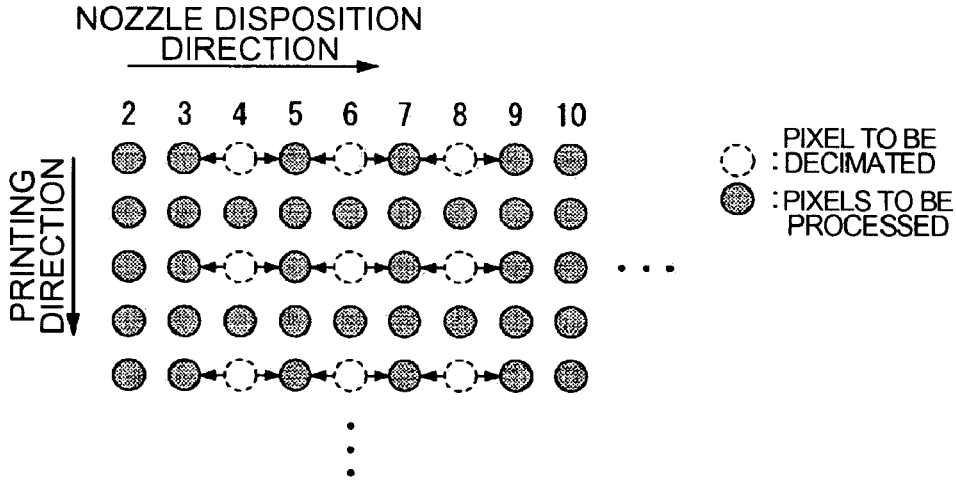
FIG. 9B is a diagram showing decimation of pixel data respectively corresponding to nozzles N4, N6, and N8 from the dot pattern of FIG. 9A.
Figure 9C:
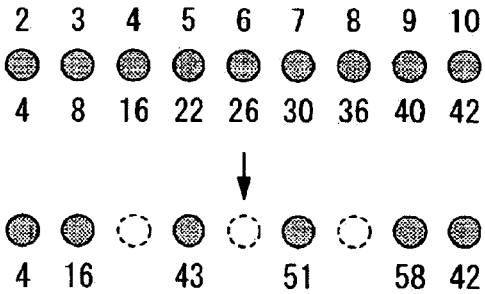
FIG. 9C is a diagram showing exemplary density value distribution to pixel data found on both sides of pixel data to be decimated.
Figure 10:
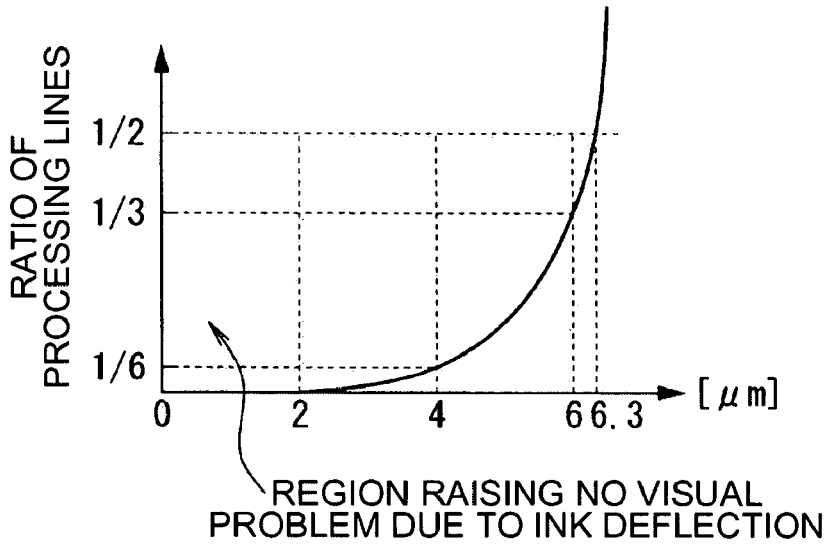
FIG. 10 is a diagram showing the relationship between the amount of ink deflection and a ratio of pixel columns for processing.
Figure 11:
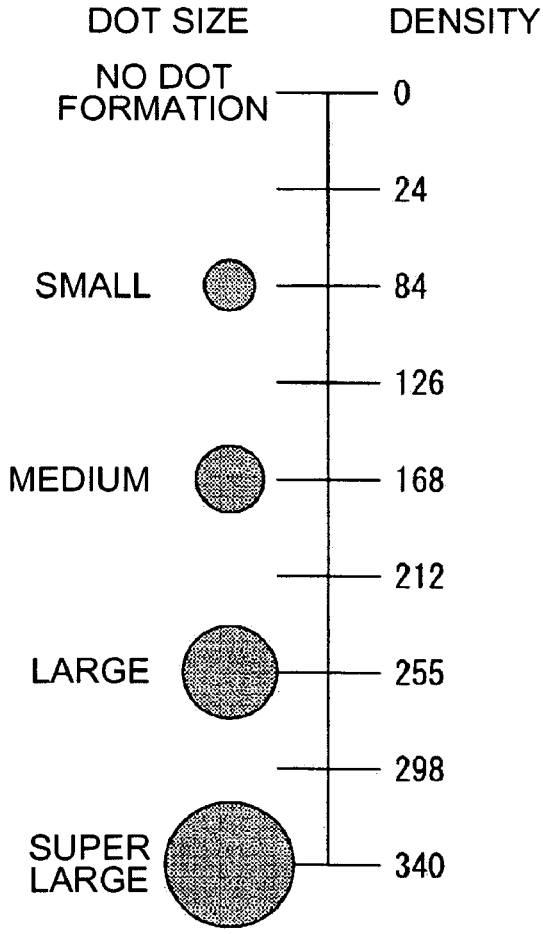
FIG. 11 is a diagram showing an exemplary dot size possibly formed by the respective nozzles N.

FIG. 7 is a diagram showing an exemplary dot pattern to be formed only by the black nozzle module 50, which includes no faulty nozzle as a cause of ink deflection. FIG. 8 is a diagram showing an exemplary dot pattern to be formed by the black nozzle module 50 in which the nozzle N6 is assumed as being a cause of ink deflection. FIG. 9A is a diagram partially showing a dot pattern to be formed in the case of FIG. 8, FIG. 9B is a diagram showing decimation of line pixel data respectively corresponding to nozzles N4, N6, and N8 from any line set for processing in the dot pattern of FIG. 9A, and FIG. 9C is a diagram showing exemplary density value distribution to pixel data found on both sides of the image data to be decimated. FIG. 10 is a diagram showing the relationship between the amount of ink deflection and a pixel column ratio for processing. FIG. 11 is a diagram showing an exemplary dot size possibly formed by the respective nozzles N. FIG. 12 is a diagram showing an exemplary diffusion direction of an error diffusion process with respect to the image data after pixel data decimation. FIG. 13A is a diagram showing an exemplary dot pattern of a filled-in image that is formed by a printing head being free from ink deflection, FIG. 13B is a diagram showing an exemplary dot pattern of a filled-in image that is formed by a printing head in which the nozzle N6 is observed with ink deflection, and FIG. 13C is a diagram showing an exemplary dot pattern that is formed based on printing data with consideration given to ink deflection of the nozzle N6.

As shown in FIG. 7, a dot pattern formed by the black nozzle module 50 including no faulty nozzle causing ink deflection is free from a banding problem as "white streaks" or "dark streaks" as described above. The banding problem is resulted from any displacement of nozzle interval.

On the other hand, FIG. 8 shows the printing result by the black nozzle module 50 in which the nozzle N6 is faulty. In the dot pattern, the dots formed by the nozzle N6 are displaced by a distance a toward the dots formed by the correct nozzle N7 on the right side. As a result, a white streak is observed between the dots formed by the nozzle N6 and the dots formed by the nozzle N5 on the left side.

The "white streaks" look pretty conspicuous when the printed image of uniform density, and when color difference is considerably big, e.g., printing paper of white and ink of black. As a result, the quality of the printing result is considerably degraded.

As an alternative to the black nozzle module 50, when any other nozzle module 52, 54, or 56 corresponding to any other colors is used, due to the displacement of the nozzle N6 by the distance a as a result of ink deflection, the distance between the nozzle N6 and the nozzle N7 on the right side becomes narrower by the distance a so that the dot density is increased in the area taken charge by such nozzles (the dots may be overlaid one another therein). As a result, the part looks conspicuous as a "dark streak". In this case, the quality of the printing result is also conspicuously degraded.

As such, the printing device 100 of the invention decimates, from the image data for printing, not only the pixel data corresponding to a faulty nozzle causing ink deflection, i.e., nozzle N6, but also the image data corresponding to any of the neighboring nozzles so that the image part observed with ink deflection is reduced in resolution. In this manner, "white streaks" or "dark streaks" are made less noticeable. Moreover, the printing device 100 distributes the density value of the to-be-decimated pixel data among the pixel data on both sides so that the dithering level is prevented from lowering in the image part. Accordingly, it becomes possible to reduce the image resolution while substantially keeping the dithering level. What is more, through control over a ratio of pixel lines for the decimation process depending on the ink deflection amount, the binarization can be performed with the original pixel values retained as much as possible. That is, any image part with rather noticeable ink deflection is frequently subjected to a process of making white or dark streaks less noticeable, and any image part with relatively little ink deflection is not subjected to the process that often.

When the printing data acquisition section 10 receives printing command information from any external device (step S100), the printing device 100 acquires image data corresponding to the printing command information from the external device or others being the source of the information. The acquired image data is forwarded to the printing nozzle setting section 12 (step S102). The printing nozzle setting section 12 reads nozzle characteristics information from the nozzle information storage section 14 (step S104), and selects the pixel data of the predetermined region from the acquired image data (step S106). Referring to the selected pixel data of the predetermined region and the read nozzle characteristics information, in the black nozzle module 50 of the printing head 200, the printing nozzle setting section 12 determines whether the pixel data of the predetermined region is corresponding to any faulty nozzle causing ink deflection (step S108). If the data is corresponding to the faulty nozzle, the procedure goes to the printing data generation process with consideration given to ink deflection (step S110).

In the printing data generation process with consideration given to ink deflection, first of all, the printing nozzle setting section 12 goes through a process of decimating, from the pixel data of the predetermined region, the pixel data corresponding to the faulty nozzle causing ink deflection, and the pixel data corresponding to any of the neighboring nozzles. This data decimation is performed based on the pixel data of the predetermined region, and the nozzle characteristics information. In this example, similarly to the above, assumed is a case where the nozzle N6 in the black nozzle module 50 is causing ink deflection, and the printing result derived by the black nozzle module 50 looks as shown in FIG. 9A, i.e., the dots formed by the nozzle N6 are displaced by the distance a toward the dots formed by the nozzle N7. The distance between the nozzles N5 and N6 looks thus wider than usual, and the distance between the nozzles N6 and N7 looks narrower than usual. The printing nozzle setting section 12 thus analyzes the pixel data of the predetermined region (step S200). The displacement amount information is then read from the nozzle characteristics information storage section 14 (step S202). A setting is then made to the image data of the predetermined region, i.e., which line is to be processed and which is not (step S204). Such a setting is made based on the displacement amount information and the relationship between the ink deflection amount and the ratio of processing lines. In the present embodiment, based on the relationship of FIG. 10, the ratio of processing lines is changed based on the ink deflection amount, i.e., with the ink deflection amount of 4 [μm], the processing lines are ⅙ of the pixel lines in the image data of a predetermined region, and with the ink deflection amount of 6 [μm], the processing lines are ⅓ of the pixel lines in the image data of a predetermined region. Assuming here is that the nozzle N6 is displaced by 6.3 [μm] toward the nozzle N7, and based on FIG. 10, a setting is so made that the processing lines are ½ of the pixel lines in the image data of a predetermined region. In the present embodiment, the odd lines in the image data of the predetermined region are set as targets for processing. As shown in FIG. 10, when the ink deflection amount is 2 [μm] or less, it is determined that no ink deflection is occurring (ratio of "0").

After the processing lines are determined as such, as shown in FIG. 9B, with respect to the processing lines, i.e., odd lines, a nozzle disuse setting is made against the pixel data corresponding to the nozzles N4 and N8, which are located on both sides of the faulty nozzle N6, not immediately but with the nozzles N5 and N7 respectively disposed therebetween (step S206). That is, the nozzles of N4, N6, and N8 are not used for their corresponding pixel data. Based on details of such a nozzle disuse setting, the pixel data corresponding to such not-to-be-used nozzles is decimated from the acquired image data. At this time, executed is also a process of distributing the density value of the to-be-decimated pixel data among the pixel data on both sides thereof (steps S212 and S214).

In the distribution process, for example, the density value of the pixel data corresponding to the not-to-be-used nozzle is divided into two (or may be three or more), and the resulting values are each added to the density value of the pixel data corresponding to the nozzles on both sides of the not-to-be-used nozzle. Assuming that, as shown in FIG. 9C, the density value of the pixel data corresponding to the not-to-be-used nozzle N6 is indicating "26", the value of "13" being the half of "26" is added to the density value of the pixel data corresponding to the nozzles N5 and N7 located on both sides of the nozzle N6. Hereinafter, the value as a result of division is referred to as distribution value. Similarly, the value of "8" being the half of the density value "16" of the pixel data corresponding to the nozzle N4 is added to the density value of the pixel data corresponding to the nozzles N3 and N5 located on both sides of the nozzle N4. The value of "18" being the half of the density value "36" of the pixel data corresponding to the nozzle N8 is also added to the density value of the pixel data corresponding to the nozzles N7 and N9 located on both sides of the nozzle N8. As shown in FIG. 9C, after such density value distribution, the density value corresponding to the nozzle N3 will be "16", the initial value of "8" plus the distribution value of "8" from the nozzle N4. The density value corresponding to the nozzle N5 will be "43", the initial value of "22" plus the distribution values of "8" and "13" from the nozzles N4 and N6, respectively. The density value corresponding to the nozzle N7 will be "51", the initial value of "30" plus the distribution values of "13" and "18" from the nozzles N6 and N8, respectively. The density value corresponding to the nozzle N9 will be "58", the initial value of "40" plus the distribution value of "18" from the nozzle N8. That is, by the data decimation process and the density value distribution process, the pixel data corresponding to the nozzles N4, N6, and N8 is decimated from the acquired image data, and as described above, the density values of the decimated pixel data are distributed to the pixel data on both sides.

After the data decimation process and the density value distribution process, the image data is forwarded to the printing data generation section 18 for binarization therein (step S220).

As described in the foregoing, the binarization is a process of comparing the density value of the pixel data with a threshold value that is each set to various sizes of dots that are in a possible size range for the nozzles. Based on the comparison result, the value of "1" is assigned for forming dots of the size, and the value of "0" is assigned for not forming dots of the size.

In the present embodiment, as shown in FIG. 11, there are four dot sizes of "super large", "large", "medium", and "small". When the pixel data indicates the density value in a range of "0 to 24, exclusive", it is determined as "no dot formation" and thus no dot is formed. When the pixel data indicates the density value in a range of "24 to 126, inclusive", dots of the size "small" corresponding to the density value of "84" are formed. When the pixel data indicates the density value in a range of "126 to 212, inclusive", dots of the size "medium" corresponding to the density value of "168" are formed. When the pixel data indicates the density value in a range of "212 to 298, inclusive", dots of the size "large" corresponding to the density value of "255" are formed. When the pixel data indicates the density value larger than 298, dots of the size "super large" corresponding to the density value of "340" are formed.

The binarization is performed with the technique of error diffusion, for example. In the error diffusion, assuming that processing-target pixel data indicates the density value of $\alpha$, dots of the size "small" are formed if with "$\alpha \leqq 84$", i.e., the value of "1". If with "$85<\alpha$", no dot is formed, i.e., the value of "0". Similarly, for the medium-sized dots, the value will be "1" if with "$86 \leqq \alpha \leqq 168$", and the value will be "0" if with "$\alpha<85$", and "$168<\alpha$". For the large-sized dots, the value will be "1" if with "$169 \leqq \alpha \leqq 255$", and the value will be "0" if with "$\alpha \leqq 168$". For the super-large-sized dots, the value will be "1" if with "$255<\alpha$", and the value will be "0" if with "$\alpha \leqq 255$". That is, based on such comparison results, if some of the four dot sizes indicate the value of "1" indicating dot formation, the largest dot size is selected therefrom. If none of the four dot sizes indicates the value of "0" indicating no dot formation, the value of "0" is selected.

Figures 12A, 12B:
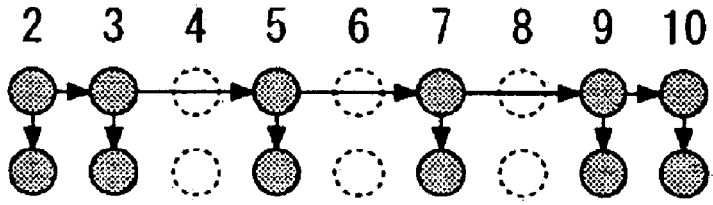
FIGS. 12A and 12B are diagrams showing an exemplary diffusion direction of an error diffusion process with respect to the image data after data decimation.
Figure 13A:
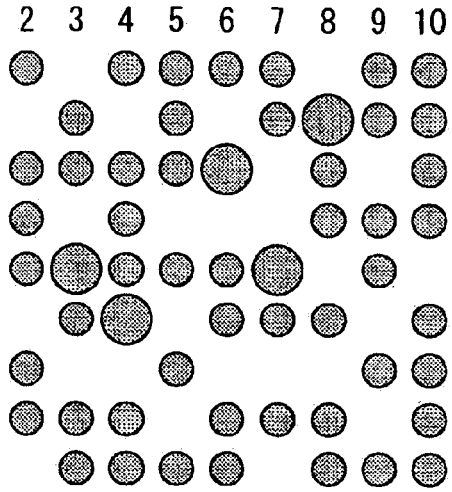
FIG. 13A is a diagram showing an exemplary dot pattern of a filled-in image that is formed by a printing head being free from ink deflection.
Figure 13B:
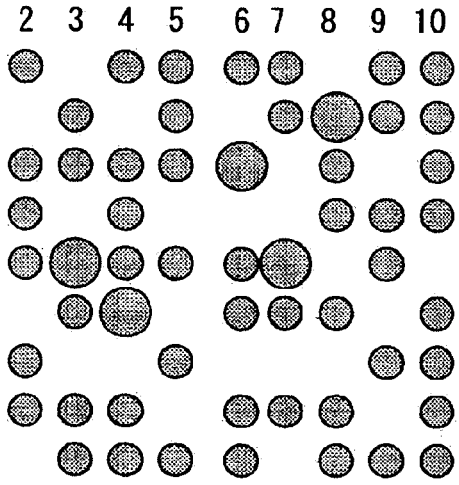
FIG. 13B is a diagram showing an exemplary dot pattern of a filled-in image that is formed by a printing head in which the nozzle N6 is observed with ink deflection.
Figure 13C:
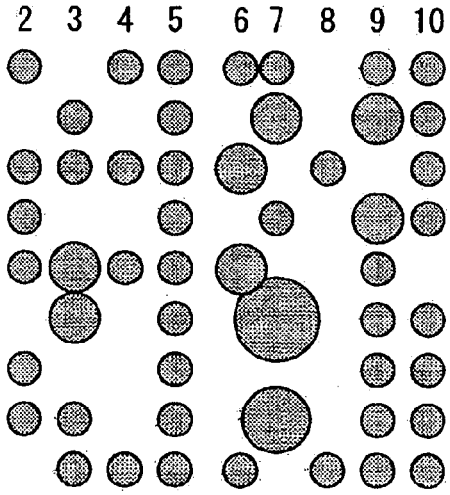
FIG. 13C is a diagram showing an exemplary dot pattern that is formed based on printing data with consideration given to ink deflection of the nozzle N6.

As shown in FIG. 12A, the error diffusion of the present embodiment pays no attention to any decimated pixels but diffuses any error to not-yet-processed pixel. For the error diffusion, such an error diffusion matrix as shown in FIG. 12B can be used. With any text-devoted process, the error diffusion is not the only option, and value determination may be made simply by comparing threshold values of pixels. Alternatively, the technique of dithering or others may be adopted for representation of dithering levels.

As such, every pixel data of a predetermined region having been subjected to data decimation and density value distribution is converted into either the value of "1" or "0", indicating forming dots of any one size of the above four, or forming no dot. For example, a value indicating dot formation of the "super large" size is "LL1", which is the value of "1" indicating dot formation plus information about size. Similarly, the value of the "large" size is "L1", the value of the "medium" size is "M1", and the value of the "small" size is "S1". In this case, the pixel data is converted into either any one of these values or "0" indicating no dot formation.

The technical method for controlling dot size as such includes a technique of providing piezo actuator to a printing head. Such a technique is easily implemented by controlling the ink discharge amount through voltage change for application to the piezo actuator.

After such data decimation and density value distribution, when every pixel data of the predetermined region of the image data is through with binarization (step S218), and when the pixel data of every region of the image data is through therewith (step S112), the image data having been subjected to binarization is forwarded to the printing section 20 as the printing data (step S114).

Based on the printing data thus provided by the printing data generation section 18, the printing section 20 uses the black nozzle module 50 to perform dot formation (printing) on a printing medium (step S116). As shown in FIG. 13C, in the formation result, no dot is formed in the odd lines (1, 3, 5, and others) for the adjacent nozzles N4, N6, and N8, and the dots at the positions corresponding to the nozzles N3, N5, N7, and N9 are bigger than the formation result of FIG. 13B. That is, the formation result of FIG. 13B is derived for the case where the printing data is generated in a normal manner with no consideration for the fact that nozzle N6 is causing ink deflection, i.e., neither data decimation nor density value distribution is performed. This is because of density value distribution, i.e., the value distributed from the decimated pixel data increases the density value of the pixel data corresponding to the nozzles N3, N5, N7, and N9 from the value range for the dot size of "small" or "medium" to the value range for the dot size of "medium", "large", or "super large". Note here that FIG. 13A shows the ideal dot formation result on the printing medium based on the normal printing data generated from the image data not having been subjected to data decimation process or density value distribution, achieved by the correct black nozzle module 50 free from faulty nozzle causing ink deflection. From a macroscopic viewpoint, compared with such an ideal printing result of FIG. 13A, in the printing result of FIG. 13C, the image texture is not smooth that much. However, compared with the printing result of FIG. 13B with no consideration to ink deflection, the phenomenon acknowledged as white and dark streaks can be made less noticeable, thereby improving the image quality in its entirety.

The relationship between the ink deflection amount and the ratio of processing lines of FIG. 10 is used as a basis to exercise control over how many pixel lines are to be subjected to data decimation process for eliminating the banding problem. This accordingly enables to minimize any possible adverse effects possibly caused by the decimation process to the original printing quality so that the image quality can be improved compared with a case with no concern about ink deflection amount.

In the first embodiment described above, the image data acquisition section 10 corresponds to the image data acquisition unit of any one of the aspects of the first, eighth, thirty-fourth, and forty-first. The nozzle information storage section 14 corresponds to the nozzle information storage unit of the first or thirty-fourth aspect. The printing nozzle selection section 12 and the printing data generation section 18 correspond to the printing data generation unit of any one of the aspects of first, seventh, eighth, thirty-fourth, fortieth, and forty-first. The printing section 20 corresponds to the printing unit of the first aspect.

In the first embodiment described above, step S102 corresponds to the image data acquiring of any one of the aspects of thirteenth, twentieth, twenty-fourth, thirty-first, forty-fourth, fifty-first, fifty-fifth, and sixty-second. Steps S108 and S110 correspond to the printing data generating of any one of the aspects of thirteenth, nineteenth, twentieth, twenty-fourth, thirtieth, thirty-first, forty-fourth, fiftieth, fifty-first, fifty-fifth, sixty-first, and sixty-second. Step S116 corresponds to the printing of the thirteenth or twenty-fourth aspect.

Second Embodiment

Described next is a second embodiment of the invention by referring to the accompanying drawings. FIGS. 14 to 17 are all a diagram showing the second embodiment of the invention, i.e., a printing device, a printing device control program and method, and a printing data generation device, program, and method.

In the second embodiment, the printing device and the computer system both are in the similar configuration as those in the first embodiment shown in FIGS. 1 and 2. The second embodiment is different from the first embodiment in the respect that the printing data generation process in step S110 of FIG. 5 is replaced with the process of FIG. 14.

Figure 14:
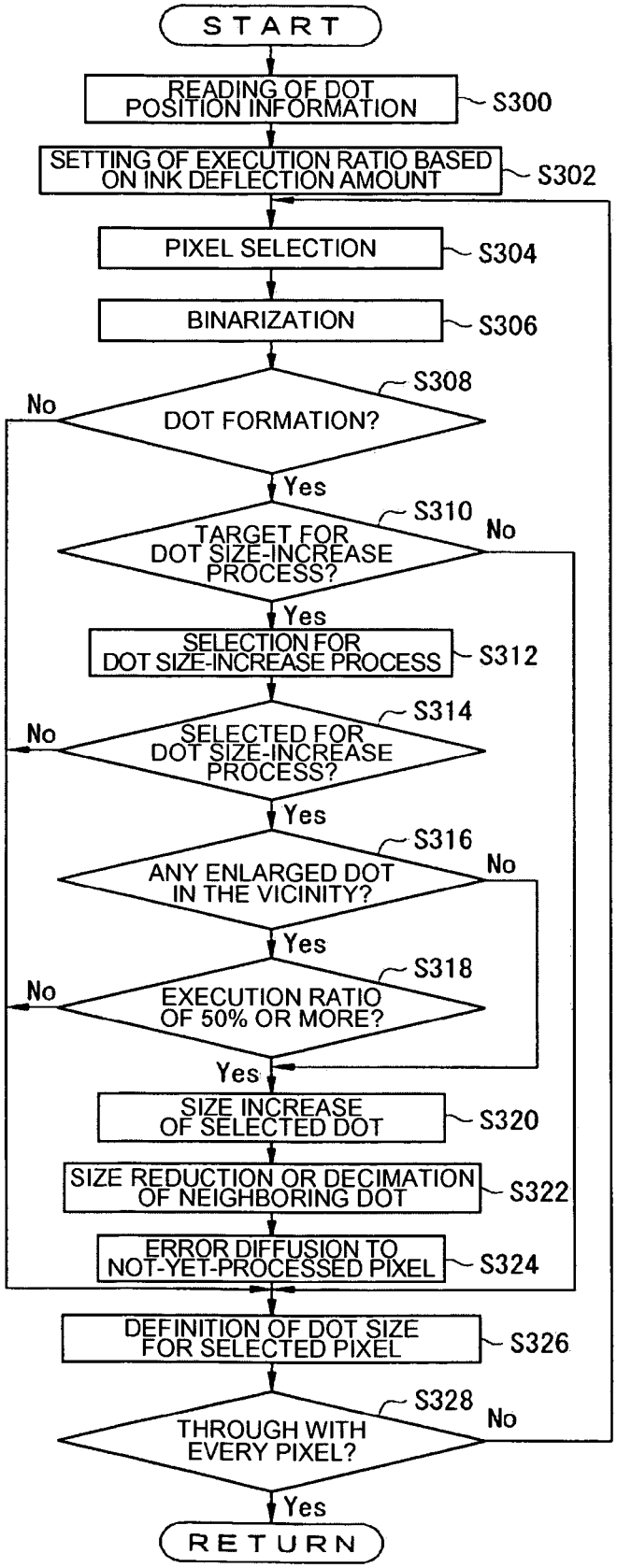
FIG. 14 is a flowchart of a printing data generation process in the printing device 100 with consideration given to ink deflection in a second embodiment of the invention.

Although the printing data generation process of FIG. 14 is the same as that of the first embodiment in principle, a difference lies in the following respects. That is, a pixel column corresponding to a nozzle causing ink deflection is determined with a dot size-increase ratio. As to the pixel column, every pixel is subjected to a selection process using random numbers, and any selected pixel is then subjected to the dot size-increase process with consideration given to the size-increase ratio. At the same time, a size reduction process or a decimation process are executed to pixel dots in the vicinity of the pixel having been through with dot size-increase process. In the below, described are only such differences from the first embodiment, avoiding redundant description.

By referring to FIG. 14, described next in detail is a printing data generation process of step S110 in the present embodiment with consideration given to ink deflection.

FIG. 14 is a flowchart of a printing data generation process in the printing data generation section 18 of the printing device 100 with consideration given to ink deflection.

In the printing data generation process, a formation ratio is determined for large dots in a pixel column corresponding to the faulty nozzle based on the ink deflection amount observed to the faulty nozzle. Thereafter, every pixel of the pixel column corresponding to the faulty nozzle is subjected to a selection process for increasing the dot size. Any pixel selected by such a selection process is then subjected to a dot-size increase process with consideration given to the formation ratio for the large dots. The image data after such processes is used as a basis to generate printing process. After such a printing data generation process is executed in step S110, as shown in FIG. 14, the procedure first goes to step S300.

In step S300, information reading is made from the nozzle information storage section 14, i.e., the nozzle characteristics information corresponding to the image data of the predetermined region, and displacement amount information, then the procedure goes to step S302.

In step S302, based on the nozzle characteristics information and the displacement amount information read in step S300, a process execution ratio is determined for the dot size-increase process of changing the dot size, from original to large, of the pixels in the pixel column corresponding to the faulty nozzle in the image data of the predetermined region. Such a process execution ratio is determined also based on how much the dot formation position of the faulty nozzle causing ink deflection is displaced from ideal. The procedure then goes to step S304. In the present embodiment, the larger the ink deflection amount, the higher the process execution ratio for the dot size-increase ratio, and the smaller the ink deflection amount, the less the process execution ratio for the dot size-increase ratio.

In step S304, any not-yet-processed pixel data is selected from the image data of the predetermined region. The procedure then goes to step S306.

In step S306, the pixel data selected in step S304 is subjected to binarization, and the procedure goes to step S308. Herein, similarly to the first embodiment, the second embodiment is also adopting the technique of error diffusion for such binarization.

In step S308, a determination is made whether dot formation is allowed for the selected pixel based on the result of the binarization in step S306. When the determination is made as Yes, the procedure goes to step S310, and when No, the procedure goes to step S326.

In step S310, a determination is made whether the selected pixel is to be selected for the dot size-increase process. When the determination is made as Yes, the procedure goes to step S312, and when No, the procedure goes to step S326. In the present embodiment, pixels taken charge by a nozzle causing ink deflection and a nozzle on its left side are to be selected for the dot size-increase process.

In step S312, the selection process is executed to see whether the pixels are to be selected for the dot size-increase process using the process execution ratio determined in step S302, and the procedure goes to step S314. In the present embodiment, the selection process is executed using predetermined random numbers based on the ratio set in step S302.

In step S314, a determination is made whether the selected pixel is selected for the dot size-increase process in step S312. When the determination is made as Yes, the procedure goes to step S316, and when No, the procedure goes to step S326.

In step S316, another determination is made whether there is any "large" dot having through with the processes in the vicinity of the selected pixel. When the determination is made as Yes, the procedure goes to step S318, and when No, the procedure goes to step S320.

In step S318, a determination is made whether the process execution ratio set in step S302 is 50% or more. When the determination is made as Yes, the procedure goes to step S320, and when No, the procedure goes to step S326.

In step S320, the dot size-increase process is executed to a dot of the selected pixel, and the procedure goes to step S322.

In step S322, the dot of any processed pixel in the vicinity of the selected pixel is subjected to the size-reduction process or the decimation process, and the procedure goes to steps S324. Specifically, the dot size-reduction process and the decimation process are those of making the neighboring processed pixels one size smaller than the current size. When the neighboring dots are of the smallest size, the dots are to be decimated.

In step S324, any error as a result of dot size change after the dot size-increase process to the selected pixel, and the size-reduction process or the decimation process to the neighboring pixels is diffused to any not-yet-processed pixels. The procedure then goes to step S326.

In step S326, the selected pixel is defined by dot size, and the procedure goes to step S328.

In step S328, a determination is made whether every pixel data in the image data of the predetermined region has been subjected to the processes of steps S304 to S326. When the determination is made as Yes, the series of processes are ended and the procedure returns, and when No, the procedure returns to step S304.

By referring to FIGS. 15A to 17, the operation of the present embodiment is described.

Figure 15A:
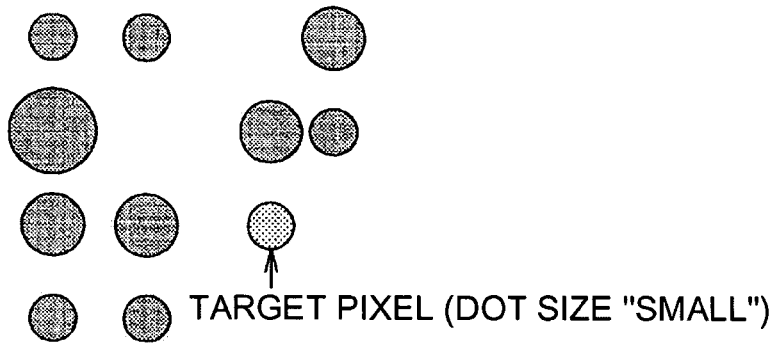
FIGS. 15A to 15C are all a conceptual diagram showing the process of dot change after a printing process of the invention.
Figure 15B:
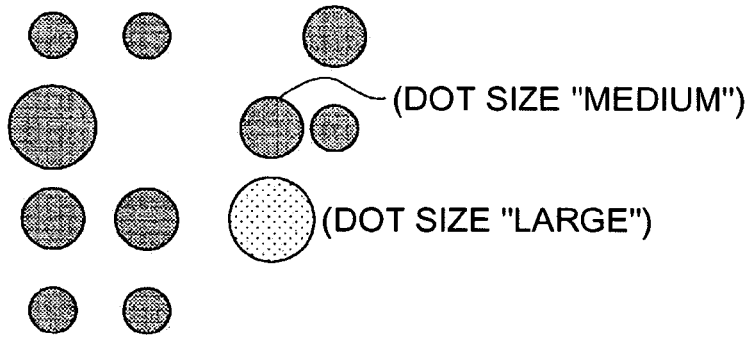
Figure 15C:
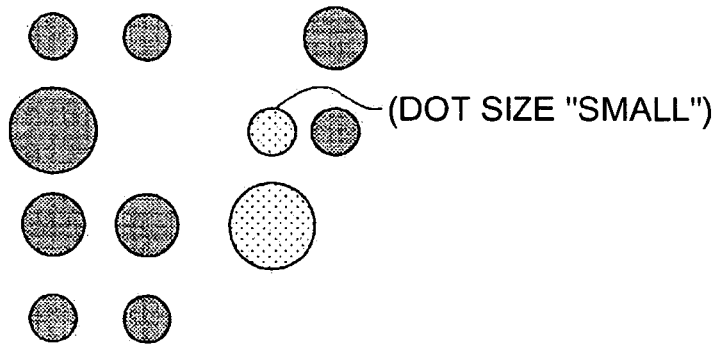
Figure 16:
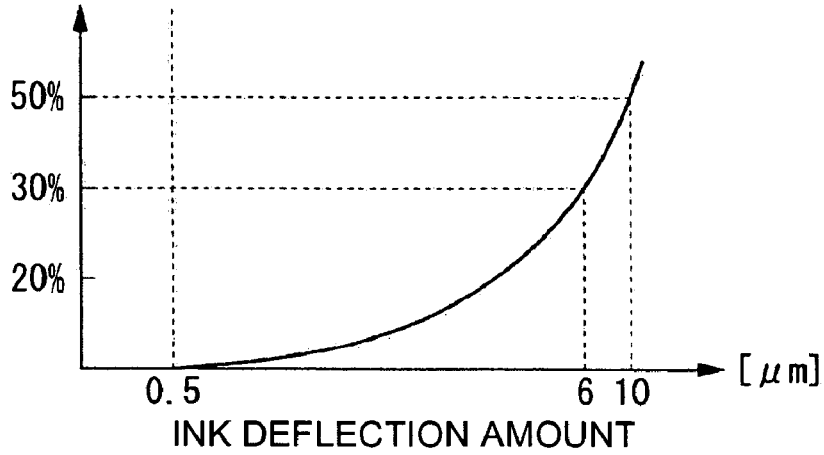
FIG. 16 is a diagram showing the relationship between the amount of ink deflection and a process execution ratio of a dot size-increase process.
Figure 17:
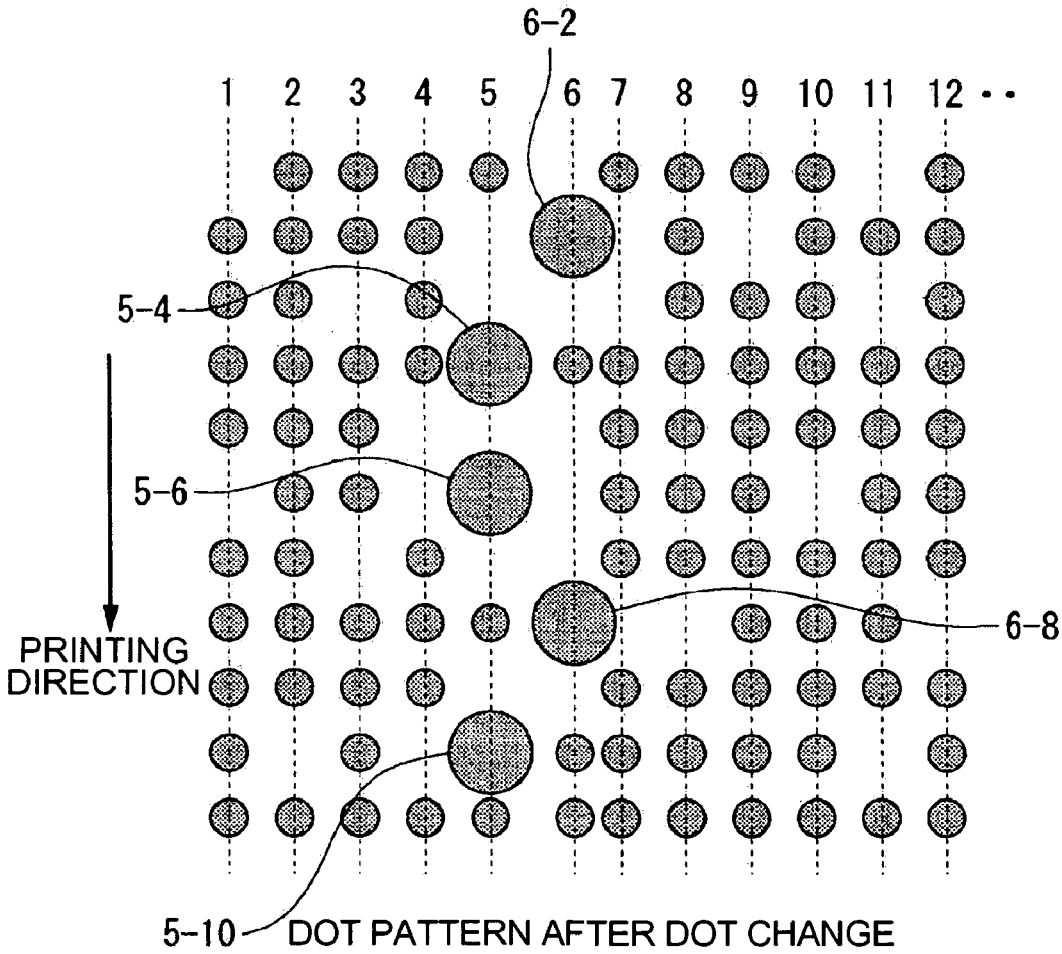
FIG. 17 is a conceptual diagram showing an exemplary dot pattern as a result of dot change after the printing process of the invention.

FIGS. 15A to 15C are all a conceptual diagram showing the process of dot change after the printing process of the invention. FIG. 16 is a diagram showing the relationship between the amount of ink deflection and the process execution ratio of a dot size-increase process. FIG. 17 is a conceptual diagram showing an exemplary dot pattern of dot change after the printing process of the invention.

Also in the present embodiment, as shown in FIG. 8 of the first embodiment, ink deflection is observed to the nozzle N6 in the black nozzle module 50. In the dot pattern, the dots formed by the nozzle N6 are displaced by the distance a toward the dots formed by the correct nozzle N7 on the right side. As a result, a white streak is observed between the dots formed by the nozzle N6 and the dots formed by the nozzle N5 on the left side.

In the printing data generation process of the present embodiment with consideration given to ink deflection, first of all, from the nozzle information storage section 14 the printing data generation section 18 reads the nozzle characteristics information and the displacement amount information corresponding to the image data of a predetermined region selected in step S106 (step S300). In this example, read are the nozzle characteristics information and the displacement amount information corresponding to the image data of the dot pattern shown in FIG. 8. Thereafter, based on the read nozzle characteristics information and the displacement amount information, with respect to a faulty nozzle causing ink deflection, i.e., the nozzle N6 in this example, a process execution ratio setting is made for the dot size-increase process of changing the dot size of the pixel column corresponding to the faulty nozzle from original to large (step S302). In the present embodiment, this process execution ratio is set based on the relationship between the ink deflection amount and the process execution ratio of the dot size-increase process. For example, when the nozzle N6 shows the ink deflection amount of 6 [μm], as shown in FIG. 16, the process execution ratio of the dot size-increase process is set to 30%, and when the nozzle N6 shows the ink deflection amount of 10 [μm], as shown in FIG. 16, the process execution ratio of the dot size-increase process is set to 50%.

After the process execution ratio is set to the dot size-increase process, a selection is made for a piece of not-yet-processed image data from the selected image data of the predetermined region (step S304). Thus selected pixel data is then subjected to binarization (step S306).

Here, binarization is a process of comparing the density value of the pixel data with a threshold value that is each set to various sizes of dots that are in a possible size range for the nozzles. Based on the comparison result, the value of "1" is assigned for forming dots of the size, and the value of "0" is assigned for not forming dots of the size.

In the present embodiment, as shown in FIG. 11 of the first embodiment, three dot sizes of "large", "medium", and "small" are used out of four dot sizes of "super large", "large", "medium", and "small". When the pixel data indicates the density value in a range of "1 to 84, inclusive", dots of the size "small" are formed. When the pixel data indicates the density value in a range of "85 to 168, inclusive", dots of the size "medium" are formed. When the pixel data indicates the density value in a range of "169 to 255, inclusive", dots of the size "large" are formed. When the pixel data indicates the density value of 0, no dot is formed.

The binarization is adopting the technique of error diffusion similarly to the first embodiment. For the error diffusion, such an error diffusion matrix as shown in FIG. 12B can be used.

After the binarization is through, a determination is made whether the pixel data is to be formed with dots (step S308). When the determination is made as Yes, another determination is made whether the pixel data is to be subjected to the selection process (step S310). When the determination is made as Yes, the selection process is accordingly executed using random numbers based on the process execution ratio that is set as above for the dot size-increase process (step S312). In this example, presumably, the selected pixel data is the one corresponding to the nozzle N6, and the selection process is executed with the process execution ratio of "30%" with the nozzle N6 showing the ink deflection amount of 6 [μm].

When the selection process selects the selected pixel data as a target for the dot size-increase process (step S314), a determination is made whether the neighboring processed pixel data carries any large-sized dot (step S316). In this example, the determination factor is only a dot directly above the selection pixel data. When the determination is made that the neighboring pixel data carries no large-sized dot, the selected pixel data is subjected to the dot size-increase process (step S320). Thereafter, in the vicinity of the dots of the selected pixel data, any processed pixel data is subjected to the dot size-reduction process or the decimation process (step S322). On the other hand, when there is pixel data carrying any large-sized dot, a determination is made whether the process execution ratio is 50% or more. In this example, because the process execution ratio is 30%, the selected pixel data is not subjected to the dot size-increase process, and the current dot size of the pixel data is defined as its dot size (step S326).

By referring to FIG. 15A, exemplified now is a case where dots of the selected pixel data are small in size, and the selection process selects the pixel data as a target for the dot size-increase process. As shown in FIG. 15A, the dot directly above the dot of the selected pixel data is medium in size. With this being the case, as shown in FIG. 15B, the dot size-increase process is executed, and the dot size of the selected pixel data is changed from small to large. In this manner, the image part suffering from white streaks caused by ink deflection is formed with large dots so that the white streaks are eliminated or made considerably less noticeable.

Because the dot directly above the size-increased dot is medium in size, as shown in FIG. 15C, the dot is made one size smaller than the current dot size, i.e., made small in size. This substantially equalizes the dithering level of a part of the selected pixel before and after the size change, or with the dithering level of any other normal part, thereby effectively preventing the corrected part of a printing result from being stood out from any other parts.

As such, when the process execution ratio of the dot size-increase process is 30%, repeating the processes as above will define the dots of FIG. 8 by size, and the printing data is generated for the image data of the selected predetermined region. The result of the printing process executed to the image part of FIG. 8 using thus generated printing data will look as shown in FIG. 17. That is, dots formed not only by the faulty nozzle N6 but also by the nozzle N5 on its left side are binarized, i.e., changed in size or decimated. As a result, the part suffering from white streaks is formed with dots large in size so that the white streaks are eliminated or made considerably less noticeable. The dithering level of the corrected part is also matched with the dithering level of any other normal parts so as to prevent with certainty the corrected parts from being stood out from any other parts.

In the second embodiment described above, the image data acquisition section 10 corresponds to the image data acquisition unit of any one of the aspects of first, fifth, sixth, thirty-fourth, thirty-eighth, and thirty-ninth. The nozzle information storage section 14 corresponds to the displacement amount information storage unit of the first or thirty-fourth aspect. The printing nozzle selection section 12 and the printing data generation section 18 correspond to the printing data generation unit of any one of the aspects of first, second, third, fourth, fifth, sixth, thirty-fourth, thirty-fifth, thirty-sixth, thirty-seventh, thirty-eighth, and thirty-ninth. The printing section 20 corresponds to the printing unit of the first aspect.

In the second embodiment described above, step S102 corresponds to the image data acquiring of any one of the aspects of thirteenth, seventeenth, eighteenth, twenty-fourth, twenty-eighth, twenty-ninth, forty-fourth, forty-eighth, forty-ninth, fifty-fifth, fifty-ninth, and sixtieth. Steps S108 and S110 correspond to the printing data generating of any one of the aspects of thirteenth, fourteenth, fifteenth, sixteenth, seventeenth, eighteenth, twenty-fourth, twenty-fifth, twenty-sixth, twenty-seventh, twenty-eighth, twenty-ninth, forty-fourth, forty-fifth, forty-sixth, forty-seventh, forty-eighth, forty-ninth, fifty-fifth, fifty-sixth, fifty-seventh, fifty-eighth, fifty-ninth, and sixtieth. Step S116 corresponds to the printing of the thirteenth or twenty-fourth aspect.

Third Embodiment

Described next is a third embodiment of the invention by referring to the accompanying drawings. FIGS. 18 to 23C are all a diagram showing the third embodiment of the invention, i.e., a printing device, a printing device control program and method, and a printing data generation device, program, and method.

The printing device of the third embodiment is similar in configuration as the printing device 100 of FIG. 1 in the first and second embodiments, except that the nozzle setting section 12 is not provided. The computer system of the third embodiment is similar to that of FIG. 1 in the first and second embodiments, and the printing head is similar to that of FIG. 3 in the first and second embodiments. In the present embodiment, the printing process of FIG. 5 in the first and second embodiments is replaced with the process of FIG. 19, and the printing data generation process of FIG. 6 or 14 is replaced with the process of FIG. 20.

The third embodiment is different from the first and second embodiments in the respect that printing data is generated by increasing the resolution of the image data, and for any nozzle causing ink deflection, by searching the resolution-increased image data for the pixel data in which the dot formation position of the faulty nozzle is closest to ideal before the resolution is increased. The difference also lies in correcting the density value of the selected pixel data based on the density value of any not-selected image data in the vicinity of the selected pixel data, and the ink deflection amount observed to the selected pixel data. In the below, described are only such differences from the first and second embodiments, and any components similar to those in the first and second embodiments are provided with the same reference numerals, and not described again.

Figure 18:
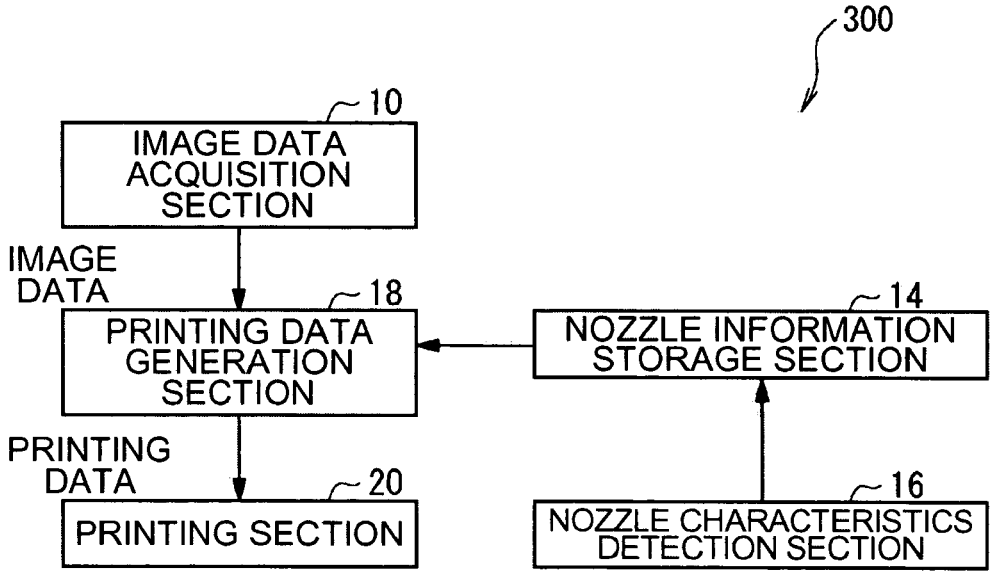
FIG. 18 is a block diagram showing the configuration of a printing device 300 of the invention.

By referring to FIG. 18, described now is the configuration of a printing device 300 of the invention. FIG. 18 is a block diagram showing the configuration of the printing device 300 of the invention.

As shown in FIG. 18, the printing device 300 is of a line-head type, and is configured to include: the image data acquisition section 10; the nozzle information storage section 14; the nozzle characteristics detection section 16; the printing data generation section 18; and the printing section 20. More specifically, the image data acquisition section 10 acquires image data from any external devices, storage devices, or others. The image data is the one configuring any predetermined image. The nozzle information storage section 14 stores information about the characteristics of the printing nozzles, and displacement amount information. Such information is detected by the nozzle characteristics detection section 16 that will be described later, or detected by a measurement text or others before shipment, for example. The nozzle characteristics detection section 16 is capable of detecting, through text printing, the characteristics of the respective printing nozzles provided to the printing head 200. Herein, the characteristics include whether or not the nozzles cause ink deflection, dot formation positions for the nozzles, and others. The printing data generation section 18 generates printing data based on the image data, and the storage contents of the nozzle information storage section 14. The printing data is used for printing images of the image data in the printing section 20 onto a printing medium S, e.g., printing paper in this example. The printing section 20 prints, based on the printing data, the images of the image data onto the printing medium S with the ink jet technology.

The printing data generation section 18 increases the resolution of the image data acquired by the image data acquisition section 10. The image data is hereinafter referred to as first image data. From the resulting resolution-increased image data, any pixel data corresponding to the nozzles of the printing head 200 is selected so that second image data is generated.

At the time of generating the second image data, for a faulty nozzle causing ink deflection, after the resolution is increased, any pixel data showing the ideal dot formation position is selected from a plurality of pixel data corresponding to the pixel data before the resolution is increased. For any other normal nozzles, selected is the same pixel data as before the resolution is increased.

The second image data generated as such is corrected by not-yet-selected pixel data in the resolution-increased image, and the resulting data is third image data.

Such a correction process is of deriving an average pixel value between the selected pixel data and the not-yet-selected pixel data in the vicinity of the selected pixel data, and determining the resulting average value as the pixel value for the selected pixel data. When a nozzle corresponding to the selected pixel data or any other neighboring nozzles is (are) causing ink deflection, control is exercised over the number of neighboring pixel data for use of average calculation for the selected pixel data based on the ink deflection amount.

After the third image data is generated as such, the third image data is subjected to binarization similarly to the first and second embodiments so that the printing data is generated.

In the present embodiment, presumably, the resolution of the first image data is the same as the resolution of the printing head 200, i.e., the number of pixels, and pixel pitch.

Figure 19:
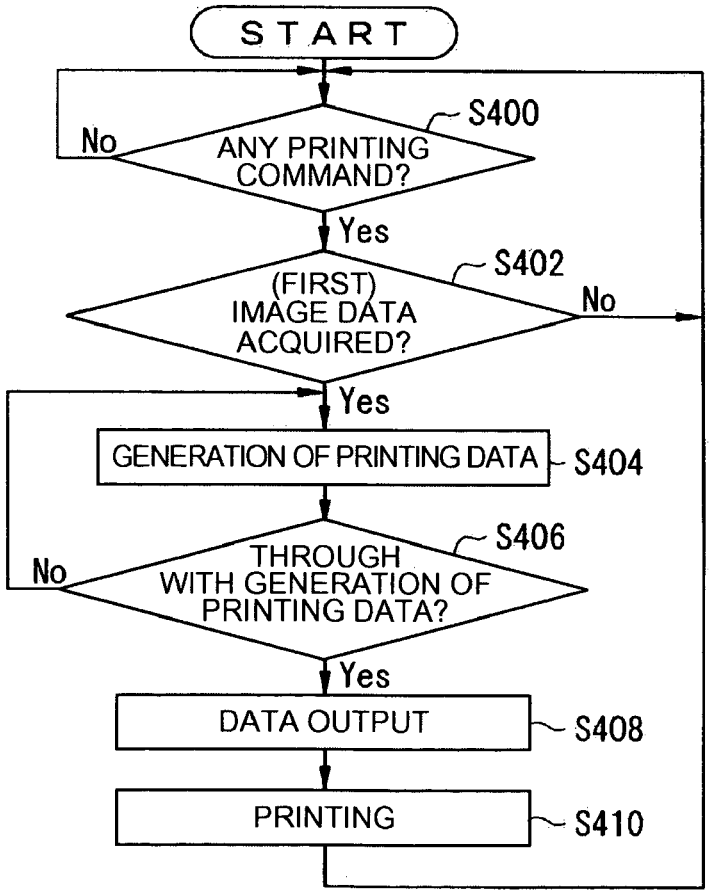
FIG. 19 is a flowchart of a printing process in the printing device 300.

FIG. 19 is a flowchart of a printing process in the printing device 300.

As shown in FIG. 19, when executed by the CPU 60, the printing process is started from step S400.

In step S400, the image data acquisition section 10 determines whether a printing command is provided. Such a determination is made in response to printing command information coming from any external device connected through the network cable L, or printing command information coming via the input device 74. When the determination is made as Yes, the procedure goes to step S402, and when not (No), the determination process is repeated until a printing command comes.

In step S402, the image data acquisition section 10 goes through a process of acquiring first image data corresponding to the printing command from recording media, the storage device 70, or others. The recording media include, as described above, external devices, CD-ROMs, DVD-ROMs, or others, and the storage device 70 includes HDDs or others. When the first image data is determined as being acquired (Yes), the acquired first image data is forwarded to the printing data generation section 18, and the procedure goes to step S404. When the determination is No, the image data acquisition section 10 makes a notification to tell the source of printing command that the printing cannot be performed, for example, and terminates the printing process for the printing command. The procedure then returns to step S400.

In step S404, the printing data generation section 18 goes through a printing data generation process of generating printing data with respect to the first image data. The procedure then goes to step S406.

In step S406, the printing data generation section 18 determines whether the printing data generation process is through. When the determination is made as Yes, the procedure goes to step S408, and when No, the procedure returns to step S404 to continue the process.

In step S408, the printing data generation section 18 outputs the printing data generated in step S406 to the printing section 20. The procedure then goes to step S410.

In step S410, the printing section 20 goes through the printing process based on the printing data provided by the printing data generation section 18. The procedure then goes to step S400.

Figure 20:
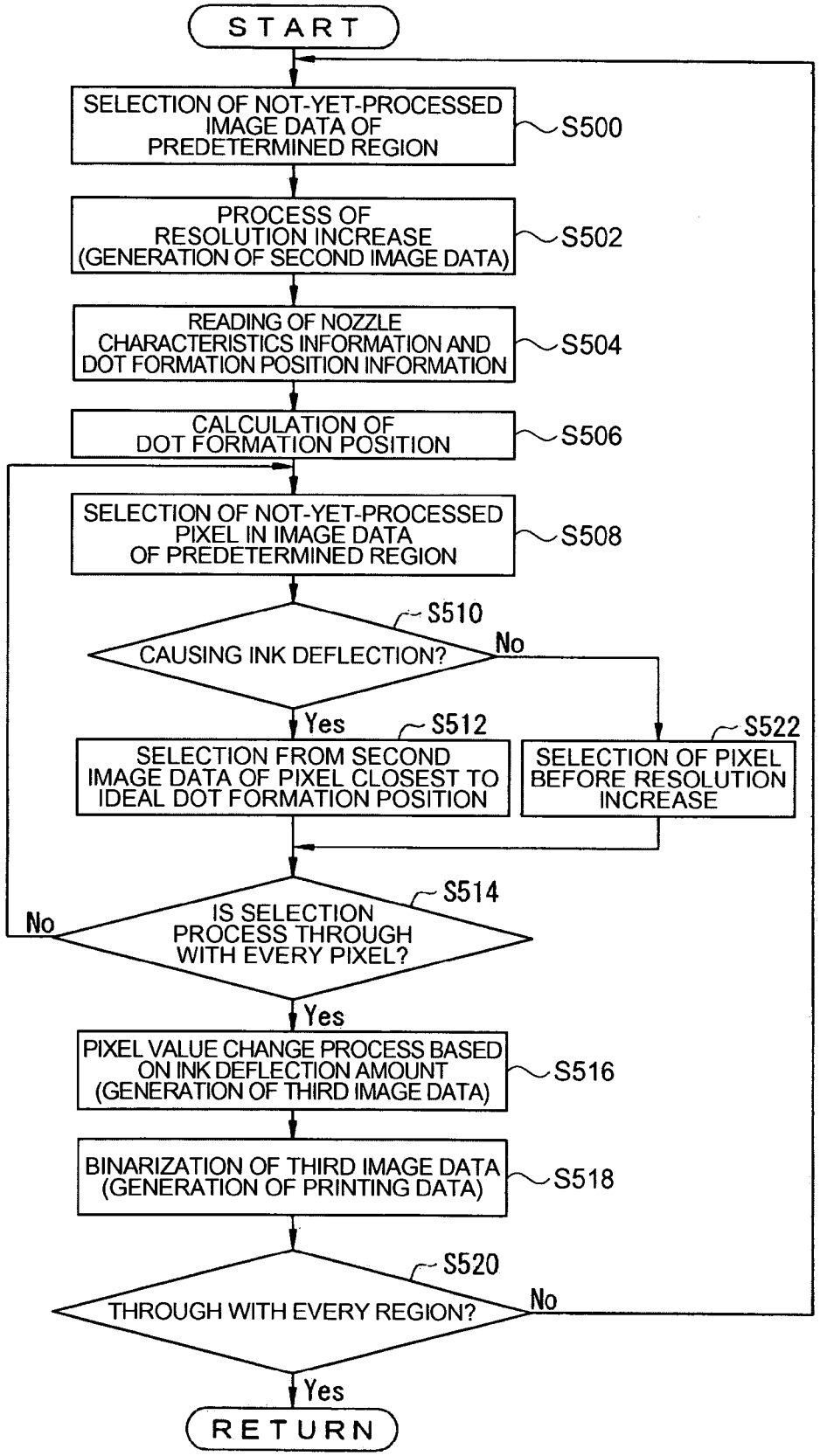
FIG. 20 is a flowchart of a printing data generation process of the printing device 300 in a third embodiment of the invention.

By referring to FIG. 20, the printing data generation process in step S404 is described in detail.

FIG. 20 is a flowchart of the printing data generation process in the printing device 300.

In the printing data generation process, as described above, the first image data is increased in resolution so that the second image data is generated. From thus generated second image data, any pixel data whose dot formation position is closest to an ideal dot formation position, and thus selected pixel data is corrected by not-yet-selected pixel data with consideration given to the amount of ink deflection. The resulting third image data is used as a basis to generate the printing data. When such a printing data generation process is executed in step S404, as shown in FIG. 20, the procedure starts from step S500.

In step S500, a selection is made from the first image data for not-yet-processed image data of a predetermined region. The procedure then goes to step S502.

In step S502, the first image data of the predetermined region selected in step S500 is increased in resolution so that the second image data is generated. The procedure then goes to step S504. In the present embodiment, the resolution increase process is of multiplying, by integer, the number of pixels in the nozzle disposition direction in the printing head 200, i.e., in the column direction of the image data. In a case where the data is increased in resolution by four times, the number of pixels in the column direction of the image data is increased by four times. In this process, the resolution is increased by four times simply by copying the same pixel data in the column direction.

In step S504, information reading is made from the nozzle information storage section 14 for nozzle characteristics information and displacement amount information corresponding to the selected first image data of the predetermined region. The procedure then goes to step S506.

In step S506, based on the second image data generated in step S502, and the nozzle characteristics information and the displacement amount information read in step S504, every pixel data in the second image data is subjected to calculation of dot formation position. The procedure then goes to step S508.

In step S508, a selection is made from the first image data of the predetermined region for any not-yet-processed pixel data. The procedure then goes to step S510.

In step S510, a determination is made whether the pixel data selected in step S508 is causing ink deflection. When the determination is made as Yes, the procedure goes to step S512, and when No, the procedure goes to step S522.

In step S512, a selection is made from the second image data for pixel data closest to the ideal dot formation position corresponding to the selected pixel data, and the procedure goes to step S514. In the below, the pixel data selected from the second image data corresponding to the selected pixel data is referred to as potential third pixel data.

In step S514, a determination is made to every pixel data in the image data of the predetermined region selected in step S500 whether a selection process is through to select potential third pixel data. When the determination is made as Yes, the procedure goes to step S516, and when No, the procedure returns to step S508.

In step S516, based on the ink deflection amount corresponding to the potential third pixel data, the pixel value of the potential third pixel data is corrected by the pixel values and those of the neighboring pixel data in the second image data so that the third image data is generated. The procedure then goes to step S518.

Herein, as described above, the pixel value correction process executed to the potential third pixel data is of deriving an average value in the second pixel data between the potential third pixel data and the neighboring pixel data based on the ink deflection amount of the potential third pixel data, i.e., the dot-to-dot distance between the potential third pixel data. The resulting average value is determined as the pixel value for the potential third pixel data. For example, based on the ink deflection amount, the number of pixel data for averaging is increased for any dot adjacent to the potential third pixel data having a wider dot-to-dot distance from any dot suffering from the ink deflection. On the other hand, the number of pixel data for averaging is decreased for any dot having a narrower dot-to-dot distance from any dot suffering from the ink deflection. The potential third pixel data in which the pixel value is corrected configures the third image data. Note here that the pixel value in this embodiment is the brightness value.

In step S518, the third image data generated in step S516 is subjected to binarization so that the printing data is generated. The procedure then goes to step S520.

In step S520, a determination is made whether the first image data is thoroughly through with the printing data generation process. When the determination is made as Yes, the series of processes are ended and the procedure returns, and when No, the procedure returns to step S500.

In step S510, when the procedure goes to step S522 with the selected pixel data not causing ink deflection, the pixels of the first image data before the resolution is increased is selected as the potential third pixel data without any change, and the procedure goes to step S514.

By referring to FIGS. 21 to 23C, the operation of the present embodiment is described.

FIG. 21 is a conceptual diagram showing the relationship among first image data, second image data, third image data, dot formation position causing ink deflection, and any selected pixel. FIG. 22 is a diagram showing the relationship between a pixel value and a dot size. FIGS. 23A to 23C are all a diagram showing dot patterns with normal printing, with ink deflection, and with the invention applied, respectively.

In the present embodiment, as shown in the dot formation result of FIG. 23B, ink deflection is observed to dots formed by the nozzle N6 in the black nozzle module 50 similarly to the first embodiment. Compared with the ideal dot formation result of FIG. 23A, in the dot pattern, the dots formed by the nozzle N6 causing ink deflection are displaced by the distance a toward the dots formed by the correct nozzle N7 on the right side. As a result, a white streak is observed between the dots formed by the nozzle N6 and the dots formed by the nozzle N5 on the left side.

When the printing data acquisition section 10 receives printing command information from any external device (step S400), the printing device 300 acquires first image data corresponding to the printing command information from the external device or others being the source of the information. The acquired first image data is forwarded to the printing data generation section 18 (step S402). After acquiring the first image data, the printing data generation section 18 starts executing the printing data generation process (step S404).

At the time of generating the printing data, a selection is made from the first image data for not-yet-processed image data of a predetermined region (step S500). Thus selected image data is increased in resolution so that the second image data is generated (step S502). In this example, the pixels are each increased in resolution by four times in the line direction. As shown in A of FIG. 21, assuming that target pixel data is in a line of the first image data of a predetermined region, as shown in B of FIG. 21, the number of the pixels is increased in the lateral direction for the line by four times so that the resolution is increased.

After the second imaged data is generated from the first image data of the predetermined region, information reading is then made from the nozzle information storage section 14, i.e., the nozzle characteristics information and the displacement amount information corresponding to the first image data of the predetermined region (step S504). Based on thus read information, the dot formation position is calculated for every pixel of the second image data (step S506).

After the dot formation position is calculated for the second image data, a selection is made from the first image data of the predetermined region for any not-yet-processed pixel data (step S508). Based on the nozzle characteristics information, a determination is then made whether the pixel data is causing ink deflection (step S510). When the determination is made as Yes, from the second image data, a selection is made from the pixel data corresponding to the selected pixel data for any being closest to the ideal dot formation position as the potential third pixel data (step S512). When the determination is No, on the other hand, the selected pixel data is selected as the potential third pixel data (step S522).

By referring to FIG. 21, assumed here is a case that the dot formation position corresponding to the pixel value of the second image data (B) is matched to the information about the dot formation position (D) of the printing head 200 provided to the printing device 300 of the invention. With this being the case, because the dot formation position located at fourth from the left is displaced by a dot toward the right due to ink deflection, the selected pixel (F) will be a pixel P4*a* that is corresponding to the dot formation position (D) in the second image data (B).

When such a selection of potential third pixel data is through with every pixel data of the predetermined region (step S514), any specific pixel data is determined for calculating an average value. Such a determination is made based on the ink deflection amount observed to a dot of the potential third pixel data and dots of its adjacent pixel data, and in this example, based on the dot-to-dot distance between the dot of the potential third pixel data and the dots of its adjacent pixel data. After such a determination, an average value is calculated for the pixel values of the pixel data, and corrects the pixel value of the potential third pixel data so that the third image data is generated (step S516).

As shown in F of FIG. 21, for example, through comparison, the dot-to-dot distance between the pixel P4*a* being the potential third pixel data and a pixel P5 on its right side is found obviously shorter than the dot-to-dot distance between the pixel P4*a* and a pixel P3 on its left side. If this is the case, the number of pixel data is assumed as being four for average calculation for use of correcting the pixels P4*a* and P5 having a narrow space therebetween. On the other hand, the number of pixel data is assumed as being five for average calculation for use of correcting the pixels P3 having a wide space with the pixel P4*a*. More in detail, for the pixel P4*a* causing ink deflection, and the pixel P5 having the short dot-to-dot distance with the pixel P4*a*, the number of pixel data is reduced for average calculation. On the other hand, for the pixel P5 having the long dot-to-dot distance from the pixel P4*a*, the number of pixel data is increased for average calculation. The resulting average value is then set as a pixel value of the third pixel data.

To be more specific, as shown in FIG. 21, for example, the pixel value of a pixel P2 when it is selected from the second image data is "18", and as shown in F of FIG. 21, the pixel value is increased to "17.5" as a result of "12+15+18+20+22"/5 after the correction process. Similarly, the pixel value of the pixel P3 is "26" at the time of selection, and the pixel value is considerably increased to "29.75" as a result of "22+24+26+28+30"/5 after the correction process. Moreover, the pixel value of the selected pixel P4*a* being adjacent to the selected pixel P3, and causing ink deflection is "36". After the correction process, the pixel value is decreased to "35" as a result of "32+34+36+38"/4. The pixel value of the selected pixel P5 adjacent to the pixel P4*a* is "42", and after the correction process, the pixel value is decreased to "41.5".

That is, the correction process is so executed as to increase the pixel value of the pixel showing the longer nozzle interval due to ink deflection, and decrease the pixel value of the pixel showing the shorter nozzle interval.

After the third image data is generated, the resulting third image data is binarized so that the printing data is generated (step S518).

The binarization in the present embodiment is similar to that in the first embodiment in principle. In this example, however, the brightness value of the pixel data is used as a basis therefor. That is, the brightness value of the pixel data is compared with the threshold value each set for a plurality of dot sizes that are in a possible size range for the nozzles depending on the density value of the pixel data. Based on the comparison result, a value of "1" is assigned for dot formation, and the value of "0" is assigned for no dot formation.

In the present embodiment, as shown in FIG. 22, three dot sizes of "large", "medium", and "small" are used. When the pixel data indicates the brightness value of "255", no dot is formed. When the pixel data indicates the brightness value in a range of "168 to 254, inclusive", dots of the size "small" are formed. When the pixel data indicates the brightness value in a range of "85 to 167, inclusive", dots of the size "medium" are formed. When the pixel data indicates the brightness value in a range of "0 to 83, inclusive", dots of the size "large" are formed.

After every pixel data in the image data is thoroughly through with the printing data generation process by binarization as such (step S520), the image data having been binarized is output to the printing section 20 as the printing data (steps 408).

In the printing section 20, based on the printing data thus provided by the printing data generation section 18, the black nozzle module 50 is used to perform dot formation (printing) on a printing medium (step S410).

As shown in FIG. 23C, in the formation result, the dots of the pixel column corresponding to the nozzle N6 causing ink deflection are larger in size compared with the formation result based on the printing data that is generated with no consideration given to the fact that the nozzle N6 is faulty, i.e., with no process execution of the invention, as shown in FIG. 23B. What is more, the dots are smaller and decimated often in the pixel column corresponding to the nozzle N7 showing the narrower dot-to-dot distance from the dots formed by the faulty nozzle N6 due to ink deflection.

This is caused by the correction process for the brightness value in the above. More in detail, the brightness value of any pixel showing the longer nozzle interval due to ink deflection is larger than original, and the brightness value of any pixel showing the shorter nozzle interval is smaller than original.

From a macroscopic viewpoint, compared with such an ideal printing result of FIG. 23A, in the printing result of FIG. 23C, the image texture is not smooth that much. However, compared with the printing result of FIG. 23B with no consideration to ink deflection, the phenomenon acknowledged as white and dark streaks can be made less noticeable.

What is more, based on the ink deflection amount, in this example, based on the dot-to-dot distance, the number of pixel data at the time of correction process is controlled so that the brightness value can be corrected to be more appropriate, thereby leading to the better image quality.

In the third embodiment described above, the image data acquisition section 10 corresponds to the image data acquisition unit of any one of the aspects of first, ninth, thirty-fourth, and forty-second. The nozzle information storage section 14 corresponds to the displacement amount information storage unit of the first or thirty-fourth aspect. The printing data generation section 18 corresponds to the printing data generation unit of any one of the aspects of first, seventh, ninth, thirty-fourth, fortieth, and forty-second. The printing section 20 corresponds to the printing unit of the first aspect.

In the third embodiment described above, step S402 corresponds to the image data acquiring of any one of the aspects of thirteenth, twenty-first, twenty-fourth, thirty-second, forty-fourth, fifty-second, fifty-fifth, and sixty-third. Step S404 corresponds to the printing data generating of any one of the aspects of thirteenth, nineteenth, twenty-first, twenty-fourth, thirtieth, thirty-second, forty-fourth, fiftieth, fifty-second, fifty-fifth, sixty-first, and sixty-third. Step S410 corresponds to the printing of the thirteenth or twenty-fourth aspect.

Fourth Embodiment

Described next is a fourth embodiment of the invention by referring to the accompanying drawings. FIGS. 24 and 31 are all a diagram showing the fourth embodiment of the invention, i.e., a printing device, a printing device control program and method, and a printing data generation device, program, and method.

The printing device of the fourth embodiment is similar in configuration as that of FIG. 18 of the third embodiment, and the computer system as that of FIG. 2 of the first to third embodiments. Moreover, in the fourth embodiment, the configuration of the printing head 200 is changed from that of FIG. 3 of the first to third embodiments to that of FIG. 24, and the printing data generation process in step S404 of FIG. 19 of the third embodiment is changed to that of FIG. 25.

The printing data generation process of FIG. 25 is of generating information, for use as printing data, about pixel formation based on the pixel values of image data using a reference dot and an enlarged dot. When the printing data is generated, the ink deflection amount is used as a basis to correct the formation size of the enlarged dots.

In the below, described are only such differences from the first to third embodiments, and any components similar to those in the first to third embodiments are provided with the same reference numerals and not described again.

As described above, the printing device 300 of the present embodiment is of a line-head type, and has the possible maximum printing resolution of 720 dpi. In such a line-head printing device, as shown in FIG. 24, a head A and a head B are configuring a line head. The heads A and B each carry nozzles at a pitch of 360 pdi (=1/360 inch) in the direction intersecting the nozzle disposition direction. The nozzles of the heads A and B are each occupying the width of a printing medium. The heads A and B are both disposed in the direction intersecting the nozzle disposition direction with a displacement of 720 dpi (=1/720 inch) therebetween. Such a line head is provided for each of four colors, i.e., cyan (C), magenta (M), yellow (Y), and black (K), and these line heads are arranged in the nozzle disposition direction with precision so that a printing head 400 is configured. With such a configuration, based on the printing data, the printing head 400 is moved in the nozzle disposition direction with respect to a printing medium while discharging liquid ink from the nozzles so that the image data can be printed with a single path.

By referring to FIG. 25, a printing data generation process in step S404 is described in detail.

FIG. 25 is a flowchart of the printing data generation process in the printing device 300.

The printing data generation process is of generating information, for use as printing data, about pixel formation based on the pixel values of image data using a reference dot and an enlarged dot. When the printing data is generated, the ink deflection amount is used as a basis to correct the formation size of the enlarged dots. When such a process is executed in step S404, as shown in FIG. 25, the procedure first goes to step S600.

In step S600, a binarization process is executed to pixels of the image data acquired by the image data acquisition section 10. The procedure then goes to step S602.

The binarization is performed similarly to the first and third embodiments with the technique of error diffusion. The frequency of the binarization process in step S600 is equivalent to a half of the possible maximum printing resolution for the printing device 300, i.e., 360 dpi.

In step S602, a selection is made from the image data having been subjected to binarization for any not-to-yet process of a predetermined region, i.e., before forming enlarged dots. The procedure then goes to step S604.

In step S604, information reading is made from the nozzle information storage section 14, i.e., the nozzle characteristics information corresponding to the image data of a predetermined region selected in step S602, and displacement amount information, and then the procedure goes to step S606.

In step S606, a selection is made from the image data of the predetermined region for any not-yet-processed pixel data before formation of enlarged dots, and then the procedure goes to step S608.

In step S608, based on the nozzle characteristics information and the displacement amount information read in step S604, a determination is made whether the selected pixel data is causing ink deflection. When the determination is made as Yes, the procedure goes to step S610, and when No, the procedure goes to step S616.

Herein, the pixel data relating to ink deflection denotes the pixel data itself causing ink deflection, or the data formed next to the dots of the pixel data with a wider dot-to-dot distance from the dots of the pixel data causing ink deflection.

In step S610, because the selected pixel data is relating to ink deflection, generated is information about forming a reference dot and an enlarged dot for the selected pixel data based on the pixel values of the selected pixel data and the information about the dot-to-dot information, and then the procedure goes to step S612.

Herein, the reference dot and the enlarged dot are both based on the result of binarization in step S600. Generated here is information about forming a reference dot and an enlarged dot by dividing a dot into two to keep the density derived by the binarization. Here, the dot to be divided is a dot that is originally supposed to be formed, and has a required density of about 360 dpi. To be more specific, in the present embodiment, dot formation is so performed that a reference dot is formed by the head A of FIG. 24, and then an enlarged dot is formed by the head B, for example. That is, in the present embodiment, the enlarged dot is formed adjacent to the reference dot wherever such dot formation is allowed, and using a nozzle next to a nozzle forming the reference dot, the enlarged dot is formed to a line next to that for the reference dot. Also generated is information about forming a reference dot and an enlarged dot in combination of a dot of large dot diameter and a dot of small dot diameter to make the dot diameter of the reference dot to be larger than the dot diameter of the enlarged dot. Also generated is information about forming a reference dot and an enlarged dot with the density of natural multiple of the density of minimum-diameter dots that are in a possible size range for the nozzles, i.e., the density per unit area to be precise. The enlarged dot is to have the diameter as a result of correcting the minimum dot diameter based on ink deflection amount, i.e., with no ink deflection, the minimum dot diameter itself. Note here that the resolution at this time will be $1/\sqrt{2}$ times of the possible maximum printing resolution of the printing device 300.

In step S612, a determination is made whether the pixel data in the image data of the predetermined region is thoroughly through with the process of generating enlarged dots. When the determination is made as Yes, the procedure goes to step S614, and when No, the procedure returns to step S606 to continue the process.

In step S614, a determination is made whether the image data is thoroughly through with the enlarged dot generation process. When the determination is made as Yes, the series of processes are ended and the procedure returns, and when No, the procedure returns to step S602 to continue the process. Here, the resulting information about forming the reference dot and the enlarged dot is the printing data.

By referring to FIGS. 26 to 31, described next is the operation of the present embodiment.

FIG. 26 is a diagram showing the relationship between a dot diameter and a density. FIG. 27 is a diagram for illustrating the principles of formation of reference dot and enlarged dot. FIGS. 28A to 28C are all a diagram showing an exemplary case of generating a reference dot and an enlarged dot when any selected pixel data has nothing to do with ink deflection. FIG. 29 is a diagram showing the relationship between the amount of ink deflection and the correction ratio of the enlarged dot diameter. FIGS. 30A to 30D are all a diagram showing an exemplary case of generating a reference dot and an enlarged dot when any selected pixel data has something to do with ink deflection. FIG. 31 is a diagram showing an exemplary printing result using printing data after a correction process.

In the printing data generation process, the image data is subjected to binarization (step S600), and a selection is then made from the resulting image data for image data of a predetermined region (step S602). Information reading is then made from the nozzle information storage section 14 for the nozzle characteristics information and the displacement amount information corresponding to the image data of the predetermined region (step S604). Another selection is then made from the image data of the predetermined region for not-yet-processed pixel data (step S606), and a determination is then made whether the selected pixel data is relating to ink deflection (step S608).

The determination factor about whether the pixel data is relating to ink deflection or not is the nozzle characteristics information read from the nozzle information storage section 14, i.e., whether the corresponding nozzle is causing ink deflection, and whether the nozzle corresponding to the pixel data next to the selected pixel data is causing ink deflection. Using such a determination factor to check whether any ink deflection is observed with the selected pixel data, and when ink deflection is observed to the pixel data next to the selected pixel data, in which direction with what amount of the ink deflection, i.e., whether the resulting dot is displaced toward right or left (limited, to right or left in this example) and with which amount, i.e., ink deflection amount. By taking these into consideration, information about forming a reference dot and an enlarged dot is generated.

Prior to describing about generating a reference dot and an enlarged dot, by referring to FIG. 26, described is the density, i.e., required density value, equivalent to the dot diameter to be defined by the present embodiment. In the present embodiment, dot formation is so performed that the pixels of the image data are corresponding to the tone levels of 0%, 10%, 20%, 30%, 40%, 50%, 60%, 70%, 80%, 90%, and 100%, respectively. Because no dot is formed with 0%, the minimum dot diameter allowed to be formed by nozzles is corresponding to the density of 10%, and the density of the remaining dot diameters are the integral multiple of the density of the minimum dot diameter, i.e., the density per unit area to be precise. The binarization in step S600 is equivalent to a half of the possible maximum printing resolution of the printing device 300, i.e., 360 dpi, and thus the density of 100% is of the size completely covering the matrix of pitch P of 360 dpi (=1/360 inch). Here, because the unit area of the matrix is $P^2$, the radius of $R_{10}$ of a dot having the density of 100% is $P/\sqrt{2}$. On the other hand, defining that the dot area of the density of X % is $P^2 \times X/100$, the radius $R_{X/10}$ of a dot having the density of X % is $P \times \sqrt{(X/100/\pi)}$. That is, as shown in FIG. 26, the dot radius $R_{80}$ of the density 80% is 0.505 P, the dot radius $R_{60}$ of the density 60% is 0.437 P, the dot radius $R_{40}$ of the density 40% is 0.357 P, and the dot radius $R_{20}$ of the density 20% is 0.252 P.

As described in the foregoing, in an attempt to generate a reference dot and an enlarged dot while keeping the density per unit area, i.e., the required density value equivalent to a half of the possible maximum printing resolution of the printing device 300 as a result of binarization, the resulting reference dot and enlarged dot corresponding to the required density value each have the dot diameter of FIG. 27, for example. With this being the case, based on the premise that a reference dot and en enlarged dot are generated in combination of a dot of large dot diameter and a dot of small dot diameter, an enlarged dot is formed adjacent to a reference dot at a position whenever allowed for dot formation, i.e., if the head A of the line head of FIG. 24 is used to form a reference dot, the head B is used for forming an enlarged dot for the next line. Also, an enlarged dot is formed by a nozzle adjacent to a nozzle forming a reference dot, i.e., an adjacent nozzle in the possible maximum printing resolution to be precise, to a line next to that formed with the reference dot, and the dot diameter of the reference dot is made larger than that of the enlarged dot.

That is, as exemplarily shown in the drawing, a reference dot and an enlarged dot with the required density value of 80% will form a zigzag pattern on the matrix of the possible maximum printing resolution. The distance between the reference dot and the enlarged dot is $\sqrt{2}/720$ inch, and the resolution is $720/\sqrt{2}$. To achieve the required density value of 100% for such reference dot and the enlarged dot, the reference dot and the enlarged dot may be both set to 80%. To achieve the required density value of 80%, the reference dot may be set to 60%, and the enlarged dot may be set to 20%. To achieve the required density value of 60%, the reference dot may be set to 40%, and the enlarged dot may be set to 20%. To achieve the required density value of 40%, the reference dot and the enlarged dot may be both set to 20%. To achieve the required density value of 20% for the reference dot and the enlarged dot, the reference dot may be set to 20%, and no enlarged dot may be formed.

Based on such principles, described next is a process of generating information for forming a reference dot and an enlarged dot. As coordinates of a matrix corresponding to the possible maximum printing resolution of the printing device 300, as shown in FIGS. 28A to 28C, with the upper left being 0, x coordinate is directed in the right direction, and y coordinate is directed in the downward direction, for example.

Assuming that the selected image data is not relating to ink deflection, when the required density for the density P[x, y] of the coordinates [x, y] is 80%, 60%, and 40%, the density of the reference dot may be set to 60%, 40%, and 20%, and the density of the enlarged dot may be all set to 20%. On the other hand, when the required density is 100%, for example, the density of the reference dot and that of the enlarged dot are both set to 80%. When the required density is 20%, 10%, and 0%, the density of the reference dot may be set to 20% and 10%, and the density of the enlarged dot may be set to 0% (no dot formation), for example (step S616).

To be specific, when the required density P[0,0] of the coordinates [0,0] is 100% as shown in FIG. 28A, the dot diameter of a reference dot to be formed on the coordinates [0,0] will be 80%, and the dot diameter of an enlarged dot to be formed on the coordinates located at the lower right to the coordinates [0,0], i.e., [1,1], will be 20% as shown in FIG. 28B. Similarly, when the required density P[2,0] of the coordinates [2,0] as a result of binarization is 80% as shown in FIG. 28A, by referring to FIG. 28B, the dot diameter of a reference dot to be formed on the coordinates [2,0] will be 60%, and the dot diameter of an enlarged dot to be formed on the coordinates located at the lower right to the coordinates [2,0], i.e., [3,1], will be 20%. When the required density of P[4,0] of the coordinates [4,0] as a result of binarization is 20% as shown in FIG. 28A, by referring to FIG. 28B, the dot diameter of a reference dot to be formed on the coordinates [4,0] will be 20%, and the dot diameter of an enlarged dot to be formed on the coordinates located at the lower right to the coordinates [4,0], i.e., [5,1], will be 0% (in a real-world situation, no enlarge dot is formed). When the required density of P[0,2] of the coordinates [0,2] as a result of binarization is 60% as shown in FIG. 28A, by referring to FIG. 28B, the dot diameter of a reference dot to be formed on the coordinates [0,2] will be 40%, and the dot diameter of an enlarged dot to be formed on the coordinates located at the lower right to the coordinates [0,2], i.e., [3,1], will be 20%. When the required density of P[2,2] of the coordinates [2,2] as a result of binarization is 40% as shown in FIG. 28A, by referring to FIG. 28B, the dot diameter of a reference dot to be formed on the coordinates [2,2] will be 20%, and the dot diameter of an enlarged dot to be formed on the coordinates located at the lower right to the coordinates [2,2], i.e., [3,3], will be 20%. When the required density of P[4,2] of the coordinates [4,2] as a result of binarization is 0% as shown in FIG. 28A, by referring to FIG. 28B, the dot diameter of a reference dot to be formed on the coordinates [4,2] will be 0%, and the dot diameter of an enlarged dot to be formed on the coordinates located at the lower right to the coordinates [4,2], i.e., [5,3], will be also 0% (in a real-world situation, no enlarge dot is formed).

As such, as shown in FIG. 28C, the reference dots and the enlarged dots form a zigzag pattern on the matrix of the possible maximum printing resolution of the printing device 300. The dummy resolution will be $1/\sqrt{2}$ times of the possible maximum printing resolution. As described above, the frequency of the binarization is equivalent to a half of the possible maximum printing resolution so that the frequency of the binarization can be reduced compared with the dummy resolution.

On the other hand, when the selected pixel data is relating to ink deflection, for the required density of the selected pixel data P[x,y], the density is determined for the reference dot and the enlarged dot in a similar manner to the case where the selected pixel data has nothing to do with the ink deflection. Thus determined density of the reference dot and the enlarged dot is then corrected based on the direction and amount of the ink deflection (step S610). Such a correction process is executed based on the relationship between the dot-to-dot distance and the correction ratio of the enlarged dot of FIG. 29. When the ink deflection causes the dot-to-dot distance from the adjacent dot to be narrower than ideal, the density of the enlarged dot is decreased by the correction ratio corresponding to the ink deflection of FIG. 29, and then the density of the reference dot is increased by the decreased density. On the other hand, when the ink deflection causes the dot-to-dot distance from the adjacent dot to be wider than ideal, the density of the enlarged dot is increased by the correction ratio corresponding to the ink deflection of FIG. 29, and then the density of the reference dot is decreased by the increased density. In the present embodiment, as indicated by dotted lines of FIG. 29, when the ink deflection is in a range of a predetermined value or smaller, no correction is applied to the reference dot nor the enlarged dot (correction ratio of 0%).

Considered here is a case where, as to the density (required density) P[x,y] of the coordinates [x,y] of the selected pixel data, the density of the reference dot is 40%, and the density of the enlarged dot is 20%. In such a case, when the ink deflection amount is of 4 [μm], 5.5 [μm], and 6 [μm], when the ink deflection direction is toward left, and when the selected pixel is located to the left of the pixel data causing ink deflection, the dot-to-dot distance will be narrower due to the ink deflection is directed to left, leading to the positive correction of the density of the enlarged dot. Accordingly, based on the relationship of FIG. 29, the enlarged dot will be changed in density from 20% to 30%, i.e., the correction amount of 4 [μm] is +10%. Similarly, the enlarged dot will be changed in density from 20% to 40%, i.e., the correction amount of 5.5 [μm] is +20%, and the enlarged dot will be changed in density from 20% to 50%, i.e., the correction amount of 6 [μm] is +30%. Through such density correction made to the enlarged dot, the reference dot is changed in density from 40% to 30%, 20%, and 10%, respectively.

On the other hand, when the ink deflection is directed toward right with the remaining conditions are the same as above, the correction amount of FIG. 29 will be negative contrarily to the above, and the density of the enlarged dot of 20% will be 10% with the correction amount of −10% for 4 [μm], and similarly, the density of the enlarged dot of 20% will be 0% (no dot will be formed) with the correction amount of −20% and −30% for 5.5 [μm] and 6 [μm], respectively. What is more, the density of the reference dot will be corrected in value from 40% to 50%, 60%, and 70%, respectively.

Figures 30A, 30B, 30C, 30D:
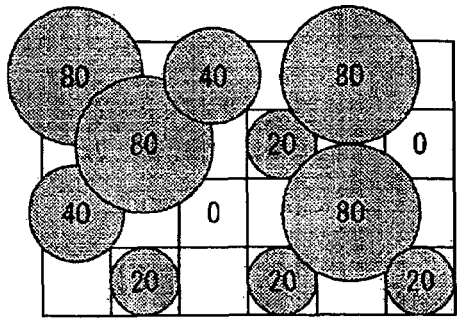

To be more specific, as shown in FIGS. 30A to 30D, exemplified is a case where the x coordinate line of "4" is suffering from ink deflection with the amount of 5.5 [μm] and the direction toward right. In such a case, when the density P[3,1] of the enlarged dot on the coordinates [3,1] is 0% as shown in FIG. 30A, the correction amount for the 5.5 [μm] will be +20% as shown in FIG. 29. Accordingly, as shown in FIG. 30B, the dot diameter of an enlarged dot to be formed on the coordinates [3,1] will be 40%. Similarly, when the density P[3,3] of the enlarged dot on the coordinates [3,3] is 0% as shown in FIG. 30A, the dot diameter of an enlarged dot to be formed on the coordinates [3,3] will be 20% as shown in FIG. 30B. With this being the case, for the enlarged dot located on the right of the dot suffering from ink deflection, as shown in FIG. 29, the correction amount for the 5.5 [μm] will be −20%. Accordingly, as shown in FIG. 30B, when the density P[5,1] of the enlarged dot on the coordinates [5,1] is 20% as shown in FIG. 30A, the dot diameter of an enlarged dot to be formed on the coordinates [5,1] will be 0%. When the density P[5,3] of the enlarged dot on the coordinates [5,3] is 20% as shown in FIG. 30A, the dot diameter of an enlarged dot to be formed on the coordinates [5,3] will be also 0% as shown in FIG. 30B.

As shown in FIG. 30C, after the density correction made to the enlarged dots as such, to keep the balance with the density of the reference dots, the dot diameter of the reference dot on the coordinates [2,0] corresponding to the enlarged dot on the coordinates [3,1] is corrected to 40%. Similarly, the dot diameter of the reference dot on the coordinates [2,2] corresponding to the enlarged dot on the coordinates [3,3] is corrected to 20%, the dot diameter of the reference dot on the coordinates [4,0] corresponding to the enlarged dot on the coordinates [5,1] is corrected to 80%, and the dot diameter of the reference dot on the coordinates [4,2] corresponding to the enlarged dot at [5,3] is corrected to 80%.

As such, as shown in FIG. 30D, the reference dots and the enlarged dots form a zigzag pattern on the matrix of the possible maximum printing resolution of the printing device 300. The dummy resolution will be $1/\sqrt{2}$ times of the possible maximum printing resolution. This also increases the density (diameter) of the enlarged dot to be formed at the part where the dot-to-dot distance is wider than ideal due to ink deflection, and decreases the density (diameter) of the enlarged dot to be formed at the part where the dot-to-dot distance is narrower than ideal. This thus favorably allows to effectively eliminate white and dark streaks as a result of ink deflection, or make those less noticeable. What is more, as described above, the frequency of the binarization is equivalent to a half of the possible maximum printing resolution so that the frequency of the binarization can be reduced compared with the dummy resolution.

After the image data is thoroughly subjected to such a process (step S614), the resulting density values of the reference dot and the enlarged dot are used so that the printing data is generated. The reference dots and the enlarged dots formed by the printing data generated as such will look like, in enlarged version, those in FIG. 31. In the drawing, dots rather large in dot diameter are reference dots, and dots rather small in dot diameter are enlarged dots. Those are the results derived by applying the above-described process for a case where original required density is entirely 80%. Accordingly, in any part being free from ink deflection, the dot diameter of reference dots is 60%, and the dot diameter of enlarged dots is 20%. In any part suffering from ink deflection, the reference dots and the enlarged dots are all corrected with their dot diameters. In the drawing, any part of displaced matrix for the maximum printing density as indicated by arrows is the part in which the dot formation position is not ideal due to ink deflection. As far as FIG. 31 is related, the above-described white and dark streaks are not observed so that no banding problem is occurring.

As such, according to the printing device of the present embodiment, the tone level of the image data is converted, i.e., subjected to binarization, into the density equivalent to the dot diameter in the direction at least intersecting the nozzle disposition direction with a predetermined resolution lower than the possible maximum printing resolution, i.e., a half of the possible maximum printing resolution of the present embodiment. In such a manner as to keep the density derived by the binarization, reference dots and enlarged dots are generated at positions corresponding to the predetermined resolution lower than the possible maximum printing resolution, i.e., corresponding to a half of the possible maximum printing resolution. At the time of generating the reference dots and the enlarged dots as such, the enlarged dots (dot diameter) are so formed as to be the size corresponding to the amount of displacement, i.e., amount of ink deflection. As such, the frequency of the binarization process can be reduced to a half of the possible maximum printing resolution. What is more, the image quality can be retained with granularity suppressed by individually generating reference dots and enlarged dots, and the banding problem can be favorably corrected.

In the fourth embodiment described above, the image data acquisition section 10 corresponds to the image data acquisition unit of the first, or thirty-fourth aspect. The nozzle information storage section 14 corresponds to the displacement amount information storage unit of the first or thirty-fourth aspect. The printing data generation section 18 corresponds to the printing data generation unit of any one of the aspects of first, tenth, thirty-fourth, and forty-third. The printing section 20 corresponds to the printing unit of the first aspect.

In the fourth embodiment described above, the step S402 corresponds to the imaged data acquiring of any one of the aspects of thirteenth, twenty-fourth, forty-fourth, and fifty-fifth. The step S404 corresponds to the printing data generating corresponds to any one of the aspects of thirteenth, twenty-second, twenty-fourth, thirty-third, forty-fourth, fifty-third, fifty-fifth, and sixty-fourth. The step S410 corresponds to the printing of the thirteenth or twenty-fourth aspect.

The printing devices of the first to fourth embodiments are characterized in the respect that image data is converted into printing data with consideration given to the characteristics of a printing head without tailoring any existing printing device. Accordingly, there is no need to provide any specific component serving as the printing section 20, but an ink jet printer that has been on the market can be used as it is. What is more, by separating the printing section 20 from the printing devices 100 and 300 of the first to fourth embodiments, the component function can be implemented only by any general-purpose printing command terminal (printing data generation unit) such as PCs.

Not only to an ink deflection problem, the invention is surely applicable also to a problem of causing the same phenomenon as the ink deflection to dots to be formed, which is resulted from the nozzles not at their ideal positions even if the ink discharge direction is perpendicular, i.e., correct.

The printing devices 100 and 300 of the first to fourth embodiments are applicable not only to line-head ink jet printers but also to multi-path ink jet printers. With the line-head ink jet printers, even if an ink deflection problem is observed, the printing result can be derived by a single path with the high quality of white or dark streaks hardly noticeable. With the multi-path ink jet printers, the frequency of the reciprocating operation can be reduced so that the higher-speed printing can be achieved.

FIGS. 32A to 32C are all a diagram illustrating a printing scheme of a line-head ink jet printer, and that of a multi-path ink jet printer.

As shown in FIG. 32A, it is assumed that the width direction of a rectangular printing paper S is the main scanning direction of the image data, and the longitudinal direction of the printing paper S is the sub scanning direction (printing direction) of the image data. By referring to FIG. 32B, the line-head ink jet printer is provided with the printing head 200 having the width of the printing paper S. The printing head 200 is fixed, and the printing paper S is moved with respect to the printing head 200 in the sub scanning direction so that the printing can be completed with a single scan, i.e., a single path operation. Alternatively, as a flat-head scanner, the printing paper S may be fixed, and the printing head 200 may be moved in the direction vertical to the nozzle disposition direction. Still alternatively, both the printing paper and the printing head may be moved in each opposite direction for printing. On the other hand, as shown in FIG. 32C, the multi-path ink jet printer is provided with the printer head 200 being rather short in width compared with the paper width. Such a printing head 200 is positioned in the direction orthogonal to the main scanning direction of the image, and is frequently reciprocated in the main scanning direction of the image so that the printing paper S is moved in the sub scanning direction of the image by a predetermined pitch for printing. As such, although the multi-path ink jet printer has a drawback of taking longer printing time compared with the line-head ink jet printer, it also has an advantage of correcting the above-described banding problem, specifically white streaks, to some extent due to its configuration of possibly placing the printing head 200 at any arbitrary position.

Exemplified in the above embodiments is an ink jet printer that performs printing by discharging ink in dots. This is not restrictive, and the invention is surely applicable to any other types of printing device using a printing head provided with printing mechanisms in line, or thermal head printers called thermal transfer printers, thermal printers, and the like.

FIG. 3 shows the printing head 200 including the nozzles modules 50, 52, 54, and 56, discharging their corresponding color, and the nozzle modules each carry nozzles N in line in the longitudinal direction of the printing head 200. As shown in FIG. 33, alternatively, the nozzle modules 50, 52, 54, and 56 may be configured by a plurality of short-length nozzle units 50*a*, 50*b*, . . . 50*n*, those of which are arranged in the movement direction of the printing head 200. Especially if the nozzle modules 50, 52, 54, and 56 are each configured by such short-length nozzle units 50*a*, 50*b*, . . . 50*n*, the dot-to-dot distance (pitch) can be substantially much shorter without narrowing the actual dot-to-dot distance. This favorably leads to a measure that can be taken with ease with respect to the resolution-increased image.

Exemplified in the above first to fourth embodiments are the printing devices 100 and 300 including the nozzle characteristics detection section 16 to be ready for deterioration with time, or others. This is surely not restrictive, and the printing device 100 is not necessarily provided with the nozzle characteristics detection section 16. With this being the case, as an alternative to the nozzle characteristics information and the displacement amount information, used may be the detection result derived at the time of shipment, or the detection result derived after shipment using a specific detection unit or others provided separately from the printing device 100. The detected nozzle characteristics information and the displacement amount information are stored in the nozzle information storage section 14. Although such a configuration disables redetection of the nozzle characteristics when deterioration with time is observed or any data corruption occurs, the expensive devices such as scanners are not required any more for detecting the nozzle characteristics and the dot formation position so that the cost can be effectively reduced to a considerable degree.

In the above third embodiment, exemplified is a case of increasing the resolution of the image data in the column direction of the nozzles. This is not restrictive, and the resolution may be increased in the line direction of the image data, i.e., by multiplying the number of pixels in the line direction by integer, or the resolution may be increased in the entire image, i.e., by multiplying the number of pixels in the line and column directions by integer.

In the above fourth embodiment, the density value of the enlarged dots is corrected with consideration given only to ink deflection observed to nozzles in charge of forming the reference dots. This is not restrictive, and the correction may be applied also with consideration given to ink deflection in charge of forming the enlarged dots. That is, the relationship of FIG. 29 may be provided not only to the reference dots but also to the enlarged dots, and even if the nozzles for the reference dots are normal, when the nozzles for the enlarged dots are suffering from ink deflection, the amount and direction of the ink deflection are used as a basis to correct the density value of the enlarged dots.

When ink deflection is observed to the both nozzles forming the reference dots of a line and the enlarged dots of the adjacent line, the density value of the enlarged dots is corrected with consideration given to the ink deflection amount and direction occurring to those both.

In the above fourth embodiment, for the reference dots and the enlarged dots suffering from no ink deflection, a setting is so made that the dot diameter of the reference dots is smaller than that of the enlarged dots. This is surely not restrictive, and in any part suffering from no ink deflection, the dot diameter of the reference dots may be the same as that of the enlarged dots.

With this being the case, the granularity becomes less noticeable, and the printing quality of the imaged data can be improved.

What is more, in the above fourth embodiment, the graph showing the relationship between the ink deflection amount and the correction ratio is used for two cases, i.e., a case with the wider dot-to-dot distance (white streaks), and a case with the narrower dot-to-dot distance (dark streaks). This is surely not restrictive, and any appropriate relationship may be derived for the white and dark streaks, respectively, and each different graph may be used.

The printing device 300 of the fourth embodiment is limited with the dot diameter for selection. Therefore, if the diameter of the enlarged dots is to be corrected to 15% based on the ink deflection amount, the printing head 200 is allowed to have ten types of the dot diameter, i.e., 0%, 10%, 20%, 30%, 40%, 50%, 60%, 70%, 80%, 90%, and 100%, not possible with the dot diameter of 15%. With this being the case, dots with the dot diameter of 10% and dots with the dot diameter of 20% may be formed with a ratio of 50:50 so that the originally-impossible dot diameter of 15% can be achieved. Alternatively, it may be possible to form dots with the dot diameter of 30% and dots with the dot diameter of 0% with a ratio of 50:50, however, using the dot size closer to the setting target size is considered preferable in view of granularity. If this is the case, the enlarged dots may be so controlled as not to exceed the size of the reference dots, and this favorably prevents the granularity from accidentally becoming more noticeable as a result of correction applied to the enlarged dots.

What is claimed is:

1. A printing device that prints an image onto a printing medium using a printing head that includes a plurality of nozzles each being capable of dot formation to the printing medium, the printing device comprising:

an image data acquisition unit that acquires image data showing pixel values of M (M≧2) for the image;

a displacement amount information storage unit that stores information about an amount of a displacement observed to the printing medium by each of the nozzles between an actual dot formation position and an ideal dot formation position;

a printing data generation unit that generates printing data including information about dot formation details based on the acquired image data and the displacement amount information for each of the pixel values, and for use as the information about the dot formation details, generates information about reducing degradation of printing image quality due to a banding problem caused by the displacement between the actual dot formation position and the ideal dot formation position, and exercises control over generating the degradation-reducing information based on the displacement amount information, the printing data generation unit generating the degradation-reducing information with respect to pixels corresponding to at least either any of the nozzles showing the displacement of a predetermined amount or more or any of the other neighboring nozzles; and a printing unit that prints, based on the printing data, the image onto the printing medium using the printing head.

2. The printing device according to claim 1, wherein the printing data generation unit generates the degradation-reducing information with respect to pixels corresponding to at least either any of the nozzles showing the displacement of a predetermined amount or more or any of the other neighboring nozzles, but not with respect to pixels corresponding to at least any of the nozzles showing the displacement smaller than the predetermined amount or any of the other neighboring nozzles.

3. The printing device according to claim 1, wherein the printing data generation unit generates the degradation-reducing information with respect to pixels corresponding to at least either any of the nozzles relating to the banding problem or any of the other neighboring nozzles to have dots entirely or partially corresponding to the pixels changed in size to suit the displacement amount.

4. The printing device according to claim 3, wherein when a dot-to-dot distance between any adjacent two of the nozzles is wider than an ideal dot-to-dot distance due to the displacement, the printing data generation unit generates, for use as the degradation-reducing information, information about forming dots larger in the neighborhood of the wider dot-to-dot distance than a pixel value size in the image data acquired by the image data acquisition unit to suit the dot-to-dot distance.

5. The printing device according to claim 3, wherein when a dot-to-dot distance between any adjacent two of the nozzles is narrower than an ideal dot-to-dot distance due to the displacement, the printing data generation unit generates, for use as the degradation-reducing information, information about forming dots smaller in the neighborhood of the narrower dot-to-dot distance than a pixel value size in the image data acquired by the image data acquisition unit to suit the dot-to-dot distance, or information about decimating dots formed in the neighborhood of the narrower dot-to-dot distance.

6. The printing device according to claim 1, wherein the printing data generation unit exercises control over generating the degradation-reducing information to derive a match between an amount of the degradation-reducing information and the displacement amount.

7. The printing device according to claim 1, wherein the printing data generation unit generates, for use as the degradation-reducing information, information about changing a resolution of a printing image derived by at least either any of the nozzles relating to the banding problem or any of the other neighboring nozzles to be lower than a resolution of a printing image derived based on the pixel values originally of the image data acquired by the image data acquisition unit, and to be a resolution based on the displacement amount information.

8. The printing device according to claim 1, wherein the printing data generation unit converts the image data to change a resolution of an image having any of the pixel values corresponding to at least either any of the nozzles relating to the banding problem or any of the other neighboring nozzles to be higher than a resolution of a printing image derived based on the pixel values originally of the image data acquired by the image data acquisition unit, and generates the information about the dot formation details based on any of the pixel values selected from those of the resolution-increased image data by reason of being closest to a dot formation position of any of the nozzles corresponding to the original pixel values, and corrected based on any of the other not-selected pixel values and the displacement amount information.

9. The printing device according to claim 1, wherein the printing data generation unit generates information, for use as the information about the dot formation details, about any of the nozzles forming a reference dot at a position corresponding to a predetermined resolution that is lower than a possible maximum resolution for the printing device in a direction at least intersecting a nozzle disposition direction, and information about forming an enlarged dot at a position different from the reference dot, and exercises control over generating the information to make a formation size of the enlarged dot to suit the displacement amount.

10. The printing device according to claim 1, wherein the printing head is configured by the nozzles successively disposed over a region wider than a region with the printing medium being attached.

11. The printing device according to claim 1, wherein the printing head takes charge of printing while reciprocating in a direction perpendicular to a paper feeding direction of the printing medium.

12. A printing device control program for control use of a printing device that prints an image onto a printing medium using a printing head that includes a plurality of nozzles each being capable of dot formation to the printing medium, the control program comprising, for process execution by a computer:

acquiring image data showing pixel values of M ($M \geqq 2$) for the image;

generating printing data including information about dot formation details for each of the pixel values based on the acquired image data and information about an amount of displacement observed to the printing medium by each of the nozzles between an actual dot formation position and an ideal dot formation position, and for use as the information about the dot formation details, generating information about reducing degradation of printing image quality due to a banding problem caused by the displacement between the actual dot formation position and the ideal dot formation position, exercising control over generating the degradation-reducing information based on the displacement amount information, and generating the degradation-reducing information with respect to pixels corresponding to at least either any of the nozzles showing the displacement of a predetermined amount or more or any of the other neighboring nozzles; and printing, based on the printing data, the image onto the printing medium using the printing head.

13. A printing device control method for control use of a printing device that prints an image onto a printing medium using a printing head that includes a plurality of nozzles each being capable of dot formation to the printing medium, the control method comprising:

acquiring image data showing pixel values of M ($M \geqq 2$) for the image;

generating printing data including information about dot formation details for each of the pixel values based on the acquired image data and information about an amount of displacement observed to the printing medium by each of the nozzles between an actual dot formation position and an ideal dot formation position, and for use as the information about the dot formation details, generating information about reducing degradation of printing image quality due to a banding problem caused by the displacement between the actual dot formation position and the ideal dot formation position, exercising control over generating the degradation-reducing information based on the displacement amount information, and generating the degradation-reducing information with respect to pixels corresponding to at least either any of the nozzles showing the displacement of a predetermined amount or more or any of the other neighboring nozzles; and printing, based on the printing data, the image onto the printing medium using the printing head.

* * * * *